US011353806B2

(12) United States Patent
Sakaguchi et al.

(10) Patent No.: US 11,353,806 B2
(45) Date of Patent: Jun. 7, 2022

(54) IMAGE FORMING APPARATUS CONFIGURED TO STOP CONVEYANCE OF SHEET FOR PRESCRIBED TIME PERIOD BEFORE CONVEYING SHEET TO PHOTOSENSITIVE DRUM WHEN SHEET IS FED FROM FIRST TRAY

(71) Applicant: BROTHER KOGYO KABUSHIKI KAISHA, Nagoya (JP)

(72) Inventors: Shintaro Sakaguchi, Nagoya (JP); Toshiyuki Sano, Aichi-ken (JP); Masahito Saeki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/862,772

(22) Filed: Apr. 30, 2020

(65) Prior Publication Data

US 2020/0356023 A1 Nov. 12, 2020

(30) Foreign Application Priority Data

May 7, 2019 (JP) ..... JP2019-087552

(51) Int. Cl.
*G03G 15/08* (2006.01)
*G03G 15/00* (2006.01)
*G03G 21/18* (2006.01)

(52) U.S. Cl.
CPC ..... *G03G 15/0813* (2013.01); *G03G 15/6508* (2013.01); *G03G 15/6558* (2013.01);
(Continued)

(58) Field of Classification Search
CPC ..... G03G 15/0813; G03G 15/6558; G03G 15/6508; G03G 21/1857;
(Continued)

(56) References Cited

U.S. PATENT DOCUMENTS 3,830,199 A * 8/1974 Saito ..... G03G 15/102 399/239
9,256,157 B2 * 2/2016 Tokudome ..... G03G 15/0812
(Continued)

FOREIGN PATENT DOCUMENTS

JP 2012-128017 A 7/2012

*Primary Examiner* — Walter L Lindsay, Jr.
*Assistant Examiner* — Laura Roth
(74) *Attorney, Agent, or Firm* — Scully, Scott, Murphy & Presser, P.C.

(57) ABSTRACT

An image forming apparatus includes: a photosensitive drum; a developing roller; a separation mechanism for moving the developing roller between a contacting position contacting the photosensitive drum and a separated position separated from the photosensitive drum; a first tray; a first sheet feed mechanism for feeding a sheet from the first tray toward the photosensitive drum; a first sheet sensor for detecting passage of the sheet at a prescribed position; and a controller. The controller of the image forming apparatus is configured to perform: when a printing operation is performed onto the sheet ted from the first tray, feeding the sheet in the first tray to the prescribed position and maintain the sheet; moving, on or after the first sheet sensor detects the sheet, the developing roller to the contacting position.

17 Claims, 26 Drawing Sheets

(52) U.S. Cl.
CPC ..... *G03G 21/1857* (2013.01); *G03G 2215/00383* (2013.01); *G03G 2215/00405* (2013.01); *G03G 2215/00721* (2013.01); *G03G 2215/0617* (2013.01); *G03G 2221/1657* (2013.01)

(58) Field of Classification Search
CPC . G03G 2221/1657; G03G 2215/00383; G03G 2215/00721; G03G 2215/0617; G03G 21/1821; G03G 21/1825; G03G 2215/00405
See application file for complete search history.

(56) References Cited

U.S. PATENT DOCUMENTS

2002/0048468 A1* 4/2002 Sakaizawa ..... G03G 15/0241 399/150
2003/0095815 A1* 5/2003 Nakagawa ..... G03G 15/0194 399/299
2005/0047822 A1* 3/2005 Hashimoto ..... G03G 21/1825 399/111
2005/0262394 A1* 11/2005 Yasukawa ..... G06F 11/0733 714/23
2008/0037035 A1* 2/2008 Okano ..... G03G 15/6579 358/1.1
2015/0076763 A1* 3/2015 Katsura ..... B65H 7/02 271/227
2015/0277279 A1* 10/2015 Suzuki ..... G03G 15/234 399/53
2016/0252843 A1* 9/2016 Kanno ..... G03G 15/0121 399/228
2018/0074448 A1* 3/2018 Endoh ..... G03G 15/0813
2020/0277155 A1* 9/2020 Sano ..... B65H 29/58
2020/0333727 A1* 10/2020 Sakaguchi ..... G03G 15/6564
2021/0011416 A1* 1/2021 Sakaguchi ..... G03G 15/50
2021/0116835 A1* 4/2021 Sakaguchi ..... G03G 15/0121

* cited by examiner

IMAGE FORMING APPARATUS CONFIGURED TO STOP CONVEYANCE OF SHEET FOR PRESCRIBED TIME PERIOD BEFORE CONVEYING SHEET TO PHOTOSENSITIVE DRUM WHEN SHEET IS FED FROM FIRST TRAY

CROSS REFERENCE TO RELATED APPLICATION

This application claims priority from Japanese Patent Application No. 2019-087552 filed May 7, 2019. The entire content of the priority application is incorporated herein by reference.

TECHNICAL FIELD

The present disclosure relates to an electrophotographic image-forming apparatus including a photosensitive drum and a developing roller.

BACKGROUND

Japanese Patent Application Publication No. 2012-128017 discloses an electrophotographic image forming apparatus in which a toner image is formed by way of contact development system. The image forming apparatus includes a mechanism for moving a developing roller toward and away from a photosensitive drum to contact and separate from the photosensitive drum in accordance with a rotation of a cam.

SUMMARY

In the image forming apparatus employing the contact development system to form a toner image on the photosensitive drum, it is effective to shorten a time period during which the developing roller and the photosensitive drum is in contact with each other in order to prolong the service life of the developing roller. The toner image is formed on the photosensitive drum at a developing position where the developing roller and the photosensitive drum are in contact with each other. Then, the toner image is moved, due to rotation of the photosensitive drum, to a transfer position where the toner image is transferred from the photosensitive drum to a sheet.

Here, it is preferable that the developing roller and the photosensitive drum make contact with each other such that the sheet reaches the transfer position at a timing when a leading end of the toner image formed on the photosensitive drum reaches the transfer position due to the rotation of the photosensitive drum.

A sheet conveying time period starts when a sheet accommodated in a sheet tray is picked up by a pick-up roller and ends when the sheet reaches the transfer position. This sheet conveying time period may vary depending on variation in position of the sheets within the sheet tray and slippage of the pick-up roller relative to the sheet. Particularly, in a case where the conveying time period varies to be excessively prolonged, a timing at which the developing roller and the photosensitive drum make contact with each other becomes earlier than the timing at which the sheet reaches the transfer position. That is, the developing roller and the photosensitive drum must wait for the arrival of the sheet at the transfer position while the developing roller and the photosensitive drum are in contact with each other.

In view of the foregoing, it is an object of the disclosure to provide an image forming apparatus capable of suppressing possibility of occurring a state where a developing roller and a photosensitive drum contacting with each other wait for arrival of a sheet even when a conveying time period from a timing at which the sheet is picked up to a timing at which the sheet reaches a transfer position varies.

In order to attain the above and other object, according to one aspect, the disclosure provides an image forming apparatus including: a photosensitive drum; a developing roller; a separation mechanism; a first tray; a first sheet feed mechanism; a first sheet sensor; and a controller. The developing roller is movable between a contacting position where the developing roller is in contact with the photosensitive drum and a separated position where the developing roller is separated from the photosensitive drum. The separation mechanism is configured to move the developing roller between the contacting position and the separated position. The first tray is configured to accommodate a sheet therein. The first sheet feed mechanism is configured to feed the sheet from the first tray toward the photosensitive drum. The first sheet sensor is positioned at a prescribed position between the first tray and the photosensitive drum and is configured to detect passage of the sheet. The controller is configured to perform: in a case where a printing operation is to be performed onto the sheet fed from the first tray, (a) controlling the first sheet feed mechanism to feed the sheet accommodated in the first tray to the prescribed position and maintain the sheet at the prescribed position; (b) controlling, on or after the first sheet sensor detects the sheet, the separation mechanism to move the developing roller to the contacting position; and (c) controlling, after a prescribed time period has elapsed since the first sheet sensor detects the sheet, the first sheet feed mechanism to feed the sheet from the prescribed position toward the photosensitive drum.

BRIEF DESCRIPTION OF THE DRAWINGS

The particular features and advantages of the disclosure will become apparent from the following description taken in connection with the accompanying drawings, in which.

DETAILED DESCRIPTION

Hereinafter, an image forming apparatus 1 according to one embodiment of the present disclosure will be described with reference to the accompanying drawings. In the present embodiment, the image forming apparatus 1 is a color printer.

In the following description, directions with respect to the image forming apparatus 1 will be referred to assuming that the image forming apparatus 1 is disposed in an orientation in which it is intended to be used. Specifically, a left side, a right side, an upper side, and a lower side in FIG. 1 will be referred to as a front side, a rear side, an upper side, and a lower side of the image forming apparatus 1, respectively. Further, a near side and a far side in FIG. 1 will be referred to as a right side and a left side, respectively.

<Overall Configuration of Image Forming Apparatus 1>

Figure 1:
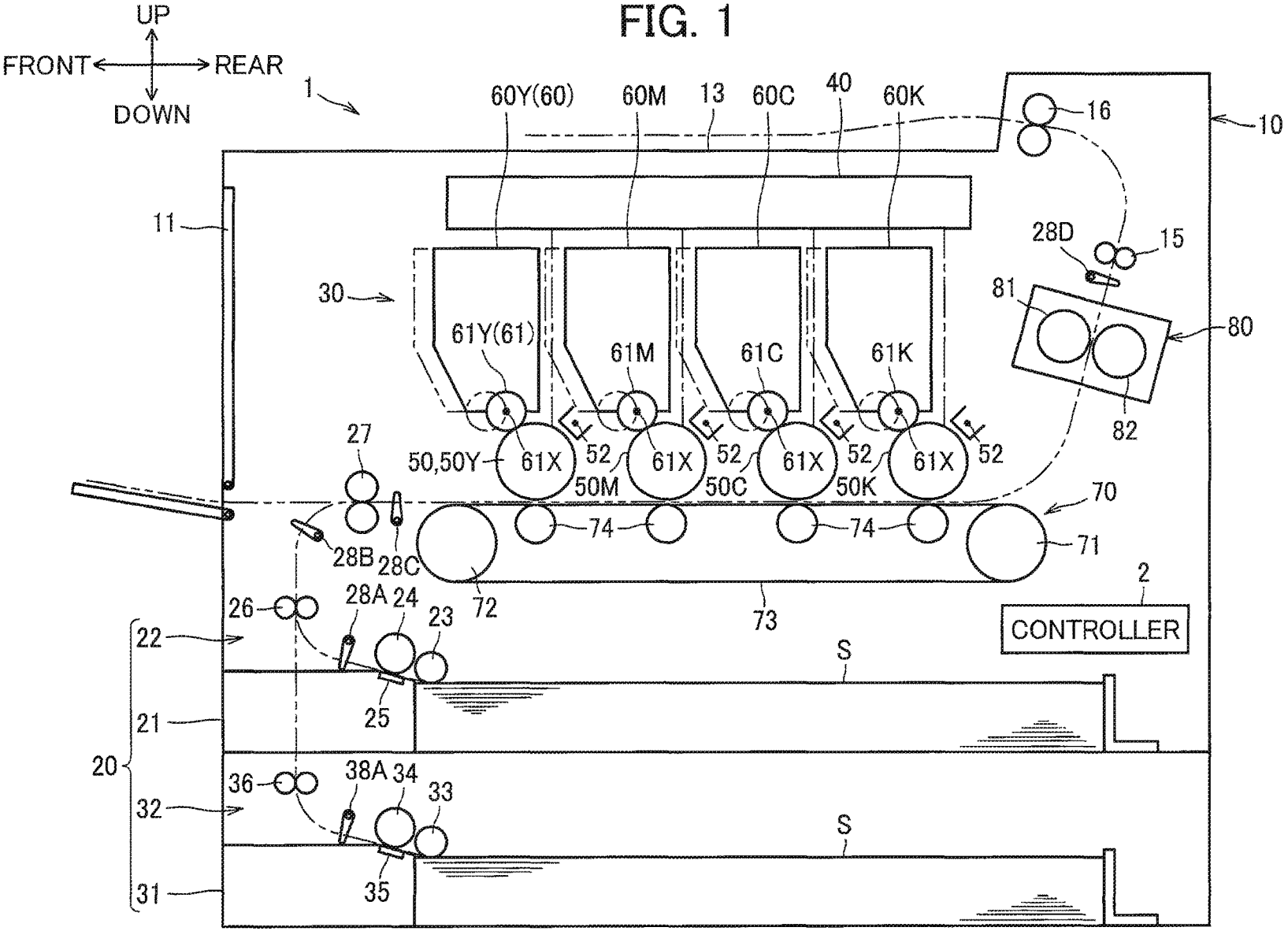
FIG. 1 is a schematic view of an image forming apparatus according to one embodiment of the present disclosure.

Referring to FIG. 1, the image forming apparatus 1 includes a housing 10, a sheet feed unit 20, an image forming unit 30, and a controller 2. The sheet feed unit 20, the image forming unit 30, and the controller 2 are disposed within the housing 10. The housing 10 is formed with a front opening, and includes a front cover 11 for opening and closing the front opening. Further, the housing 10 has an upper surface functioning as a discharge tray 13.

The sheet feed unit 20 is positioned at a lower portion within the housing 10, and includes a first tray 21, a second tray 31 those are configured to accommodate sheets S therein, a first sheet feed mechanism 22 configured to feed the sheets S from the first tray 21 toward the image forming unit 30 (photosensitive drums 50), and a second sheet feed mechanism 32 configured to feed the sheets S from the second tray 31 toward the image forming unit 30 (the photosensitive drums 50). The first tray 21 and the second tray 31 are detachable from the housing 10 through the front opening by pulling the same frontward (leftward in FIG. 1).

The second tray 31 is positioned below the first tray 21. Specifically, as indicated by two-dotted chain lines in FIG. 1, a length of a conveying path indicated by a two-dotted chain line between the second tray 31 and a photosensitive drum 50Y is greater than a length of a conveying path indicated by another two-dotted chain line between the first tray 21 and the photosensitive drum 50Y. In the present embodiment, the second tray 31 is positioned opposite to the photosensitive drums 50 with respect to the first tray 21.

The first sheet feed mechanism 22 is provided at a front portion within the housing 10, and includes a pick-up roller 23, a separation roller 24, a separation pad 25, conveyer rollers 26, and registration rollers 27. The second sheet feed mechanism 32 is also provided at the front portion within the housing 10, and includes a pick-up roller 33, a separation roller 34, a separation pad 35, conveyer rollers 36, the conveyer rollers 26, and the registration rollers 27. Note that the conveyer rollers 26 and the registration rollers 27 constitute both the first sheet feed mechanism 22 and the second sheet feed mechanism 32.

Incidentally, in the present disclosure, the sheet S is an example of an image forming medium on which an image can be formed by the image forming apparatus 1. For example, plain paper, an envelope, a post card, thin paper, thick paper, calendered paper, a resin sheet, and a seal are available as the sheet S.

In the sheet feed unit 20, the sheets S accommodated in the first tray 21 are configured to be fed by the pick-up roller 23, and then separated one by one by the separation roller 24 and the separation pad 25. Likewise, the sheets S accommodated in the second tray 31 are configured to be fed by the pick-up roller 33, and then separated one by one by the separation roller 34 and the separation pad 35. Subsequently, a position of a leading edge of each sheet S is configured to be regulated by the registration rollers 27 whose rotation is halted, and the sheet S is then configured to be supplied to the image forming unit 30 by the rotation of the registration rollers 27.

A plurality of sheet sensors configured to detect passage of the sheet S therethrough is provided upstream of the photosensitive drum 50Y in a direction in which the sheets S are conveyed (hereinafter referred to as "sheet conveying direction"). Specifically, the sheet sensors include a first sheet feed sensor 28A, a front sensor 28B, a back sensor 28C, and a second sheet feed sensor 38A.

The front sensor 28B is positioned downstream of the first and second sheet feed sensors 28A and 38A and upstream of the registration rollers 27 in the sheet conveying direction. Specifically, the front sensor 28B is positioned between the conveyer rollers 26 and the registration rollers 27 in the sheet conveying direction. The back sensor 28C is positioned between the registration rollers 27 and the photosensitive drum 50Y in the sheet conveying direction.

The first sheet feed sensor 28A is configured to initially detect passage of the sheet S delivered from the first tray 21, and is positioned between the first tray 21 and the photosensitive drum 50Y in the sheet conveying direction. Specifically, the first sheet feed sensor 28A is positioned between the separation roller 24 and the conveyer rollers 26 in the sheet conveying direction.

The second sheet feed sensor 38A is configured to initially detect passage of the sheet S delivered from the second tray 31, and is positioned between the second tray 31 and the photosensitive drum 50Y in the sheet conveying direction. Specifically, the second sheet feed sensor 38A is positioned between the separation roller 34 and the conveyer rollers 36 in the sheet conveying direction. Incidentally, the first sheet feed sensor 28A is an example of a "first sheet sensor", and the second sheet feed sensor 38A is an example of a "second sheet sensor".

The image forming unit 30 includes an exposure device 40, the plurality of photosensitive drums 50, a plurality of developing cartridges 60, a conveying device 70, and a fixing device 80.

The exposure device 40 includes a laser diode, a deflector, lenses, and mirrors those not illustrated. The exposure device 40 is configured to emit laser beams to expose surfaces of the respective photosensitive drums 50 to scan the surfaces.

The photosensitive drums 50 include: a first photosensitive drum 50Y for a first color of yellow; a second photosensitive drum 50M for a second color of magenta; a third photosensitive drum 50C for a third color of cyan; and a fourth photosensitive drum 50K for a fourth color of black. Throughout the specification and the drawings, in a case where colors must be specified, members or components corresponding to the colors of yellow, magenta, cyan and black are designated by adding "Y", "M", "C" and "K", respectively. On the other hand, in a case where distinction of colors is unnecessary, the addition of "Y", "M", "C" and "K" is omitted and naming of "first" through "fourth" is also omitted.

Four of the developing cartridges 60 are provided in one-to-one correspondence with respect to the four photosensitive drums 50. Specifically, the developing cartridges 60 include: a first developing cartridge 60Y including a first developing roller 61Y for supplying toner to the first photosensitive drum 50Y; a second developing cartridge 60M including a second developing roller 61M for supplying toner to the second photosensitive drum 50M; a third developing cartridge 60C including a third developing roller 61C for supplying toner to the third photosensitive drum 50C; and a fourth developing cartridge 60K including a fourth developing roller 61K for supplying toner to the fourth photosensitive drum 50K.

The first developing roller 61Y, the second developing roller 61M, the third developing roller 61C, and the fourth developing roller 61K are arranged in line in this order toward downstream in the sheet conveying direction.

Each developing cartridge 60 is movable between a position where the developing roller 61 is at a contacting position in contact with the corresponding photosensitive drum 50 (indicated by a solid line in FIG. 1) and a position where the developing roller 61 is at a separated position separated from the corresponding photosensitive drum 50 (indicated by a dashed line in FIG. 1).

Figure 2:
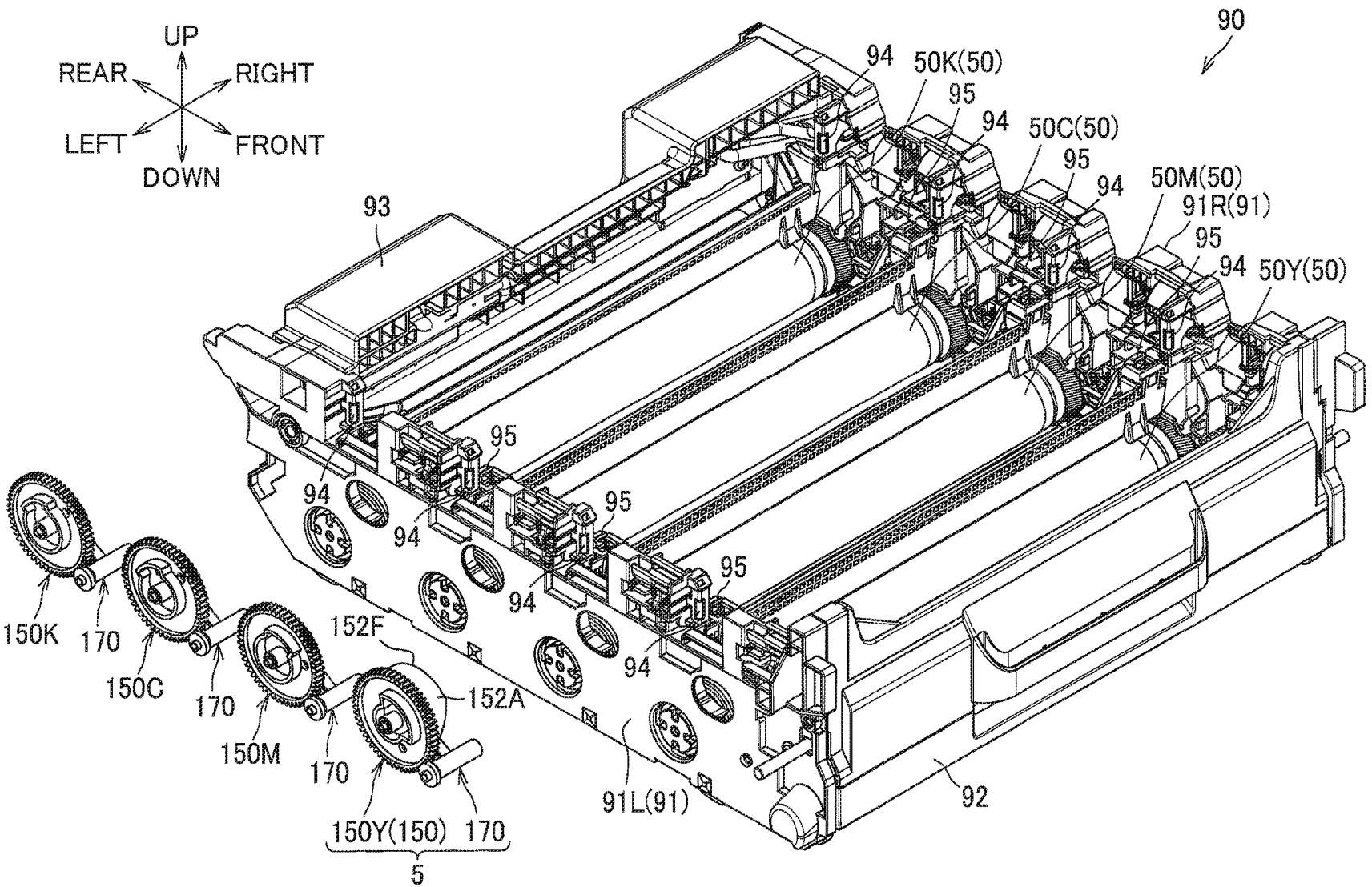
FIG. 2 is a perspective view of a support member, a cam, and a cam follower in the image forming apparatus according to the embodiment.

As illustrated in FIG. 2, the photosensitive drums 50 are rotatably supported by a support member 90. Further, the support member 90 detachably supports the four developing cartridges 60. The support member 90 is attachable to and detachable from the housing 10 through the front opening when the front cover 11 is opened.

The support member 90 includes a pair of side frames 91 including a right side frame 91R and a left side frame 91L, a front connection frame 92, and a rear connection frame 93. The right side frame 91R and the left side frame 91L are spaced apart from each other in an axial direction of the photosensitive drums 50. The front connection frame 92 connects a front end portion of the right side frame 91R to a front end portion of the left side frame 91L, and the rear connection frame 93 connects a rear end portion of the right side frame 91R to a rear end portion of the left side frame 91L. Chargers 52 (see FIG. 1) are also provided in the support member 90. Each charger 52 is positioned to face corresponding one of the photosensitive drums 50 for charging the same.

The image forming apparatus 1 further includes four separation mechanisms 5 (see FIG. 2) each configured to move the developing roller 61 between the contacting position in contact with the corresponding photosensitive drum 50 and the separated position away from the corresponding photosensitive drum 50. The four separation mechanisms 5 are provided for the first through fourth colors in one-to-one correspondence.

Specifically, each separation mechanism 5 includes a cam 150 (150Y, 150M, 150C and 150K), and a cam follower 170. The cam 150 is rotatable about a rotation axis extending parallel to a rotation axis 61X (see FIG. 1) of the corresponding developing roller 61. The cam 150 includes a first cam portion 152A protruding in a direction in which the rotation axis 61X of the developing roller 61 extends (hereinafter simply referred to as "axial direction"). The first cam portion 152A has an end face serving as a cam surface 152F.

The cam follower 170 is in contact with the cam surface 152F, and is movable between an operating position (illustrated in FIG. 4B) for positioning the developing roller 61 at the separated position and a standby position (illustrated in FIG. 4A) for positioning the developing roller 61 at the contacting position. The cam follower 170 is slidingly movable in the axial direction to the operating position by the contact with the cam surface 152F to apply a pressing force to the corresponding developing cartridge 60, thereby separating the developing roller 61 from the corresponding photosensitive drum 50. The cam follower 170 is separated from the developing cartridge 60 when the cam follower 170 is at the standby position.

Turning back to FIG. 2, the cam 150 and the cam follower 170 corresponding thereto are provided for each developing cartridge 60. The cam 150 and the cam follower 170 are positioned leftward of the left side frame 91L, i.e., outward of the left side frame 91L in a leftward/rightward direction. The cam 150 and the cam follower 170 will be described in detail later.

Counterpart abutment portions 94 are provided on respective upper portions of the side frames 91R and 91L of the support member 90. The counterpart abutment portions 94 are configured to abut slide members 64 (see FIG. 3A) described later. Each counterpart abutment portion 94 is in a form of a roller rotatable about an axis extending in a third direction (upward/downward direction) perpendicular to a first direction in parallel to the axial direction of the photosensitive drum 50 and a second direction (frontward/rearward direction) in which the photosensitive drums 50 are juxtaposed.

The support member 90 also includes a plurality of pressure members 95 corresponding to the respective developing cartridges 60. For each developing cartridge 60, two of the pressure members 95 are positioned one each outward of the corresponding photosensitive drum 50 in the axial direction thereof. Each of the pressure members 95 is urged rearward by a spring 95A (see FIGS. 4A and 4B). In accordance with the attachment of the developing cartridge 60 to the support member 90, each of the pressure members 95 is pressed against the corresponding developing cartridge 60 (specifically, a protrusion 63D of the developing cartridge 60 (see FIGS. 3A through 4B) as will be described later) by an urging force of the spring 95A, to permit the corresponding developing roller 61 to be in pressure contact with the corresponding photosensitive drum 50.

Figure 3A:
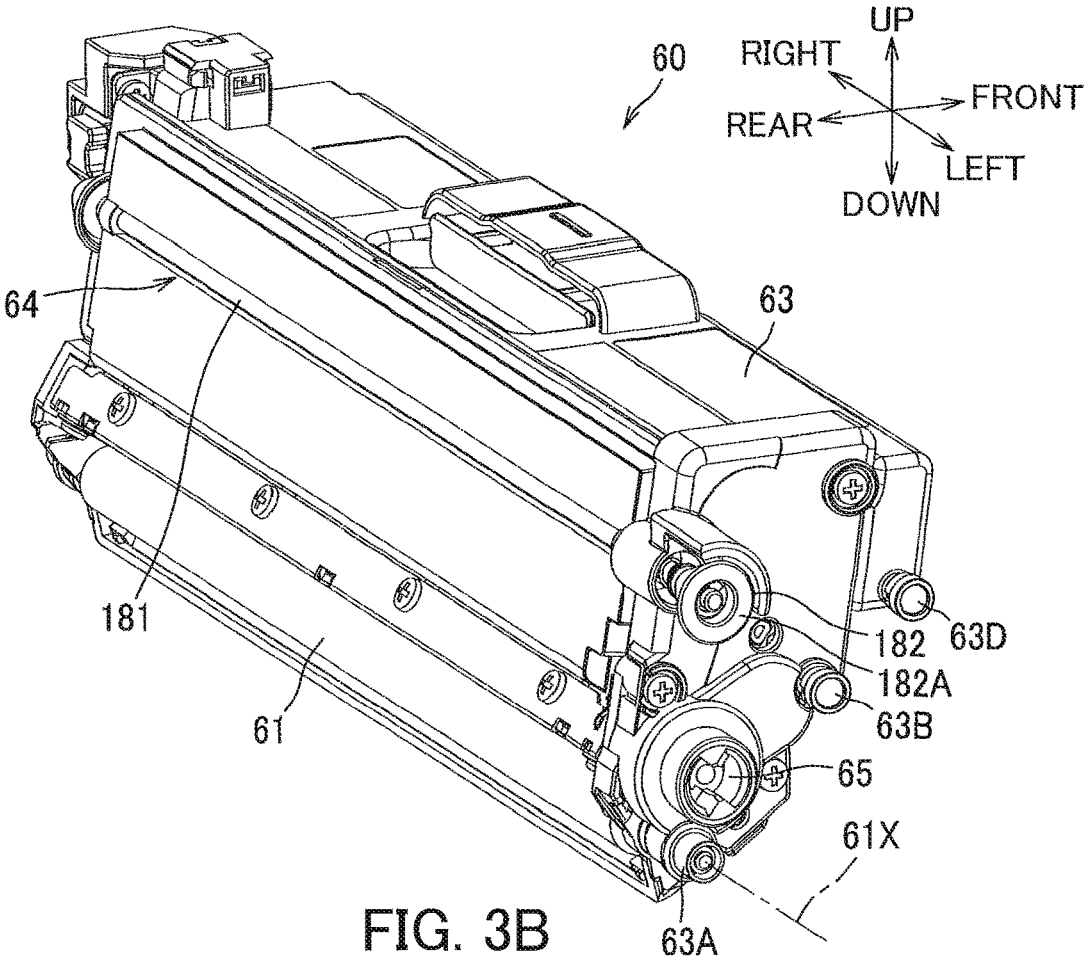
FIG. 3A is a perspective view of a developing cartridge in the image forming apparatus according to the embodiment.
Figure 3B:
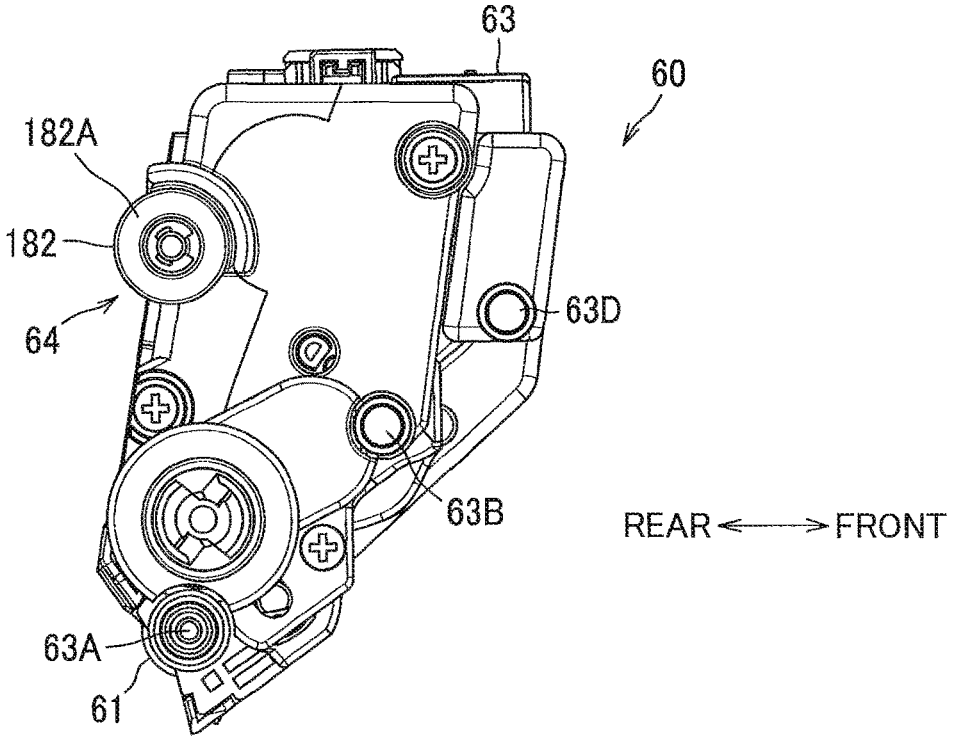
FIG. 3B is a side view of the developing cartridge in the image forming apparatus according to the embodiment.

As illustrated in FIGS. 3A and 3B, each developing cartridge 60 (60Y, 60M, 60C and 60K) includes a casing 63, the slide member 64, and a coupling 65.

The casing 63 has one side surface in the axial direction (left end surface) provided with a first protruding portion 63A and a second protruding portion 63B each protruding in the axial direction. The first protruding portion 63A is coaxial with the rotation axis 61X of the developing roller 61. The second protruding portion 63B is positioned away from the first protruding portion 63A by a predetermined distance. The second protruding portion 63B is positioned above the first protruding portion 63A in the present embodiment.

The first and second protruding portions 63A and 63B are rollers rotatable about their axes extending in parallel to the axial direction. Although not illustrated in the drawings, the first and second protruding portions 63A and 63B are also provided at another side surface (right end surface) of the casing 63 at positions symmetrical with the first and second protruding portions 63A and 63B provided at the one side surface (left end surface).

Further, the above-described protrusion 63D configured to be pressed by the pressure member 95 is positioned frontward of the first and second protruding portions 63A and 63B. The protrusion 63D protrudes outward in the axial direction from each side surface of the casing 63 in the axial direction.

The coupling 65 is configured to be engaged with a coupling shaft 119 (described later) of a power transmission mechanism 100. Rotational driving force is inputted to the coupling 65 through the coupling shaft 119.

Figure 4A:
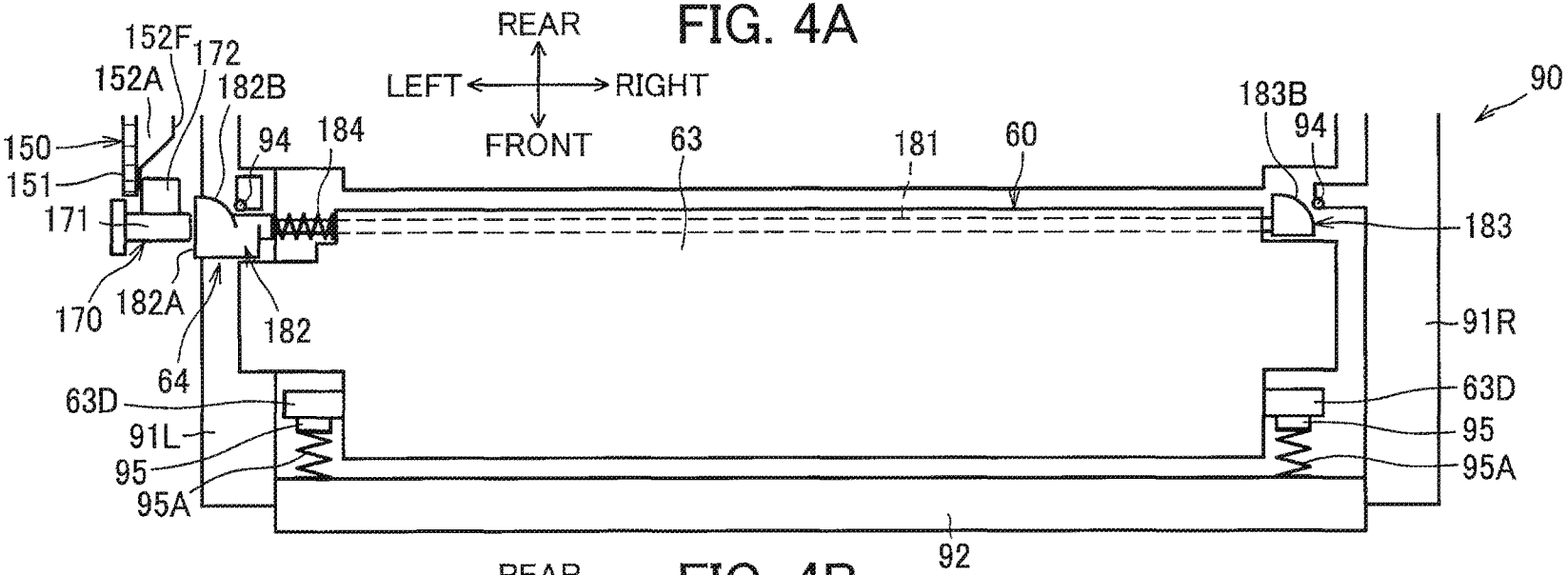
FIG. 4A is a schematic top view illustrating the developing cartridge and components in the vicinity thereof for description of a slide member of the developing cartridge, and particularly illustrating a state where the cam follower is at a standby position in the image forming apparatus according to the embodiment.
Figure 4B:
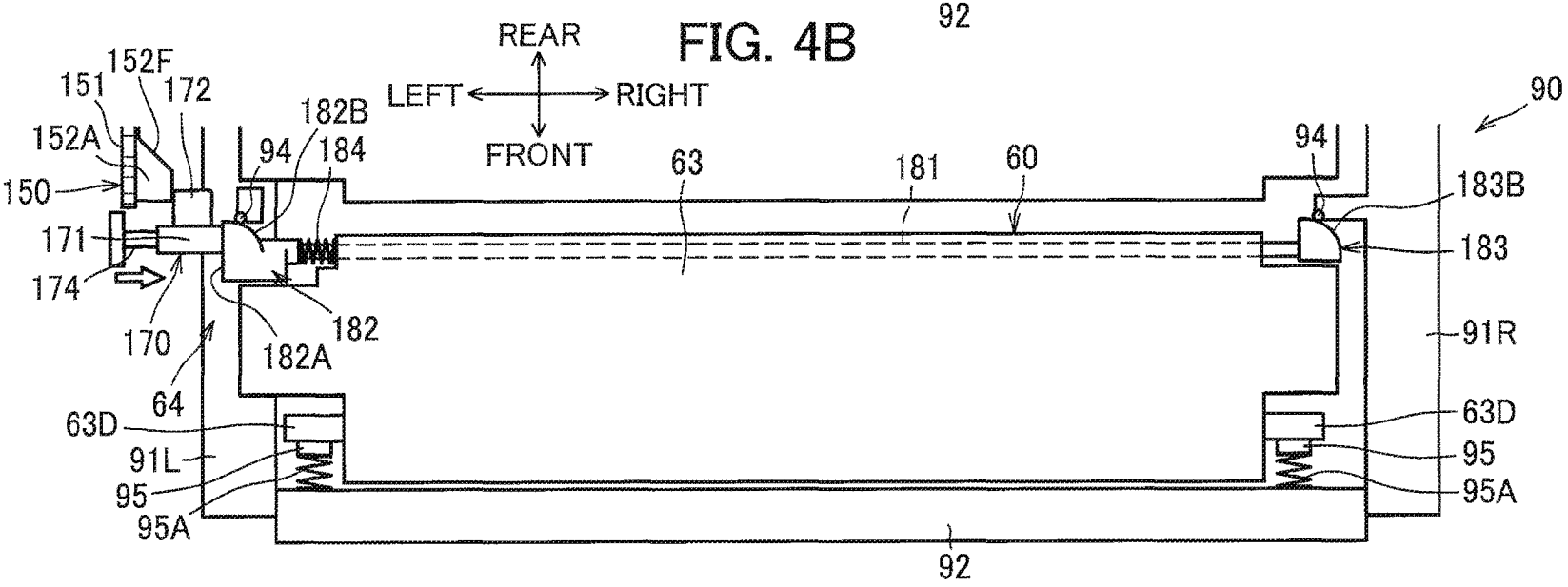
FIG. 4B is a schematic top view illustrating the developing cartridge and the components in the vicinity thereof for description of the slide member, and particularly illustrating a state where the cam follower is at an operating position in the image forming apparatus according to the embodiment.

The slide member 64 is slidably movable in the axial direction with respect to the casing 63 upon application of the pressing force from the corresponding cam follower 170. As illustrated in FIGS. 4A and 4B, the slide member 64 includes a shaft 181, a first abutment member 182 fixed to one end of the shaft 181, and a second abutment member 183 fixed to another end of the shaft 181. The casing 63 is formed with a hole extending in the axial direction. The shaft 181 extends through the hole and is slidably supported by the casing 63.

The first abutment member 182 has a pressure receiving surface 182A which is an end face in the axial direction, and a sloped surface 182B sloped relative to the axial direction. The pressure receiving surface 182A is configured to be pressed by the corresponding cam follower 170. When the pressure receiving surface 182A is pressed in the axial direction by the cam follower 170, the sloped surface 182B is configured to abut against the corresponding counterpart abutment portion 94 of the support member 90, to urge the developing cartridge 60 in a direction parallel to the sheet conveying direction, thereby moving the developing cartridge 60 to the position illustrated in FIG. 4B. The sloped surface 182B is sloped in a curved fashion to extend gradually frontward toward the right. That is, the sloped surface 182B is sloped in a direction from the photosensitive drum 50 toward the corresponding developing roller 61 (frontward) as extending in a direction from the one end (left end) to the other end (right end) of the shaft 181 in the axial direction.

The second abutment member 183 has a sloped surface 183B sloped relative to the axial direction similar to the sloped surface 182B of the first abutment member 182. When the pressure receiving surface 182A of the slide member 64 is pressed in the axial direction by the cam follower 170, the sloped surface 183B is configured to abut against the corresponding counterpart abutment portion 94 of the support member 90, to urge the developing cartridge 60 in the sheet conveying direction, thereby moving the developing cartridge 60 to the position as illustrated in FIG. 4B in cooperation with the first abutment member 182.

A spring 184 is interposed between the first abutment member 182 and the casing 63 to urge the slide member 64 leftward, i.e., in the direction from the other end (right end) to the one end (left end) of the shaft 181 in the axial direction. The spring 184 is a compression spring disposed over the shaft 181.

Figure 5:
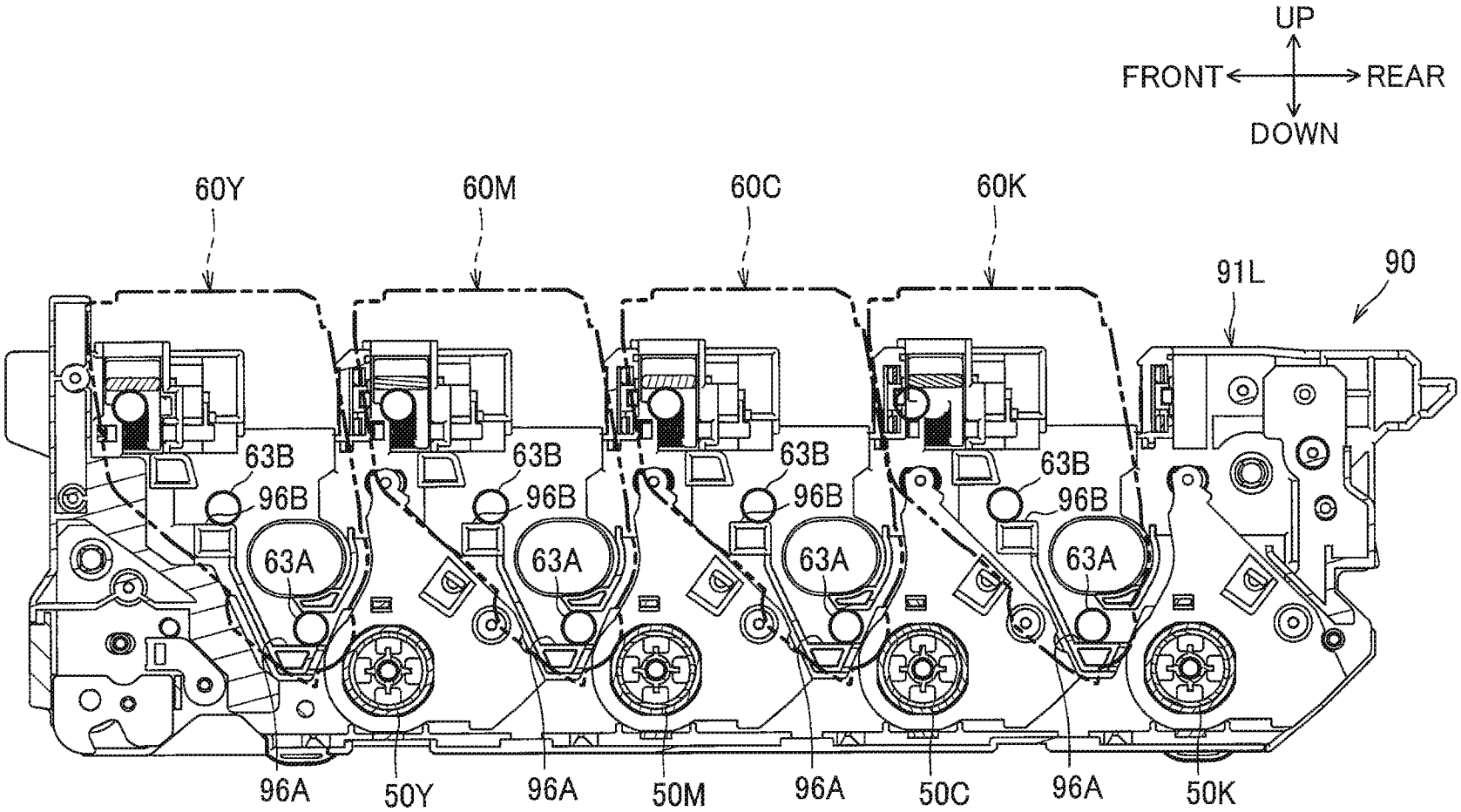
FIG. 5 is a side view of a side frame of the support member in the image forming apparatus according to the embodiment, and particularly illustrating an inner portion of the side frame to which the developing cartridge is attachable.

As illustrated in FIG. 5, the left side frame 91L of the support member 90 has an inner surface provided with first support surfaces 96A and second support surfaces 96B. The first support surface 96A and the second support surface 96B support the first protruding portion 63A and the second protruding portion 63B of the corresponding developing cartridge 60 from below when the developing roller 61 is moved from the contacting position to the separated position. Each first support surface 96A and each second support surface 96B extend in the sheet conveying direction.

The first support surface 96A is positioned to support the corresponding first protruding portion 63A. The first support surface 96A is configured to guide the developing roller 61 and to fix a position thereof in the upward/downward direction when the developing cartridge 60 is attached to the support member 90. The second support surface 96B is positioned upward of the first support surface 96A to support the second protruding portion 63B when the developing cartridge 60 is attached to the support member 90. Although not illustrated in the drawings, the first and second support surfaces 96A and 96B are provided at an inner surface of the right side frame 91R at positions symmetrical with the first and second support surfaces 96A and 96B of the left side frame 91L.

Referring to FIG. 5, when the developing roller 61 is positioned at the contacting position in contact with the corresponding photosensitive drum 50, the first protruding portion 63A is positioned at a rear region of the corresponding first support surfaces 96A (see the first protruding portions 63A of the first through third developing cartridges 60Y, 60M and 60C). When the developing roller 61 is at the separated position away from the corresponding photosensitive drum 50, the first protruding portion 63A is positioned at a front region of the corresponding first support surface 96A (see the first protruding portion 63A of the fourth developing cartridge 60K).

In this way, the first through fourth developing rollers 61Y, 61M, 61C and 61K are moved frontward, i.e., in a direction opposite to the sheet conveying direction (toward upstream in the sheet conveying direction) when the separation mechanisms 5 move the developing rollers 61Y, 61M, 61C and 61K from the contacting positions to the separated positions, respectively.

Figure 12A:
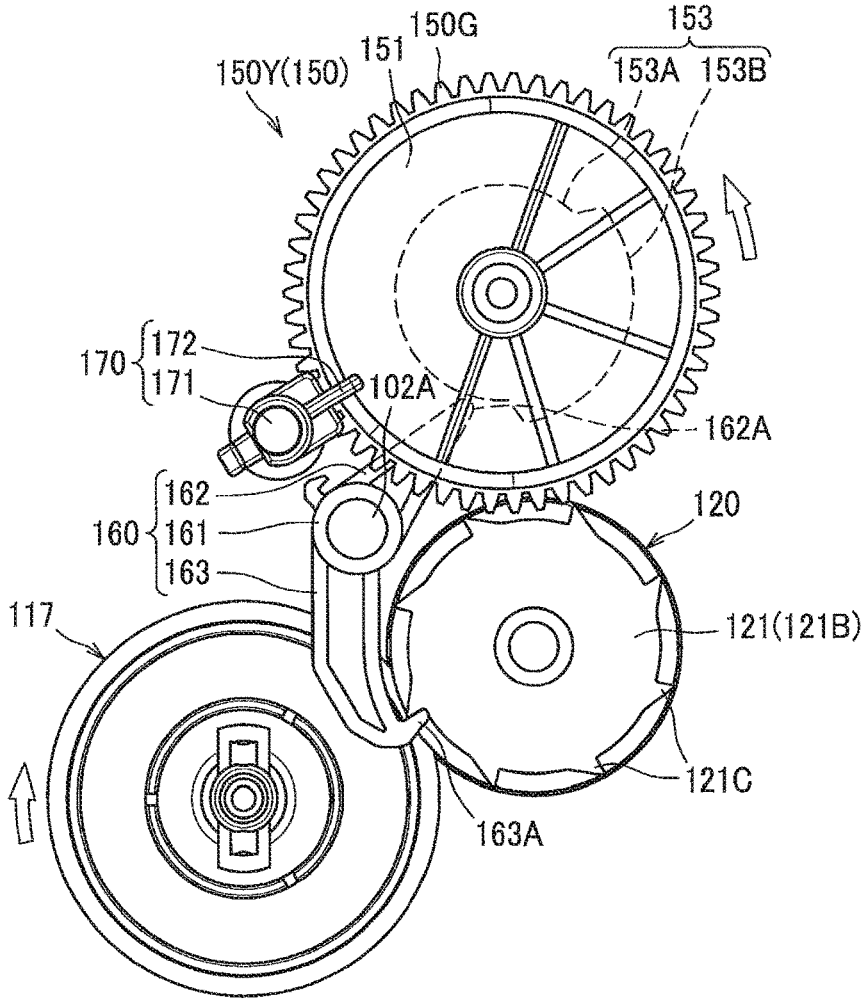
FIG. 12A is a view illustrating a separation mechanism, a lever, the clutch, and a coupling gear in the image forming apparatus according to the embodiment as viewed in the axial direction, and particularly illustrating a state where a developing roller is at a contacting position and the clutch is at a transmission state.
Figure 12B:
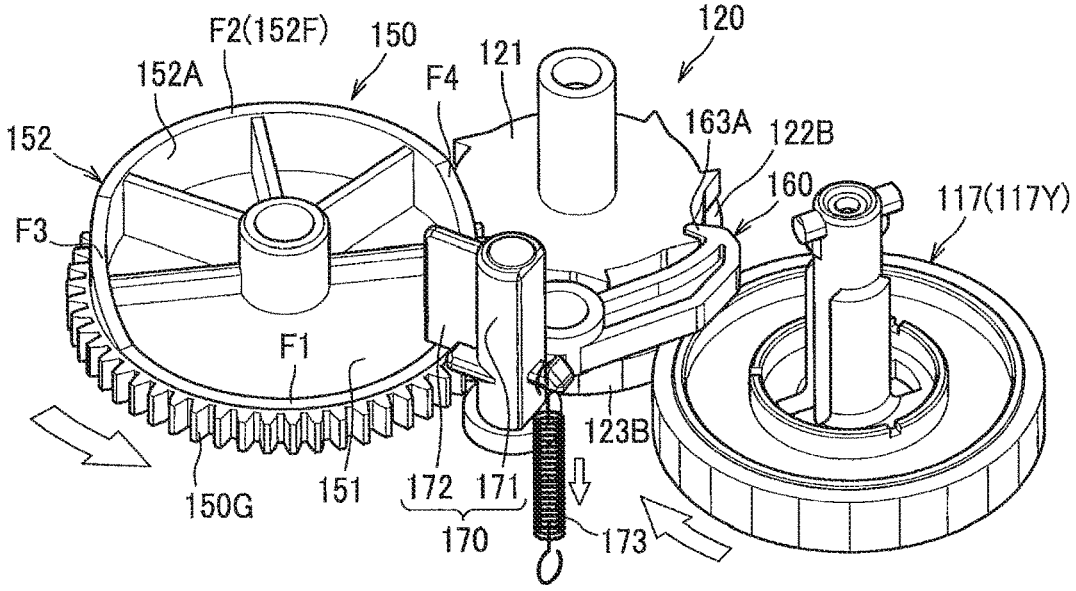
FIG. 12B is a perspective view illustrating the separation mechanism, the lever, the clutch, and the coupling gear in the image forming apparatus according to the embodiment, and particularly illustrating the state where the developing roller is at the contacting position and the clutch is at the transmission state.

As illustrated in FIGS. 12A and 12B, each cam 150 includes a disc portion 151, a gear portion 150G, an end face cam 152, and a clutch control cam 153. The cam 150 is rotatable to move the corresponding developing roller 61 between the contacting position and the separated position.

The disc portion 151 has a generally circular plate shape, and is rotatably supported by a support plate 102 (see FIG.

9). The gear portion 150G is provided at an outer peripheral surface of the disc portion 151. The end face cam 152 constitutes one of components of the corresponding separation mechanism 5, and constitutes the above-described first cam portion 152A protruding from the disc portion 151. The end face cam 152 has the cam surface 152F which is the protruding end face (right end face) of the first cam portion 152A in the axial direction.

The cam surface 152F has a first holding surface F1, a second holding surface F2, a first guide surface F3, and a second guide surface F4. In other words, the first holding surface F1, the second holding surface F2, the first guide surface F3 and the second guide surface F4 altogether constitute the cam surface 152F.

The first holding surface F1 is configured to hold the corresponding cam follower 170 at its standby position. The second holding surface F2 is configured to hold the corresponding cam follower 170 at its operating position. The first guide surface F3 connects the first holding surface F1 and the second holding surface F2 together and is inclined with respect to the first holding surface F1. The first guide surface F3 is configured to guide movement of the corresponding cam follower 170 from the first holding surface F1 to the second holding surface F2 in accordance with the rotation of the cam 150. The second guide surface F4 connects the second holding surface F2 and the first holding surface F1 together and is inclined with respect to the first holding surface F1. The second guide surface F4 is configured to guide movement of the corresponding cam follower 170 from the second holding surface F2 to the first holding surface F1 in accordance with the rotation of the cam 150.

The clutch control cam 153 is configured to provide control to a clutch 120 of the power transmission mechanism 100 to switch a power transmission status of the clutch 120 between a transmission state and a cut-off state, in cooperation with a lever 160 of the power transmission mechanism 100. The clutch control cam 153 includes a base portion 153A having a columnar shape, and a second cam portion 153B protruding radially outward from the base portion 153A. The clutch control cam 153 is integral with and coaxial with the disc portion 151, and hence, the second cam portion 153B rotates together with the cam 150.

The cam follower 170 includes a slide shaft portion 171, and a contact portion 172. The slide shaft portion 171 is slidable relative to a shaft 174 (see FIG. 4B) fixed to the housing 10 to be movable in the axial direction. The slide shaft portion 171 is urged by a spring 173 functioning as an urging member in such a direction that the contact portion 172 is in contact with the cam surface 152F of the cam 150. With this configuration, the cam follower 170 is urged toward the standby position.

Specifically, the spring 173 is a tension spring having one end portion engaged with the slide shaft portion 171 and another end portion engaged with a spring attaching portion (not illustrated) provided in the housing 10. The contact portion 172 protrudes radially outward from the slide shaft portion 171 and extends in the axial direction. The contact portion 172 has one axial end face (left end face) facing the cam surface 152F and contactable with the cam surface 152F.

Figure 9:
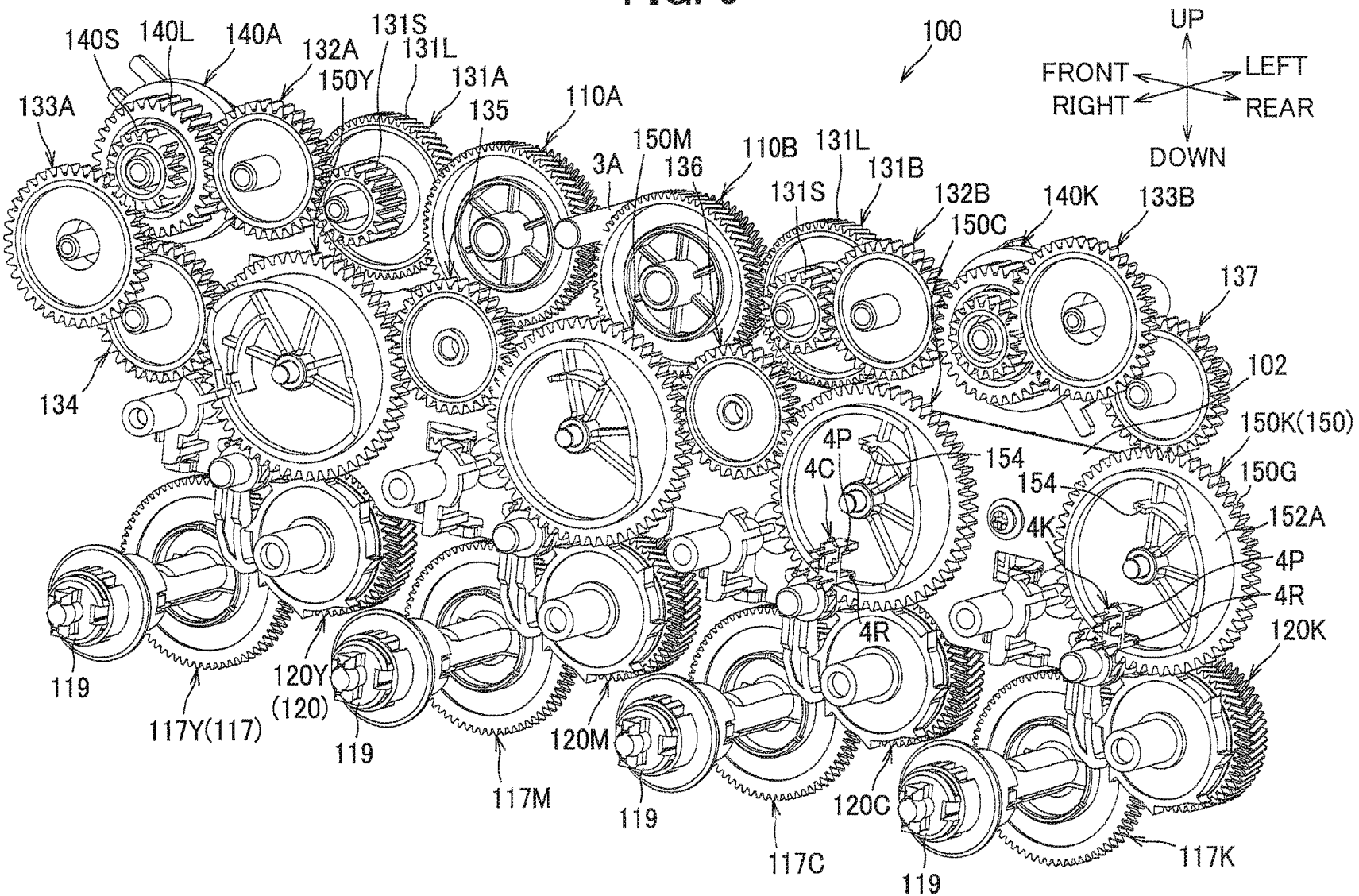
FIG. 9 is a perspective view of the power transmission mechanism in the image forming apparatus according to the embodiment as viewed from an upper right side thereof.

As illustrated in FIG. 9, the cams 150Y, 150M, 150C and 150K have configurations generally the same as one another except that a length of the first cam portion 152A of the cam 150Y in a rotational direction thereof is greater than a length of the first cam portions 152A of each of the remaining cams 150M, 150C and 150K in a rotational direction thereof.

Each of the cams 150C and 150K is provided with a counterpart detection portion 154 protruding from each disc portion 151 in the axial direction at a position radially inward of the corresponding first cam portion 152A. Further, the housing 10 is provided with separation sensors 4C and 4K corresponding to the colors of black and cyan.

The separation sensors 4C and 4K are phase sensors or displacement sensors for detecting phases or rotational positions of the respective cams 150C and 150K. The separation sensors 4C and 4K are configured to output separation signals in response to a timing where the cams 150C and 150K are positioned within a predetermined phase range indicative of the third developing roller 61C and the fourth developing roller 61K being at the separated positions, respectively. The separation sensors 4C and 4K are configured not to output the separation signals in response to a timing where the cams 150C and 150K are positioned outside of the predetermined phase range. In the present embodiment, output of the separation signal will be referred to as ON, and non-output of the separation signal will be referred to as OFF. A voltage level of an ON state may be higher or lower than that of an OFF state.

Each of the separation sensors 4K and 4C includes a light emitting portion 4P configured to emit detection light, and a light receiving portion 4R configured to receive the detection light. In a state where the counterpart detection portion 154 is positioned between the light emitting portion 4P and the light receiving portion 4R to block the detection light so that the light receiving portion 4R cannot receive the detection light, each separation sensor 4C and 4K outputs a signal indicative of being at the ON state (ON signal) to the controller 2. On the other hand, in a state where the counterpart detection portion 154 is displaced from a path of the detection light so that the light receiving portion 4R can receive the detection light, each separation sensor 4C and 4K outputs a signal indicative of being at the OFF state (OFF signal) to the controller 2.

Incidentally, each of the cams 150Y and 150M has a part having a shape the same as the counterpart detection portion 154 of the cams 150C and 150K. However, a separation sensor corresponding to each of these parts is not provided at the housing 10, and therefore, these parts do not function as the counterpart detection portion 154 does.

Referring back to FIG. 1, the conveying device 70 is positioned between the first tray 21 and the photosensitive drums 50. The conveying device 70 includes a drive roller 71, a driven roller 72, an endless belt as a conveyer belt 73, and four transfer rollers 74. The conveyer belt 73 is looped over the drive roller 71 and the driven roller 72 under tension, and has an outer peripheral surface facing each of the photosensitive drums 50. Each transfer roller 74 is positioned within a loop of the conveyer belt 73 to nip the conveyer belt 73 in cooperation with the corresponding photosensitive drum 50. The sheet S is conveyed as the conveyer belt 73 circulates while the sheet S is mounted on an upper portion of the outer peripheral surface of the conveyer belt 73, and at the same time, the toner image formed on each photosensitive drum 50 is transferred to the sheet S, sequentially.

The fixing device 80 is positioned rearward of the photosensitive drum 50K and the conveying device 70. The fixing device 80 includes a heat roller 81 and a pressure roller 82 positioned to face the heat roller 81. A sheet discharge sensor 28D is positioned downstream of the fixing device 80 in the sheet conveying direction to detect that the sheet moves past the sheet discharge sensor 28D. A pair of conveyer rollers 15 is positioned above the fixing device 80, and a pair of discharge rollers 16 is positioned above the conveyer rollers 15.

In the image forming unit 30, the surface of each photosensitive drum 50 is uniformly charged by the corresponding charger 52, and is then exposed to light by the laser beam irradiated from the exposure device 40. Thus, an electrostatic latent image on a basis of image data is formed on the surface of each photosensitive drum 50.

Further, toner accommodated in the casing 63 of each developing cartridge 60 is carried onto the surface of each developing roller 61, and the toner is supplied from each developing roller 61 to the surface of the corresponding photosensitive drum 50 when the developing roller 61 comes into contact with the photosensitive drum 50. Hence, a toner image is formed on the surface of each photosensitive drum 50.

Then, the toner image formed on each photosensitive drum 50 is transferred onto the sheet S while the sheet S fed onto the conveyer belt 73 moves past portions between each photosensitive drum 50 and the corresponding transfer roller 74. Then, the toner image transferred onto the sheet S is thermally fixed to the sheet S when the sheet S moves past the portion between the heat roller 81 and the pressure roller 82.

The sheet S discharged from the fixing device 80 is discharged onto the discharge tray 13 by the conveyer rollers 15 and the discharge rollers 16.

Figure 6:
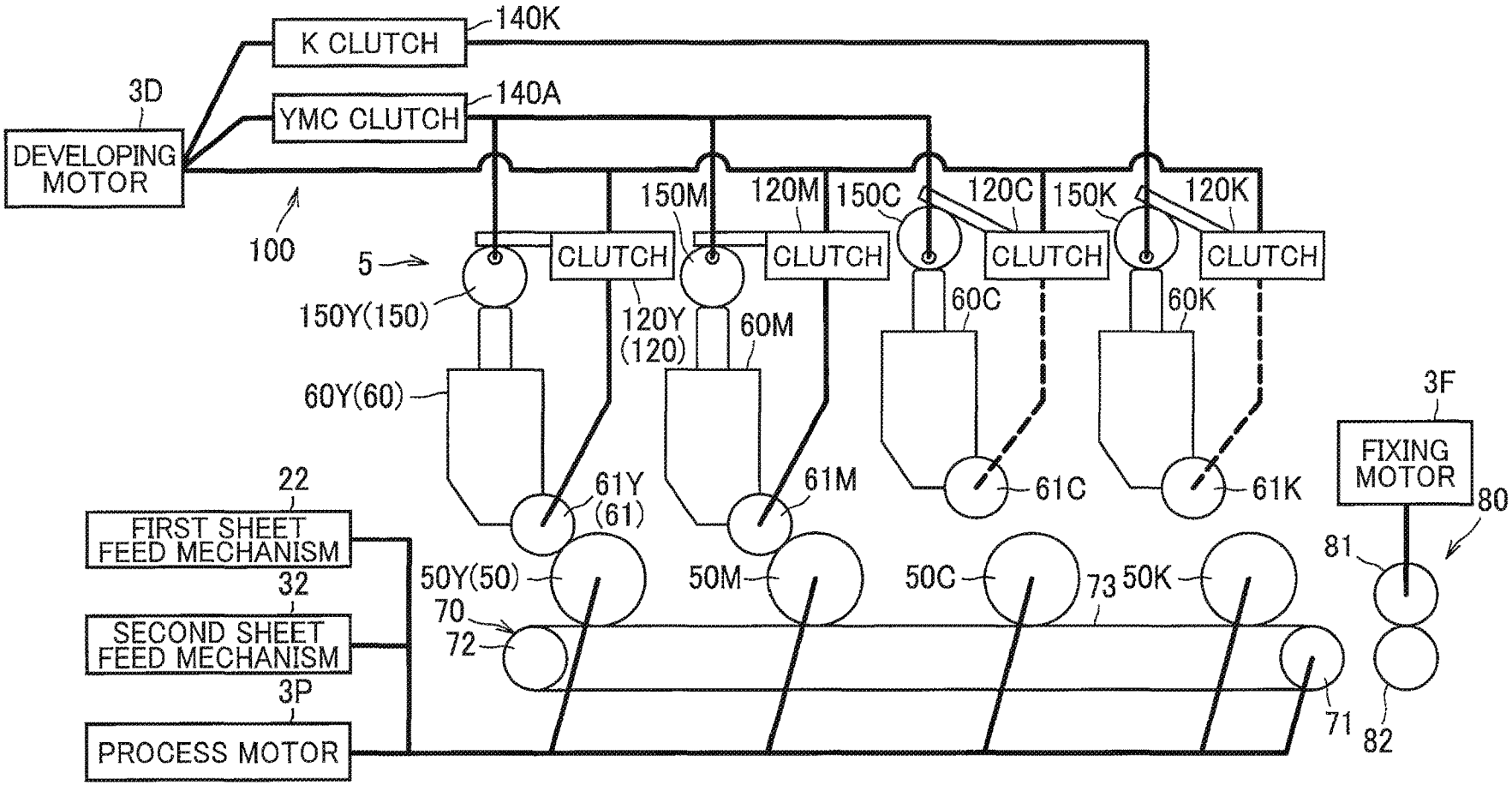
FIG. 6 is a block diagram illustrating transmission of a driving force from motors in the image forming apparatus according to the embodiment.

As illustrated in FIG. 6, the image forming apparatus 1 further includes a developing motor 3D, a process motor 3P, a fixing motor 3F, and the power transmission mechanism 100 configured to transmit a driving force of the developing motor 3D to the developing rollers 61.

The developing motor 3D is configured to supply the driving force to the developing rollers 61 and the separation mechanisms 5. The process motor 3P is provided separately from the developing motor 3D and is configured to supply a driving force to the photosensitive drums 50, the drive roller 71 of the conveying device 70, the first sheet feed mechanism 22, and the second sheet feed mechanism 32. The fixing motor 3F is provided separately from the developing motor 3D and the process motor 3P and is configured to supply a driving force to the heat roller 81 of the fixing device 80. Incidentally, the developing motor 3D is an example of a "motor" and a "first motor", and the process motor 3P is an example of a "second motor".

<Mechanisms for Performing Driving/Stop and Contact/Separation of Developing Rollers 61>

Next, a structure for driving and stopping the developing rollers 61, and a structure for moving the developing rollers 61 to come into contact with and to be separated from the photosensitive drums 50 will be described in detail.

Figure 7:
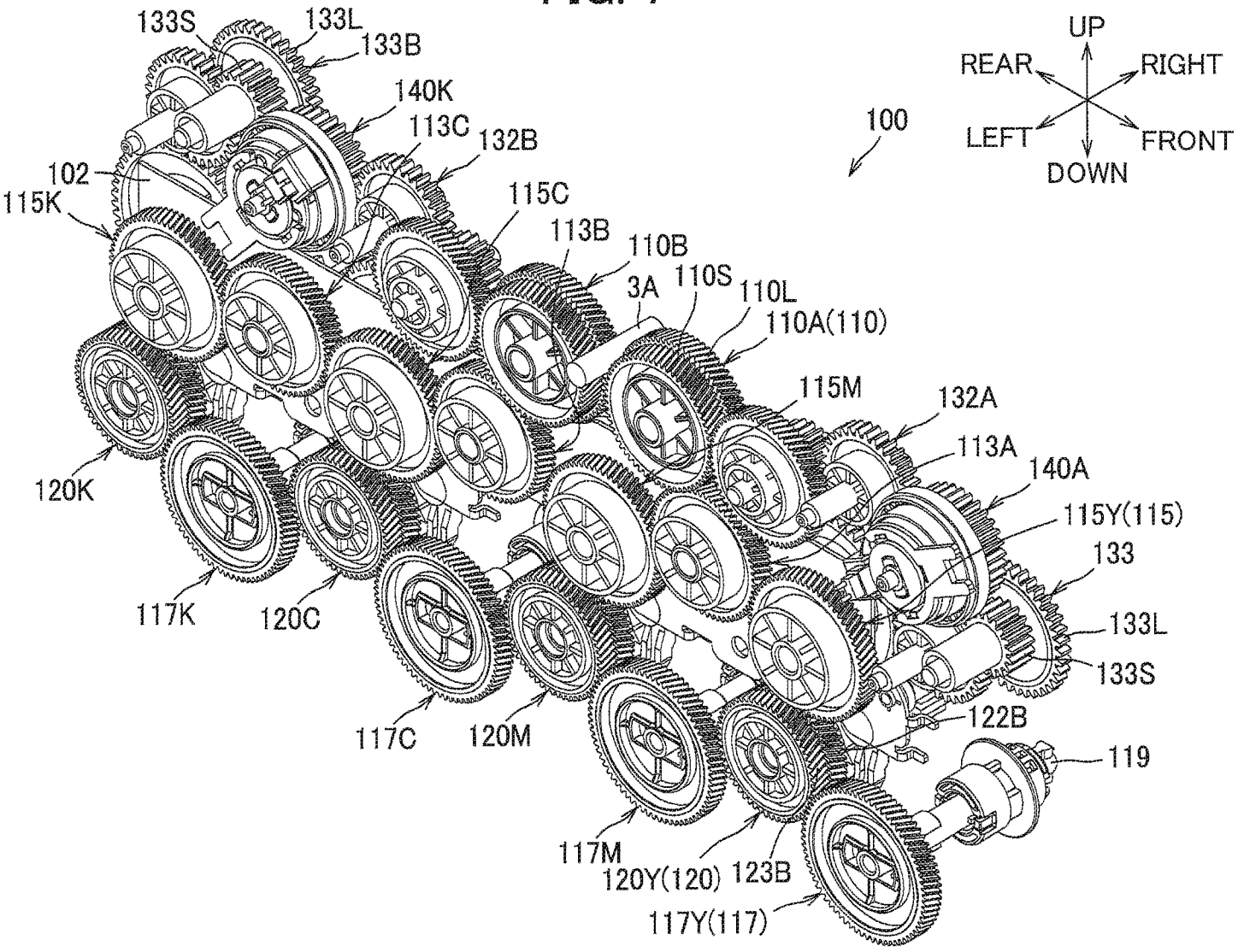
FIG. 7 is a perspective view of a power transmission mechanism in the image forming apparatus according to the embodiment as viewed from an upper left side thereof.
Figure 8:
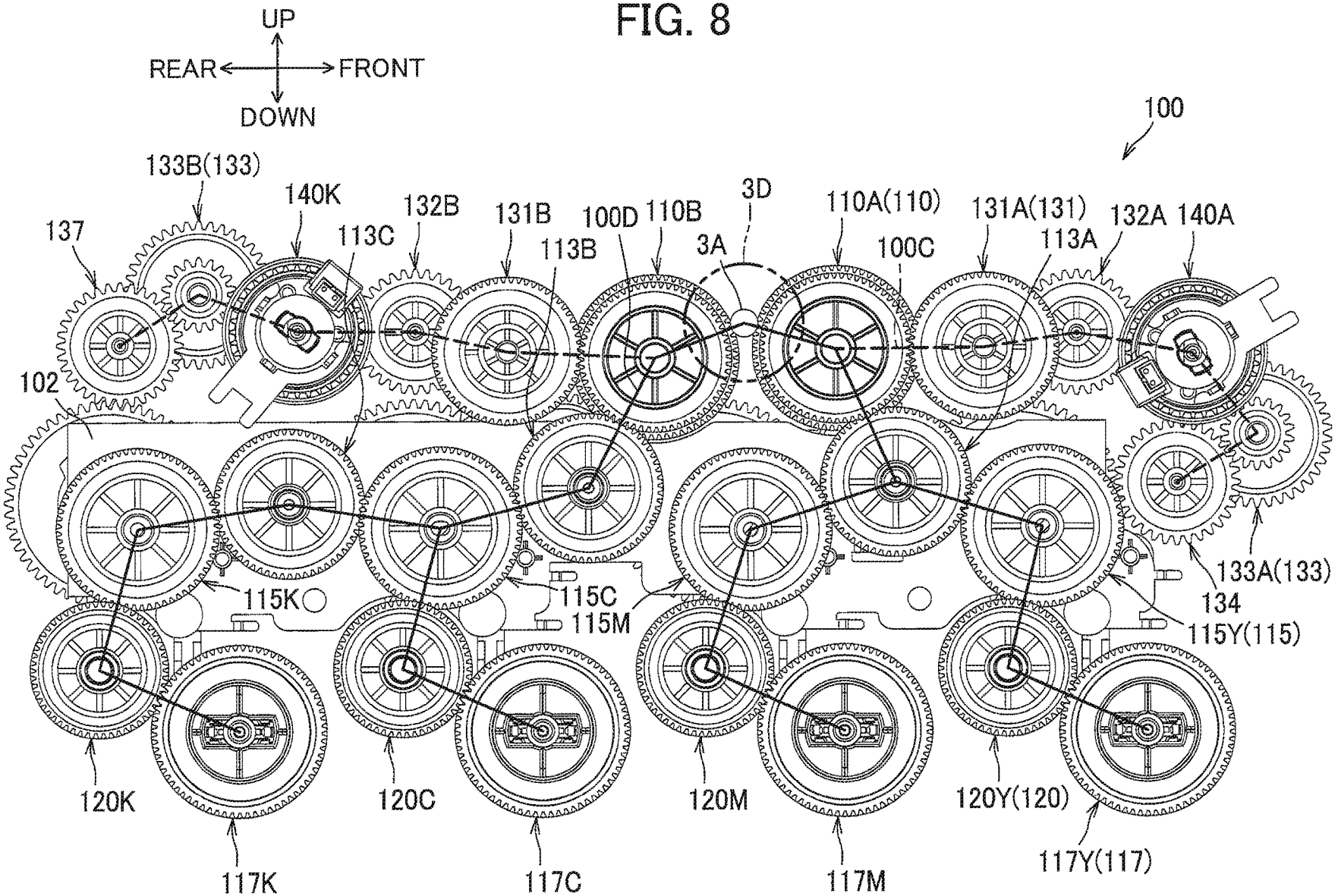
FIG. 8 is a view illustrating the power transmission mechanism in the image forming apparatus according to the embodiment as viewed from a left side thereof in an axial direction.

As illustrated in FIGS. 7 to 9, the power transmission mechanism 100 is mechanically connected to the cams 150 of the separation mechanisms 5. The power transmission mechanism 100 is configured to transmit the driving force of the developing motor 3D to the developing rollers 61 when these developing rollers 61 are at their respective contacting positions, and is configured not to transmit the driving force of the developing motor 3D to the developing rollers 61 when these developing rollers 61 are at their respective separated positions.

Figure 10:
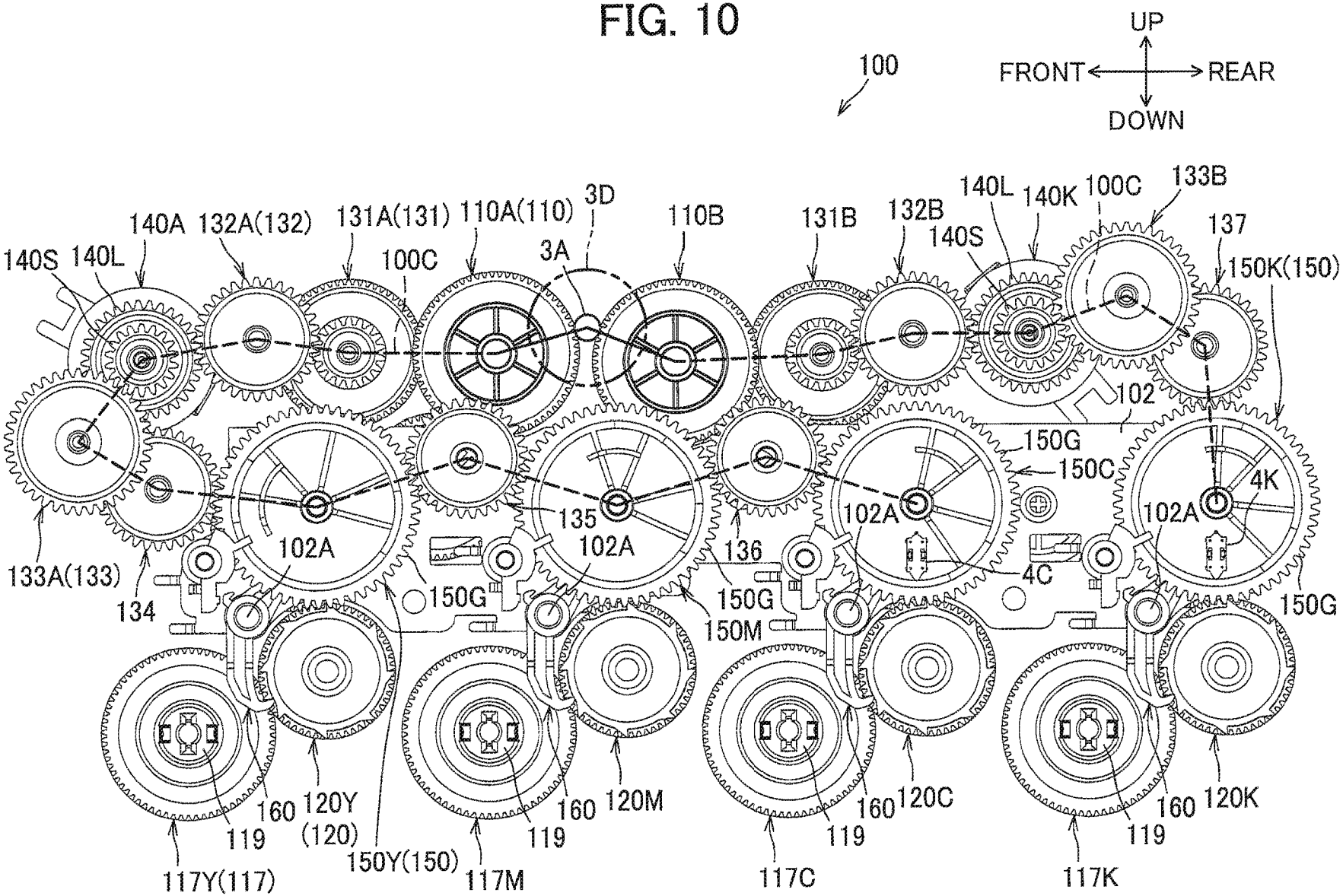
FIG. 10 is a view illustrating the power transmission mechanism in the image forming apparatus according to the embodiment as viewed from a right side thereof in the axial direction.

As best illustrated in FIG. 8, the power transmission mechanism 100 includes: a power transmission gear train 100D configured to transmit the driving force of the developing motor 3D to the developing rollers 61; and a transmission control gear train 100C configured to control transmission of the driving force of the power transmission gear train 100D. The power transmission gear train 100D is mechanically connected to the transmission control gear train 100C. In FIGS. 8 and 10, meshing engagement of the gears in the power transmission gear train 100D is indicated by a bold solid line, and meshing engagement of the gears in the transmission control gear train 100C is indicated by a bold broken line.

The power transmission gear train 1001) includes two first idle gears 110 (110A and 110B), three second idle gears 113A, 113B and 113C, four third idle gears 115 (115Y, 115M, 115C and 115K), and four clutches 120 (120Y, 120M, 120C and 120K), and four coupling gears 117 (117Y, 117M, 117C and 117K). Each of these gears constituting the power transmission gear train 100D is supported by the support plate 102 or a frame (not illustrated), and is rotatable about an axis extending in the axial direction.

The developing motor 3D includes an output shaft 3A. A gear (not illustrated) is concentrically fixed to the output shaft 3A.

As illustrated in FIG. 7, each of the first idle gears 110 is a two-stage gear including a large diameter gear 110L and a small diameter gear 110S. The small diameter gear 110S has a certain number of gear teeth which is smaller than a number of gear teeth of the large diameter gear 110L. The large diameter gear 110L is rotatable integrally with the small diameter gear 110S. The first idle gear 110A is positioned frontward of the output shaft 3A, and the other first idle gear 110B is positioned rearward of the output shaft 3A. The large diameter gear 110L of each first idle gear 110 is in meshing engagement with the gear of the output shaft 3A.

As illustrated in FIG. 8, the second idle gear 113A is in meshing engagement with the small diameter gear 110S of the front first idle gear 110A. The second idle gear 113B is in meshing engagement with the small diameter gear 110S of the rear first idle gear 110B.

The third idle gears 115Y, 115M, 115C and 115K are provided in one-to-one correspondence with the four colors, and are arrayed in this order in a front-to-rear direction. The third idle gears 115Y and 115M are in meshing engagement with the second idle gear 113A. The third idle gear 115C is in meshing engagement with the second idle gear 113B and the second idle gear 113C. The third idle gear 115K is in meshing engagement with the second idle gear 113C. Hence, the third idle gear 115K is driven by the third idle gear 115C through the second idle gear 113C.

The four clutches 120 have structures the same as one another. Each clutch 120 is in meshing engagement with one of the four third idle gears 115 (115Y, 115M, 115C and 115K) to receive the driving force from the third idle gear 115. Structure of the clutches 120 will be described later in detail.

Each coupling gear 117 is in meshing engagement with one of the clutches 120. Each coupling gear 117 is provided with the coupling shaft 119 rotatable integrally therewith (see FIG. 7). The coupling shaft 119 is movable in the axial direction in interlocking relation to the opening/closing movement of the front cover 11. The coupling shaft 119 is engaged with the coupling 65 (see FIG. 3A) of the corresponding developing cartridge 60 in accordance with the closing motion of the front cover 11.

In the power transmission gear train 100D, the coupling gear 117Y for the color of yellow is configured to receive the driving force from the developing motor 3D through the first idle gear 110A, the second idle gear 113A, the third idle gear 115Y, and the clutch 120Y.

The coupling gear 117M for the color of magenta is configured to receive the driving force from the developing motor 3D through the first idle gear 110A, the second idle gear 113A, the third idle gear 115M, and the clutch 120M.

The coupling gear 117C for the color of cyan is configured to receive the driving force from the developing motor 3D through the first idle gear 110B, the second idle gear 113B, the third idle gear 115C, and the clutch 120C.

The coupling gear 117K for the color of black is configured to receive the driving force from the developing motor 3D through the first idle gear 110B, the second idle gear 113B, the third idle gear 115C, the second idle gear 113C, the third idle gear 115K, and the clutch 120K.

As illustrated in FIGS. 9 and 10, the transmission control gear train 100C includes two fourth idle gears 131 (131A and 131B), two fifth idle gears 132 (132A and 132B), a YMC clutch 140A, a K clutch 140K, two sixth idle gears 133 (133A and 133B), a seventh idle gear 134, an eighth idle gear 135, a ninth idle gear 136, a tenth idle gear 137, and the cams 150 (150Y, 150M, 150C and 150K). Each of these gears constituting the transmission control gear train 100C is supported by the support plate 102 or the frame (not illustrated), and is rotatable about an axis extending in the axial direction.

Each of the fourth idle gears 131 is a two-stage gear including a large dimeter gear 131L and a small diameter gear 131S (see FIG. 9). The small diameter gear 131S has a certain number of gear teeth is smaller than a number of gear teeth of the large diameter gear 131L. The large diameter gear 131L is rotatable integrally with the small diameter gear 131S. The fourth idle gear 131A is positioned frontward of the first idle gear 110A, and the other fourth idle gear 131B is positioned rearward of the first idle gear 110B. The large diameter gear 131L of each fourth idle gear 131 is in meshing engagement with the small diameter gear 110S of the corresponding first idle gear 110 (first idle gear 110A or 110B).

The fifth idle gears 132A is positioned frontward of the fourth idle gear 131A, and the other fifth idle gear 132B is positioned rearward of the fourth idle gear 131B. The fifth idle gear 132A is in meshing engagement with the small diameter gear 131S of the fourth idle gear 131A, and the fifth idle gear 132B is in meshing engagement with the small diameter gear 131S of the fourth idle gear 131B.

The YMC clutch 140A is configured to change-over transmission and cut-off of the driving force to the cams 150 with respect to the color of yellow, magenta, and cyan in the transmission control gear train 100C. That is, the YMC clutch 140A is configured to perform switching of the cams 150Y, 150M and 150C between their rotating state and non-rotating state.

The YMC clutch 140A includes a large diameter gear 140L and a small diameter gear 140S whose numbers of gear teeth is smaller than a number of gear teeth of the large diameter gear 140L. The YMC clutch 140A is positioned frontward of the fifth idle gear 132A, and the large diameter gear 140L of the YMC clutch 140A is in meshing engagement with the fifth idle gear 132A.

An electromagnetic clutch is available as the YMC clutch 140A. Upon receipt of power supply (turning ON), the large diameter gear 140L and the small diameter gear 140S integrally rotate together, and upon halting of the power supply (turning OFF), the large diameter gear 140L idly rotates to prevent rotation of the small diameter gear 140S.

The K clutch 140K has a structure the same as that of the YMC clutch 140A. The K clutch 140K is configured to change-over transmission and cut-off of the driving force to the cam 150 with respect to the color of black (i.e., the cam 150K) in the transmission control gear train 100C. The K clutch 140K includes a large diameter gear 140L and a small diameter gear 140S whose numbers of gear teeth is smaller than number of gear teeth of the large diameter gear 140L. The K clutch 140K is positioned rearward of the fifth idle gear 132B, and the large diameter gear 140L of the K clutch 140K is in meshing engagement with the fifth idle gear 132B.

Each of the two sixth idle gears 133 is a two-stage gear including a large diameter gear 133L and a small diameter gear 133S whose numbers of gear teeth is smaller than number of gear teeth of the large diameter gear 133L (see FIG. 7). The large diameter gear 133L and the small diameter gear 133S rotate integrally. One of the two sixth idle gears 133A is positioned frontward of the YMC clutch 140A, and the other sixth idle gear 133B is positioned rearward of the K clutch 140K. The large diameter gear 133L of the sixth idle gear 133A is in meshing engagement with the small diameter gear 140S of the YMC clutch 140A, and the large diameter gear 133L of the sixth idle gear 133B is in meshing engagement with the small diameter gear 140S of the K clutch 140K.

The seventh idle gear 134 is positioned between the sixth idle gear 133A and the cam 150Y. The seventh idle gear 134 is in meshing engagement with the small diameter gear 133S (see FIG. 7) of the sixth idle gear 133A and the gear portion 150G of the cam 150Y.

The eighth idle gear 135 is positioned between the cam 150Y and the cam 150M. The eighth idle gear 135 is in meshing engagement with the gear portion 150G of the cam 150Y and the gear portion 150G of the cam 150M.

The ninth idle gear 136 is positioned between the cam 150M and the cam 150C. The ninth idle gear 136 is in meshing engagement with the gear portion 150G of the cam 150M and the gear portion 150G of the cam 150C.

The tenth idle gear 137 is positioned between the sixth idle gear 133B and the cam 150K. The tenth idle gear 137 is in meshing engagement with the small diameter gear 133 of the sixth idle gear 133B (see FIG. 7) and the gear portion 150G of the cam 150K.

In the transmission control gear train 100C, the yellow cam 150Y is configured to receive the driving force of the developing motor 3D through the first idle gear 110A, the fourth idle gear 131A, the fifth idle gear 132A, the YMC clutch 140A, the sixth idle gear 133A, and the seventh idle gear 134. Further, the magenta cam 150M is configured to receive the driving force from the yellow cam 150Y through the eighth idle gear 135. Further, the cyan cam 150C is configured to receive the driving force from the magenta cam 150M through the ninth idle gear 136. Upon power supply to the YMC clutch 140A, the cams 150Y, 150M and 150C rotate concurrently, and upon halting the power supply to the YMC clutch 140A, the cams 150Y, 150M and 150C stop rotating.

On the other hand, the black cam 150K is configured to receive the driving force of the developing motor 3D through the first idle gear 110B, the fourth idle gear 131B, the fifth idle gear 132B, the K clutch 140K, the sixth idle gear 133B, and the tenth idle gear 137. Upon power supply to the K clutch 140K, the cam 150K rotates, and upon halting the power supply, the cam 150K stops rotating.

Figure 11A:
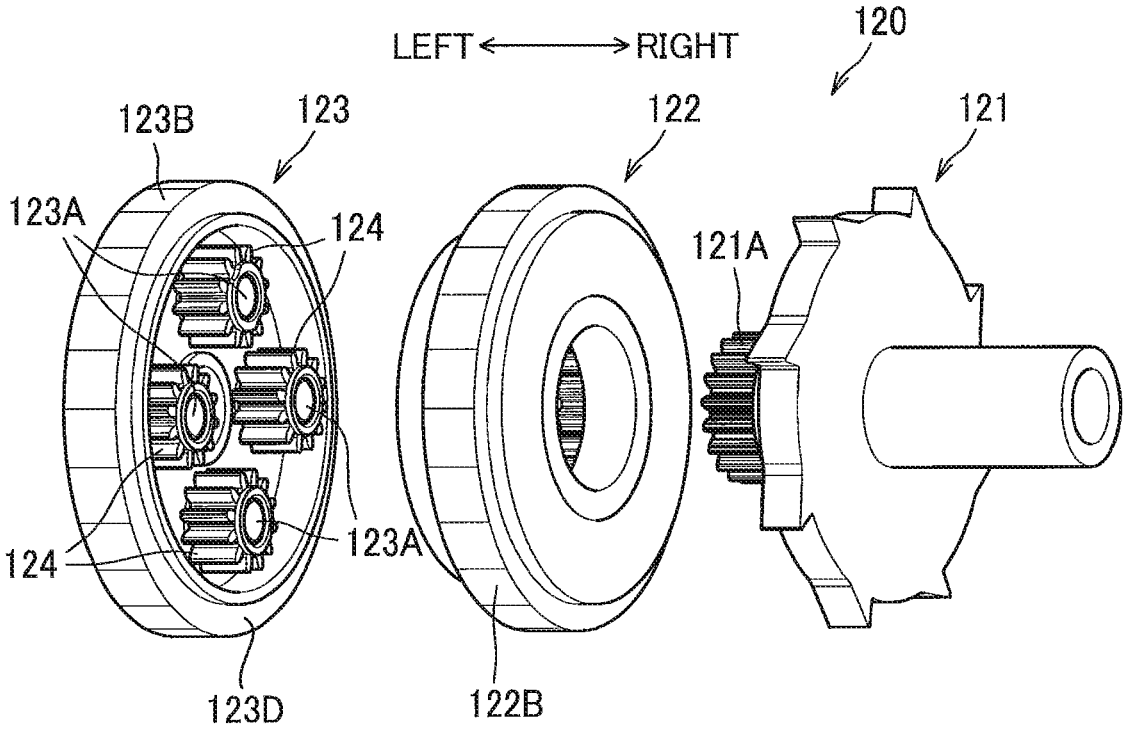
FIG. 11A is an exploded perspective view illustrating a clutch in the image forming apparatus according to the embodiment as viewed from a sun gear side thereof.
Figure 11B:
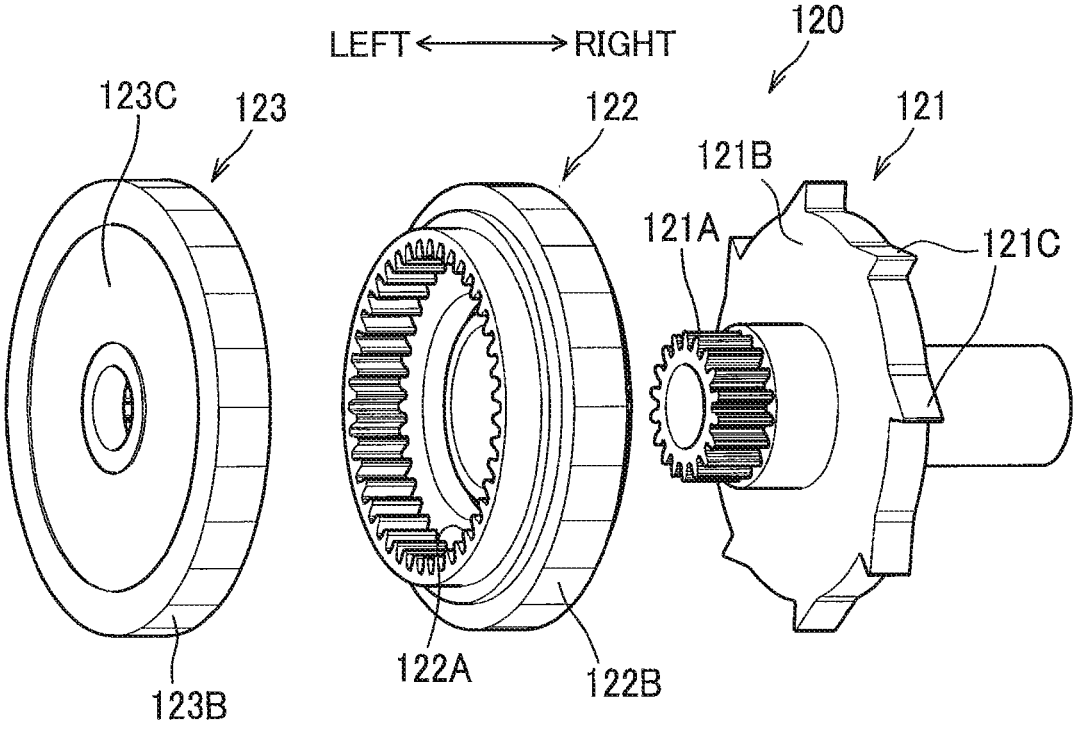
FIG. 11B is an exploded perspective view illustrating the clutch in the image forming apparatus according to the embodiment as viewed from a carrier side thereof.

The Structure and functions of the clutches 120 will be described. As illustrated in FIGS. 11A and 11B, the clutch 120 includes a planetary gear mechanism. Each of the clutches 120 is configured to perform change-over between the transmission state where the driving force of the developing motor 3D is transmitted to the developing roller 61 of the corresponding developing cartridge 60 and a cut-off state where the driving force is not transmitted to the developing roller 61 of the corresponding developing cartridge 60. Specifically, the clutch 120 includes a sun gear 121 rotatable about an axis thereof, a ring gear 122, a carrier 123, and a plurality of (four) planetary gears 124 supported by the carrier 123. The ring gear 122 and the carrier 123 are rotatable coaxially about the axis of the sun gear 121.

The sun gear 121 includes a gear portion 121A, a disc portion 121B rotatable integrally with the gear portion 121A, and a plurality of pawls 121C provided at an outer peripheral surface of the disc portion 121B. The pawls 121C have acute tip end portions each of which is inclined toward upstream in a rotational direction of the sun gear 121 along the outer peripheral surface. The ring gear 122 has an annular shape having an inner peripheral surface provided with an inner gear 122A and an outer peripheral surface provided with an input gear 122B.

The carrier 123 includes a circular portion 123C, an annular portion 123D extending from an outer surface of the circular portion 123C, a four shaft portions 123A extending from the circular portion 123C, and an output gear 123B provided at the outer peripheral surface of the annular portion 123D.

Each of the four planetary gears 124 is rotatably supported by the corresponding one of the shaft portions 123A. Each planetary gear 124 is in meshing engagement with the gear portion 121A of the sun gear 121, and with the inner gear 122A of the ring gear 122.

As illustrated in FIGS. 7 and 8, the input gear 122B of the clutch 120 is in meshing engagement with the corresponding third idle gear 115, and the output gear 123B is in meshing engagement with the coupling gear 117.

In a state where the rotation of the sun gear 121 is stopped, the driving force inputted into the input gear 122B can be transmitted to the output gear 123B (the transmission state). On the other hand, in a state where the sun gear 121 is allowed to be rotated, the driving force inputted into the input gear 122B cannot be transmitted to the output gear 123B (the cut-off state). In a state where the clutch 120 is at the cut-off state and the driving force is inputted into the input gear 122B while load is imparted on the output gear 123B, the output gear 123B does not rotate, and the sun gear 121 idly rotates.

As illustrated in FIG. 10, the power transmission mechanism 100 further includes a plurality of (four) the levers 160 corresponding to the respective four colors. Four support shafts 102A are fixed to and extend from the support plate 102. Each lever 160 is pivotally movably supported by one of the four support shafts 102A. Each lever 160 is configured, in cooperation with the corresponding cam 150, to be engage with the sun gear 121 of the planetary gear mechanism in the corresponding clutch 120 to prevent the rotation of the sun gear 121 to provide the transmission state, and to disengage from the sun gear 121 to provide the cut-off state.

Specifically, as illustrated in FIG. 12A, each lever 160 includes a rotation support portion 161, a first arm 162 extending from the rotation support portion 161, and a second arm 163 extending from the rotation support portion 161 in a direction different from a direction in which the first arm 162 extends.

The rotation support portion 161 has a hollow cylindrical shape. The corresponding support shaft 102A of the support plate 102 is inserted into a hollow space of the rotation support portion 161. Hence, the rotation support portion 161 is supported by the support shaft 102A.

The second arm 163 has a tip end portion extending toward the outer peripheral surface of the disc portion 121B of the sun gear 121 of the corresponding clutch 120. The lever 160 is urged by a torsion spring (not illustrated) so that the tip end portion is urged toward the outer peripheral surface of the disc portion 121B. A hook 163A is provided at the tip end of the second arm 163. The hook 163A is configured to engage with any one of the pawls 121C of the sun gear 121 to prevent the sun gear 121 from rotating.

The first arm 162 has a tip end portion 162A contactable with the second cam portion 153B of the corresponding cam 150. Specifically, the lever 160 is pivotally movable between an engagement position and a disengagement position. In the engagement position, the tip end portion 162A is positioned in confrontation with the circular base portion 153A, so that the hook 163A is engaged with one of the pawls 121C of the corresponding clutch 120 (see FIGS. 12A to 14B). In the disengagement position, the tip end portion 162A of the first arm 162 comes into contact with the second cam portion 153B to be urgingly moved by the same, so that the hook 163A is disengaged from the pawl 121C (see FIGS. 15A to 16B). The engagement position of the lever 160 separated from the second cam portion 153B brings the clutch 120 into the transmission state, and the disengagement position of the lever 160 in contact with the second cam portion 153B brings the clutch 120 into the cut-off state.

<Operation of Lever 160, Clutch 120, Cam 150 and Cam Follower 170>

Operation of the lever 160, the clutch 120, the cam 150, and the cam follower 170 will be described with reference to FIGS. 12A through 16B. The components illustrated in these drawings are for the color of yellow. Components corresponding to the other colors have the structure the same as the components illustrated in FIGS. 12A through 16B except for the difference in the phase of each cam 150.

As illustrated in FIGS. 12A and 12B, the tip end portion 162A of the first arm 162 is brought into confrontation with the circular base portion 153A after the tip end portion 162A is separated from the second cam portion 153B. Hence, the hook 163A of the second arm 163 is brought into engagement with one of the pawls 121C of the sun gear 121 of the corresponding clutch 120 to position the lever 160 at its engagement position. Since rotation of the sun gear 121 is stopped by the lever 160, the clutch 120 is brought to the transmission state where the output gear 123B rotates in accordance with the rotation of the input gear 122B. Hence, the driving force of the developing motor 3D can be transmitted to the developing roller 61, and accordingly, the developing roller 61 is rotatable by the rotation of the developing motor 3D through the power transmission gear train 100D.

Further, the end face of the contact portion 172 of the cam follower 170 is positioned on the first holding surface F1 of the cam surface 152F of the cam 150. Therefore, the slide shaft portion 171 is positioned away from the slide member 64 of the developing cartridge 60 in the axial direction (see FIG. 4A). Accordingly, the developing roller 61 is positioned at its contacting position.

Figure 13A:
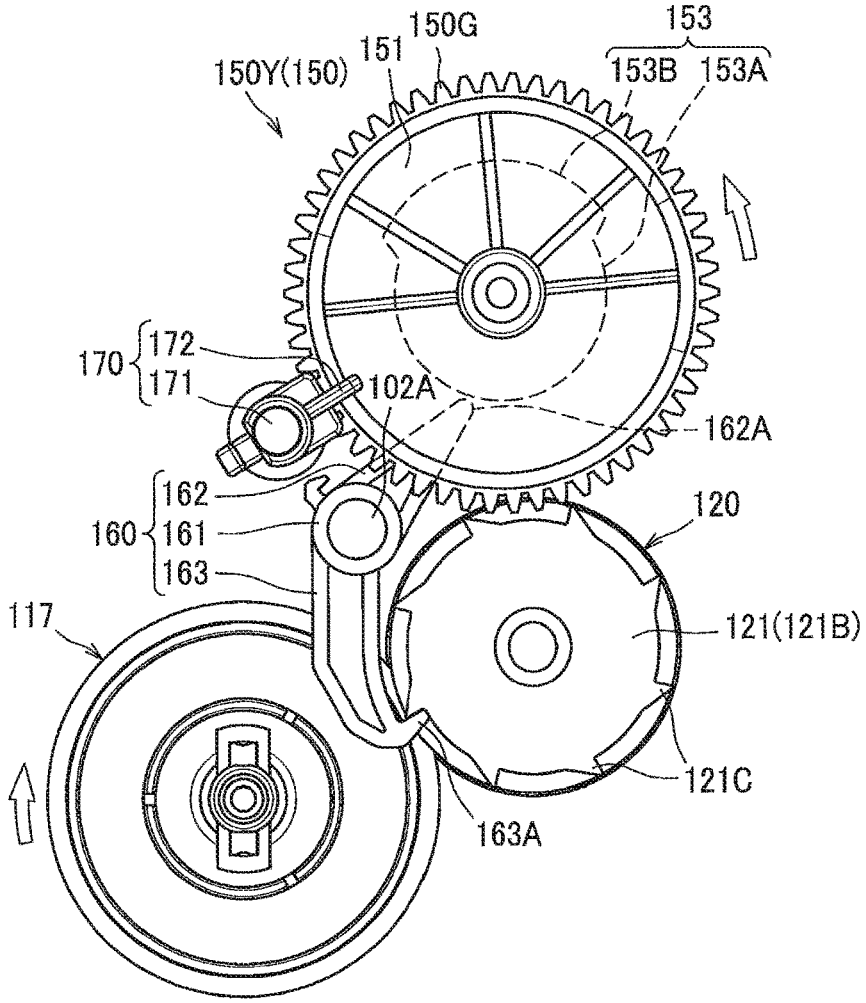
FIG. 13A is a view illustrating the separation mechanism, the lever, the clutch, and the coupling gear in the image forming apparatus according to the embodiment as viewed in the axial direction, and particularly illustrating a state where the cam is rotated from the state of FIG. 12A and a developing roller corresponding to a color of yellow is at its contacting position for performing image formation.
Figure 13B:
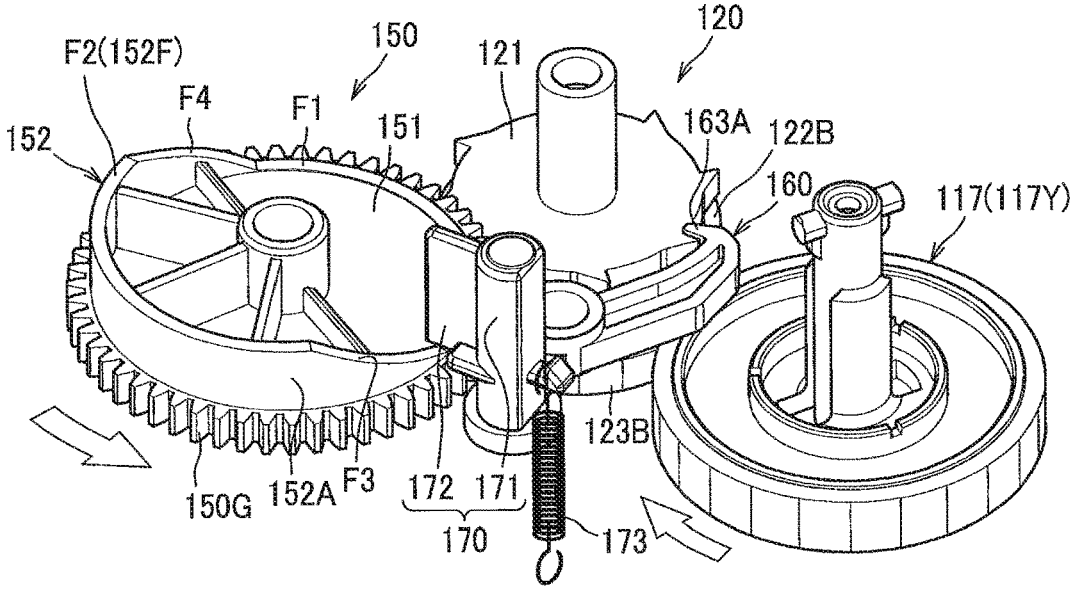
FIG. 13B is a perspective view illustrating the separation mechanism, the lever, the clutch, and the coupling gear in the image forming apparatus according to the embodiment, and particularly illustrating the state where the cam is rotated from the state of FIG. 12B and the developing roller corresponding to the color of yellow is at the contacting position for performing image formation.

As illustrated in FIGS. 13A and 13B, in accordance with further rotation of the cam 150 from the state illustrated in FIGS. 12A and 12B, the contact portion 172 of the cam follower 170 slidingly moves over the first holding surface F1 of the cam 150 and approaches the first guide surface F3. In a case where the rotation of the yellow cam 150Y is stopped while the developing roller 61 is at the contacting position, the rotation of the yellow cam 150Y is stopped when the contact portion 172 is at such a position in contact with the first guide surface F3, the position being closer to the first holding surface F1 than to the second holding surface F2, as illustrated in FIG. 13B.

Figure 14A:
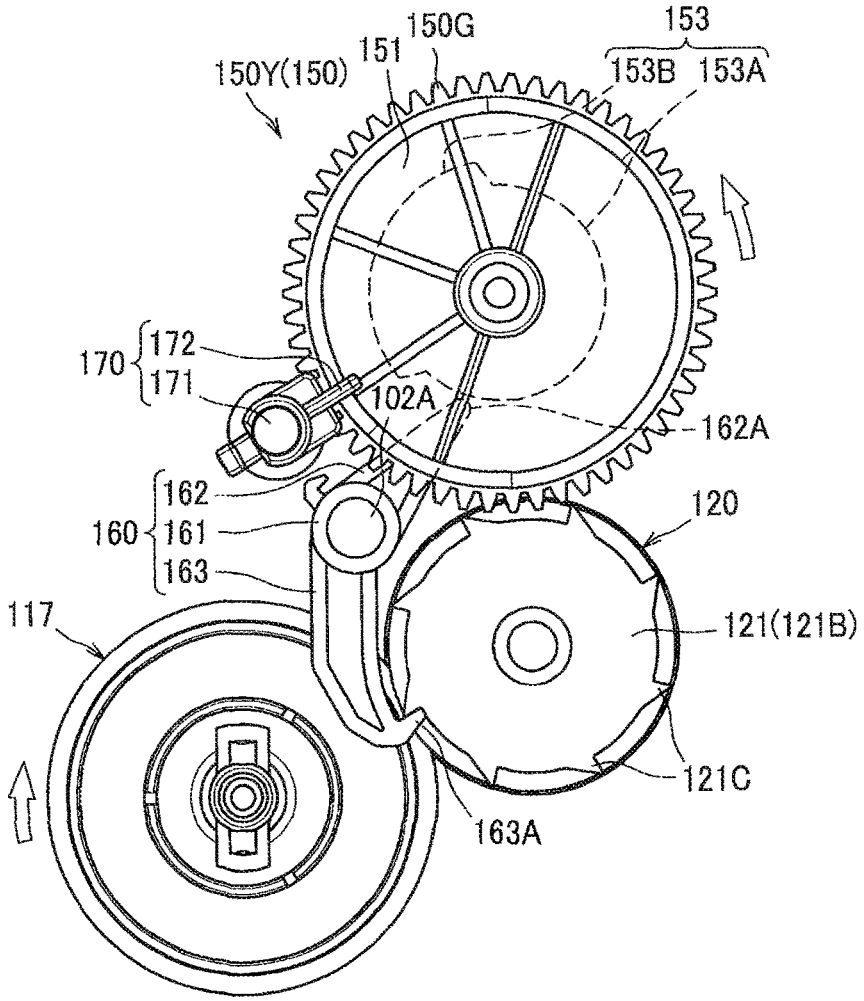
FIG. 14A is a view illustrating the separation mechanism, the lever, the clutch, and the coupling gear in the image forming apparatus according to the embodiment as viewed in the axial direction, and particularly illustrating a state where the cam is further rotated from the state of FIG. 13A and the developing roller is at its separated position and the clutch is at the transmission state.
Figure 14B:
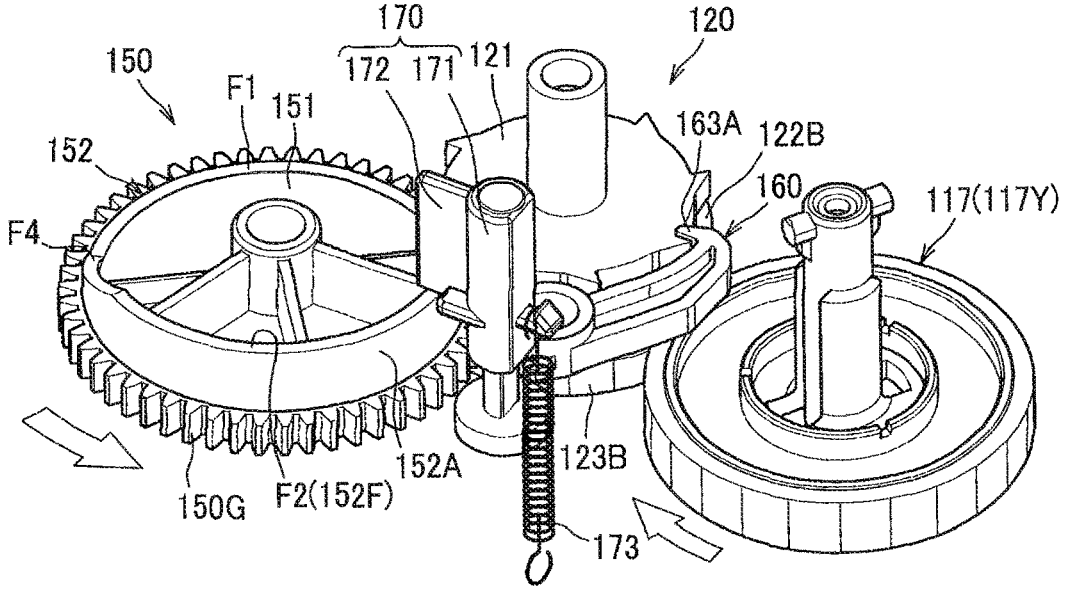
FIG. 14B is a perspective view illustrating the separation mechanism, the lever, the clutch, and the coupling gear in the image forming apparatus according to the embodiment, and particularly illustrating the state where the cam is further rotated from the state of FIG. 13B and the developing roller is at the separated position and the clutch is at the transmission state.

In order to separate the developing roller 61 away from the photosensitive drum 50, the cam 150Y is further rotated from the state illustrated in FIGS. 13A and 13B so that the contact portion 172 of the cam follower 170 slidingly moves over the first guide surface F3 and is brought into contact with the second holding surface F2 as illustrated in FIGS. 14A and 14B. Hence, the slide shaft portion 171 of the cam follower 170 pushes the slide member 64 of the developing cartridge 60 in the axial direction, so that the developing cartridge 60 is pushed frontward by the reaction force from the counterpart abutment portions 94 provided on the support member 90 (see FIG. 4B).

The developing roller 61 is thus separated from the photosensitive drum 50 in a state where the contact portion 172 is positioned on a region of the first guide surface F3, the region being closer to the second holding surface F2 than to the first holding surface F1. The separated position of the developing roller 61 is maintained in a state where the contact portion 172 is positioned on the second holding surface F2.

Figure 15A:
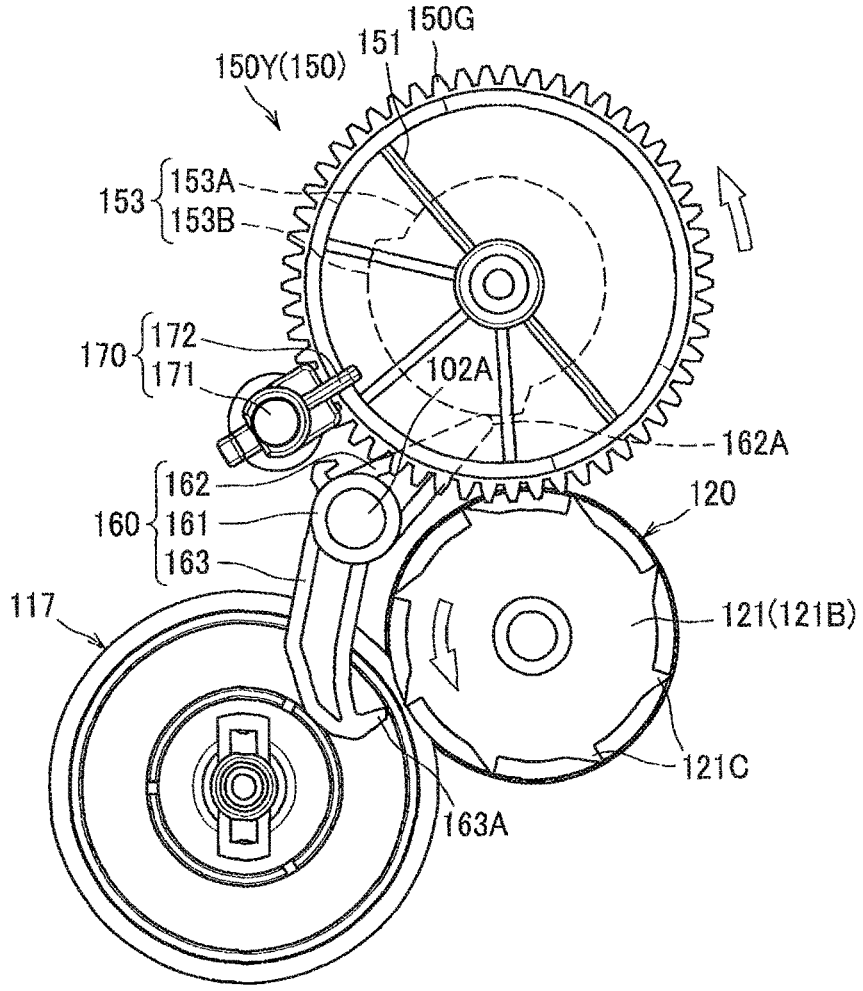
FIG. 15A is a view illustrating the separation mechanism, the lever, the clutch, and the coupling gear in the image forming apparatus according to the embodiment as viewed in the axial direction, and particularly illustrating a state where the cam is further rotated from the state of FIG. 14A and the developing roller is at the separated position and the clutch is at its cut-off state.
Figure 15B:
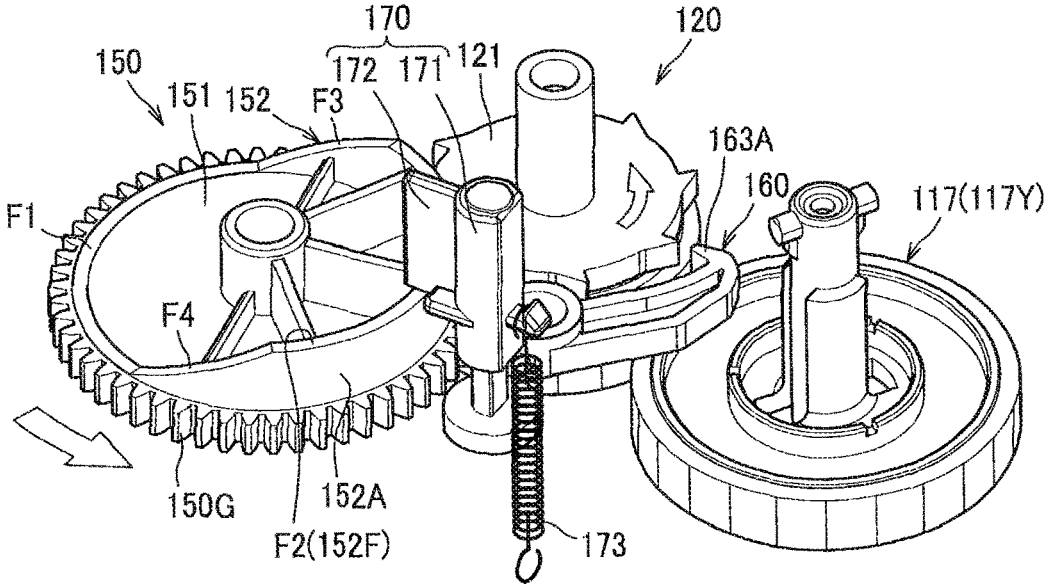
FIG. 15B is a perspective view illustrating the separation mechanism, the lever, the clutch, and the coupling gear in the image forming apparatus according to the embodiment, and particularly illustrating the state where the cam is further rotated from the state of FIG. 14B and the developing roller is at the separated position and the clutch is at the cut-off state.

As illustrated in FIGS. 15A and 15B, the cam 150 further rotates after the developing roller 61 is positioned at the separated position, so that the tip end portion 162A of the first arm 162 of the lever 160 is brought into contact with the second cam portion 153B. The lever 160 is pivotally moved because the second cam portion 153B pushes the first arm 162. Hence, the hook 163A is disengaged from the pawl 121C of the sun gear 121, thereby providing the disengagement position of the lever 160.

Since the lever 160 no longer stops the rotation of the sun gear 121 of the clutch 120, the clutch 120 is switched to the cut-off state where the output gear 123B does not perform power transmission during rotation of the input gear 122B. Accordingly, the driving force of the developing motor 3D cannot be transmitted to the developing roller 61. That is, the rotation of the developing motor 3D does not cause rotation of the developing roller 61, but only causes idle rotation of the sun gear 121.

Figure 16A:
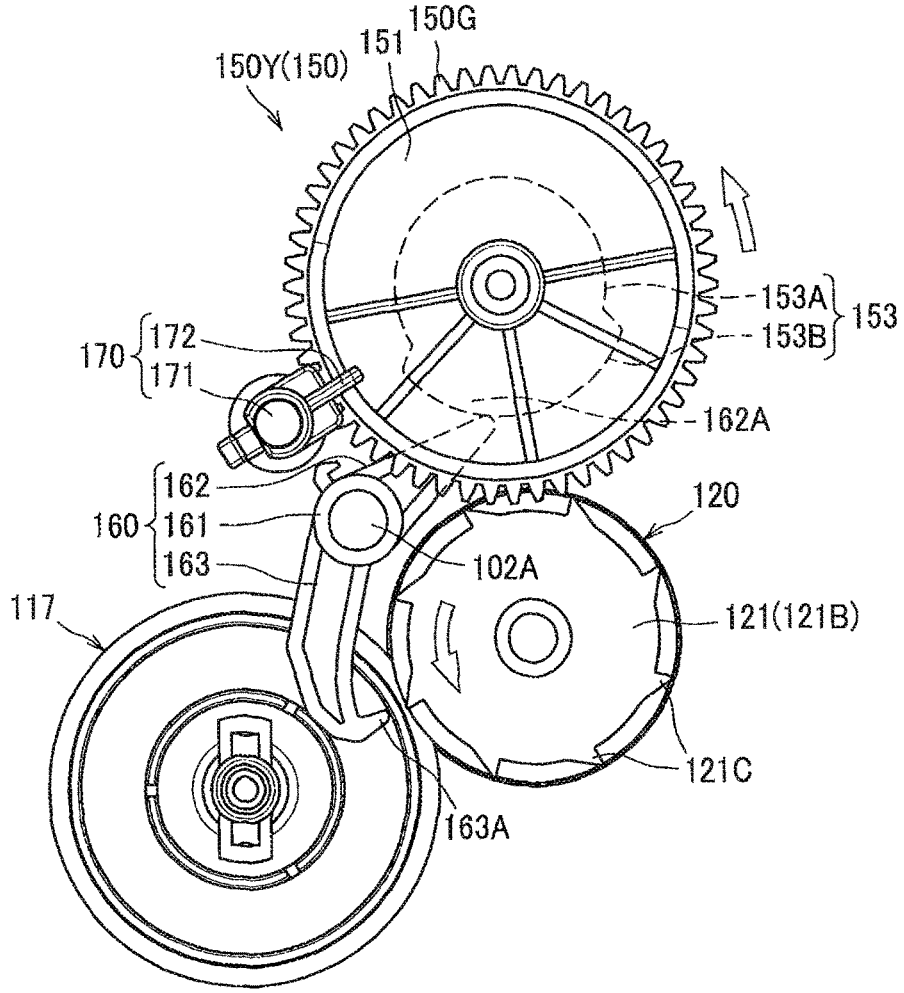
FIG. 16A is a view illustrating the separation mechanism, the lever, the clutch, and the coupling gear in the image forming apparatus according to the embodiment as viewed in the axial direction, and particularly illustrating a state where the cam is further rotated from the state of FIG. 15A and the developing roller corresponding to the color of yellow is temporarily stopped immediately before starting to move to the contacting position.
Figure 16B:
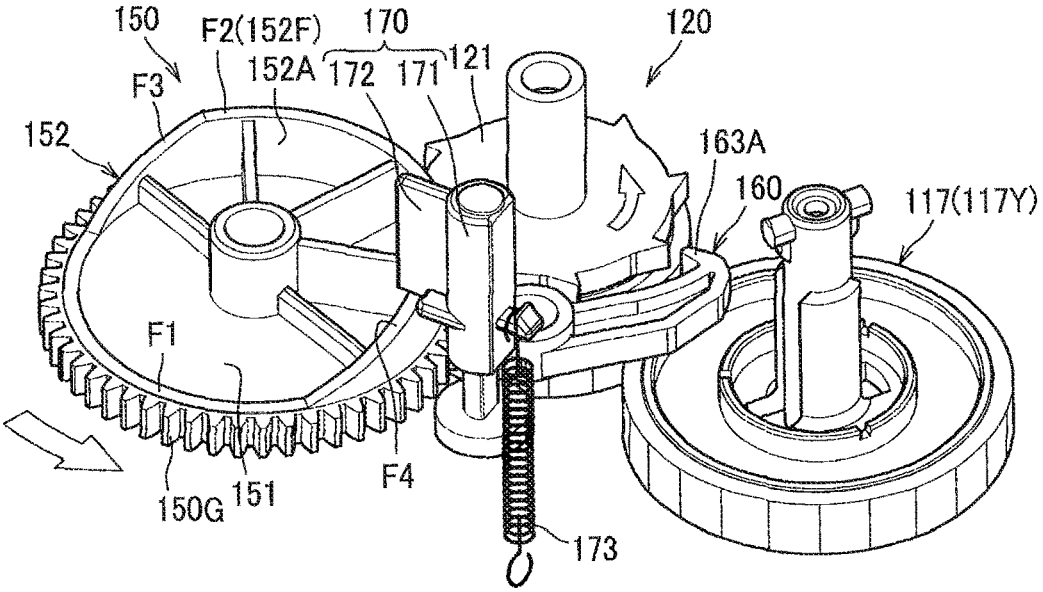
FIG. 16B is a perspective view illustrating the separation mechanism, the lever, the clutch, and the coupling gear in the image forming apparatus according to the embodiment, and particularly illustrating the state where the cam is further rotated from the state of FIG. 15B and the developing roller corresponding to the color of yellow is temporarily stopped immediately before starting to move to the contacting position.

In order to maintain the separated position of the developing roller 61, the rotation of the cam 150 is halted while the lever 160 is at the disengagement position illustrated in FIGS. 15A and 15B. For temporarily stopping the rotation of the yellow cam 150Y while the developing roller 61 is at the separated position, the cam 150Y is further rotated from the state illustrated in FIGS. 15A and 15B. Then, as illustrated in FIGS. 16A and 16B, rotation of the yellow cam 150Y is stopped when the contact portion 172 reaches an end of the second holding surface F2, the end being immediately upstream of the second guide surface F4. That is, the contact portion 172 is stopped immediately before moving onto the second guide surface F4 (before coming into contact with the second guide surface F4).

In order to move the developing roller 61 from the separated position to the contacting position, the cam 150 is further rotated from the state illustrated in FIGS. 15A and 15B or FIGS. 16A and 16B. As a result, the contact portion 172 is slidingly moved over the second guide surface F4 and comes to the position in contact with the first holding surface F1 by the urging force of the spring 173 as illustrated in FIGS. 12A and 12B.

Accordingly, the cam follower 170 is moved in the axial direction away from the slide member 64, so that the slide member 64 can be moved leftward in FIG. 4A by the urging force of the spring 184. As the slide member 64 is moved back to the position illustrated in FIG. 4A, the developing cartridge 60 is returned to the contacting position indicated by the solid line in FIG. 1 where the developing roller 61 is in contact with the photosensitive drum 50. The developing roller 61 is brought into contact with the photosensitive drum 50 when the contact portion 172 moves past a region of the second guide surface F4, the region being adjacent to the second holding surface F2 (see FIG. 16B).

In the meantime, the lever 160 is pivotally moved to the engagement position where the hook 163A of the second arm 163 is engaged with the pawl 121C, since the tip end portion 162A of the first arm 162 faces the circular base portion 153A. Therefore, the clutch 120 is rendered into the transmission state.

<Operations of the Controller 2>

In the image forming apparatus 1 according to the embodiment, the first developing roller 61Y, the second developing roller 61M, the third developing roller 61C, and the fourth developing roller 61K are configured to be moved to the contacting positions for transferring respective toner image to the sheet S in synchronism with the movement of the sheet S, and are configured to be moved in sequence to the separated positions after completion of development of the toner images to the corresponding photosensitive drums 50.

To this effect, the cams 150Y, 150M and 150C are assembled so that the phases (angular positions) of the respective first cam portions 152A is displaced from one another by a predetermined angle (see FIG. 9). Specifically, the cams 150M and 150C have the same structure as each other. Further, the length of the first cam portion 152A of the yellow cam 150Y in the rotational direction is greater than the length of the cam 150M and 150C in the rotational direction thereof. Further, as illustrated in FIGS. 9 and 10, the phases or the angular positions of downstream ends of the respective first cam portions 152A are displaced from one another by a predetermined angle with respect to the cams 150Y, 150M and 150C, whereas the phases or angular positions of upstream ends of the respective first cam portions 152A are coincident with each other with respect to the cams 150Y and 150M.

Further, the structure of the cam 150K is identical to the structure of the cams 150M and 150C. However, the controller 2 is configured to control the cam 150K to start operating at a timing later by a predetermined angle (retardation in phase) than a timing at which the operations of the cams 150M and 150C are started.

The controller 2 is configured to control overall operations performed in the image forming apparatus 1. The controller 2 includes a CPU, a ROM, a RAM, an input portion, and an output portion and the like, and is configured to perform various processing by executing programs preliminarily stored therein.

The controller 2 is configured to control the YMC clutch 140A and the K clutch 140K in response to signals transmitted from the first sheet feed sensor 28A, the front sensor 28B, the back sensor 28C, and the separation sensors 4K and 4C, thereby controlling the contact/separation of the developing rollers 61 relative to the respective photosensitive drums 50.

The controller 2 is configured to control the developing rollers 61M, 61C and 61K to be positioned at the contacting position prior to irradiation of the laser beams toward the photosensitive drums 50 positioned adjacent to and immediately upstream of the respective developing rollers 61M, 61C and 61K, i.e., the photosensitive drums 50Y, 50M and 50C, respectively. That is, the second developing roller 61M and the third developing roller 61C are configured to be moved to the contacting position prior to irradiation of the laser beams to the upstream photosensitive drums 50Y and 50M by the difference in length of the first cam portions 152A among the cams 150Y, 150M and 150C, and by the mechanical settings as to displacement of phases of the cams 150Y, 150M and 150C.

Specifically, in order to move the second developing roller 61M to the contacting position prior to the exposure to the first photosensitive drum 50Y, the cams 150Y and 150M are configured to cause the second developing roller 61M to contact the second photosensitive drum 50M at a timing concurrently with or prior to, concurrently with in the present embodiment, a timing of contact of the first developing roller 61Y with the first photosensitive drum 50Y.

For performing color printing, the controller 2 controls the cam 150K to be delayed by the predetermined angle against the cam 150C in association with the movement (moving timing) of the third developing roller 61C. That is, for performing color printing employing the first developing roller 61Y, the second developing roller 61M, the third developing roller 61C, and the fourth developing roller 61K, the controller 2 permits the third developing roller 61C and the fourth developing roller 61K to be moved to their contacting positions prior to start of exposure to the third photosensitive drum 50C.

Figure 17A:
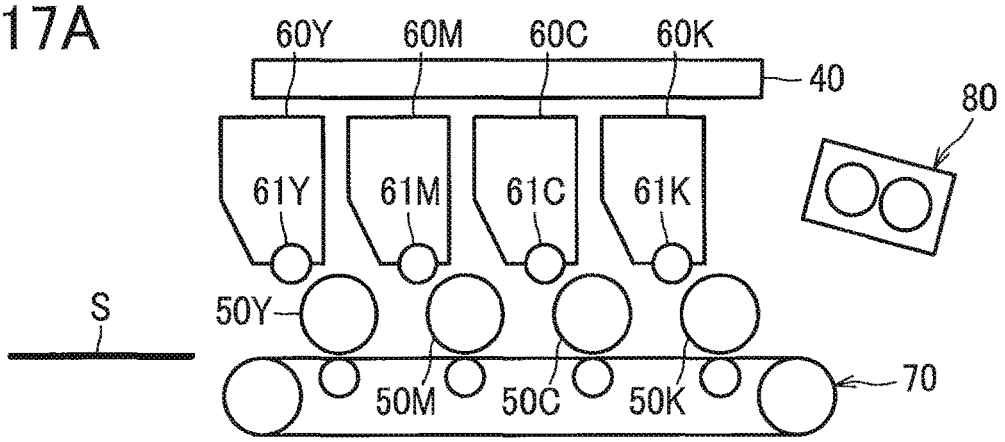
FIG. 17A is a view for description of contacting/separating operation of the developing rollers for performing color printing in the image forming apparatus according to the embodiment, and particularly illustrating a state where a sheet is approaching a most upstream developing roller.

Specifically, as illustrated in FIG. 17A, the controller 2 controls the first developing roller 61Y, the second developing roller 61M, the third developing roller 61C, and the fourth developing roller 61K to be positioned at their separated positions prior to starting printing operation.

Figure 17B:
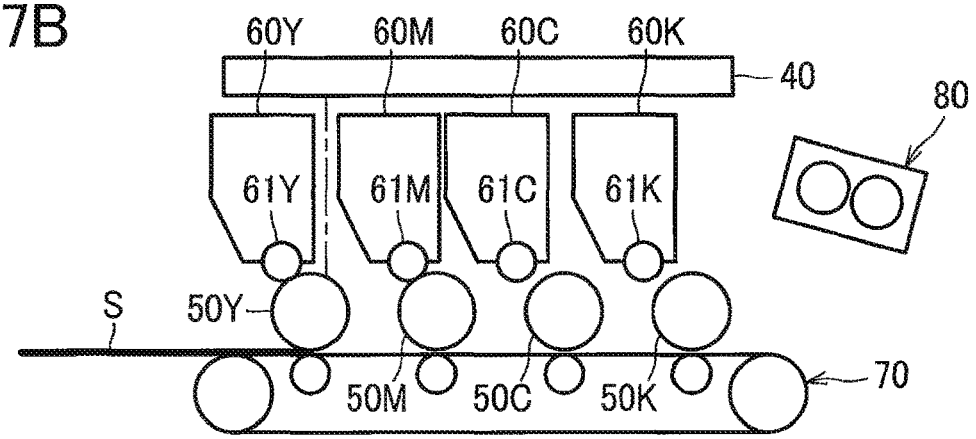
FIG. 17B is a view for description of the contacting/separating operation of the developing rollers for performing the color printing in the image forming apparatus according to the embodiment, and particularly illustrating a state subsequent to the state of FIG. 17A.

Then, as illustrated in FIG. 17B, when the sheet S is about to arrive at the first photosensitive drum 50Y, the first developing cartridge 60Y and the second developing cartridge 60M are simultaneously moved to move corresponding developing rollers (61Y and 61M) to the respective contacting positions prior to start exposure of the first photosensitive drum 50Y. Therefore, development of a toner image on the first photosensitive drum 50Y by the first developing roller 61Y can be performed, and the toner image can be transferred to the sheet S.

Figure 17C:
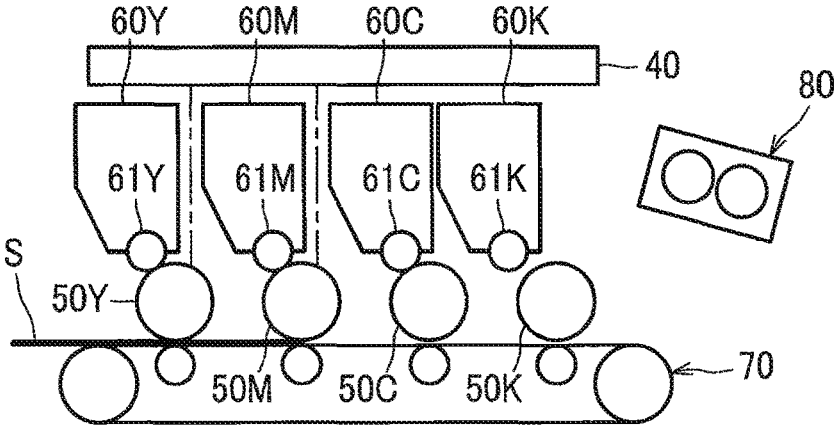
FIG. 17C is a view for description of the contacting/separating operation of the developing rollers for performing the color printing in the image forming apparatus according to the embodiment, and particularly illustrating a state subsequent to the state of FIG. 17B.

Then, as illustrated in FIG. 17C, when the sheet S is about to arrive at the second photosensitive drum 50M, the third developing cartridge 60C is moved to move the developing roller 61C to the contacting position prior to start of exposure of the second photosensitive drum 50M. Therefore, development of a toner image on the second photosensitive drum 50M by the second developing roller 61M can be performed, and the toner image can be transferred to the sheet S.

Figure 17D:
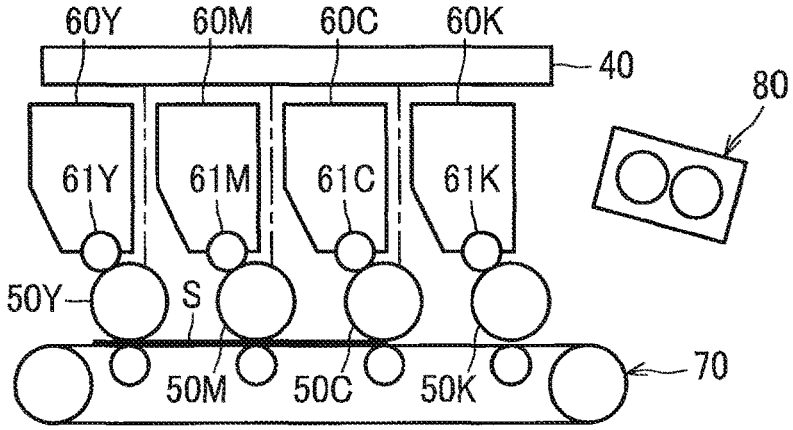
FIG. 17D is a view for description of the contacting/separating operation of the developing rollers for performing the color printing in the image forming apparatus according to the embodiment, and particularly illustrating a state subsequent to the state of FIG. 17C.

Then, as illustrated in FIG. 17D, when the sheet S is about to arrive at the third photosensitive drum 50C, the fourth developing cartridge 60K is moved to move the fourth developing roller 61K to the contacting position prior to start exposure of the third photosensitive drum 50C. Therefore, development of a toner image on the third photosensitive drum 50C by the third developing roller 61C can be performed, and the toner image can be transferred to the sheet S. Further, the development of a toner image on the fourth photosensitive drum 50K by the fourth developing roller 61K can be performed, since the fourth developing roller 61K is at the contacting position.

Figure 18A:
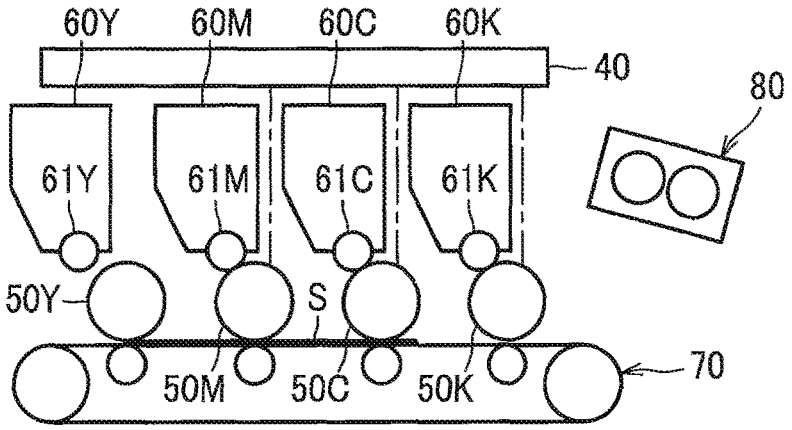
FIG. 18A is a view for description of the contacting/separating operation of the developing rollers for performing the color printing in the image forming apparatus according to the embodiment, and particularly illustrating a state subsequent to the state of FIG. 17D.

Then, as illustrated in FIG. 18A, the controller 2 controls the first developing cartridge 60Y to be moved to move the first developing roller 61Y to the separated position, after termination of development on the photosensitive drum 50Y by the first developing roller 61Y and prior to termination of development on the photosensitive drum 50M by the second developing roller 61M.

Figure 18B:
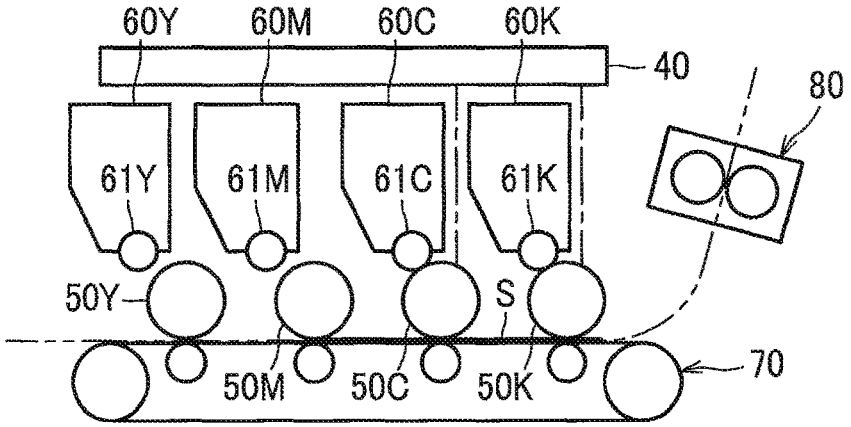
FIG. 18B is a view for description of the contacting/separating operation of the developing rollers for performing the color printing in the image forming apparatus according to the embodiment, and particularly illustrating a state subsequent to the state of FIG. 18A.

Then, as illustrated in FIG. 18B, the second developing cartridge 60M is moved to move the second developing roller 61M to the separated position, after termination of the development on the photosensitive drum 50M by the second developing roller 61M and prior to termination of development on the photosensitive drum 50C by the third developing roller 61C.

Figure 18C:
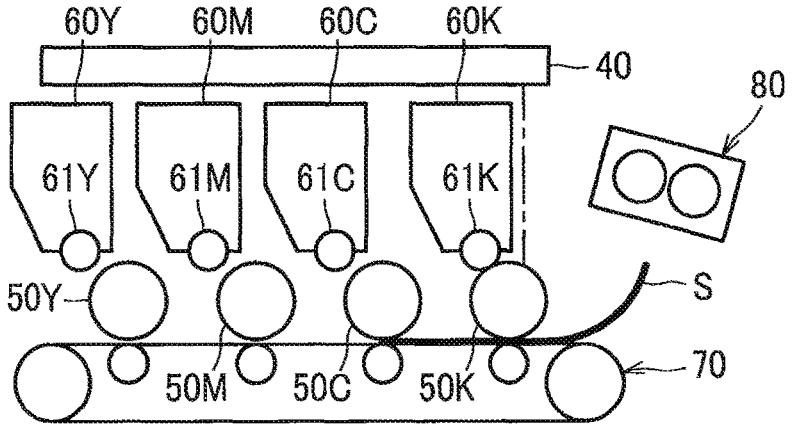
FIG. 18C is a view for description of the contacting/separating operation of the developing rollers for performing the color printing in the image forming apparatus according to the embodiment, and particularly illustrating a state subsequent to the state of FIG. 18B.

Then, as illustrated in FIG. 18C, the third developing cartridge 60C is moved to move the third developing roller 61C to the separated position, after termination of the development on the photosensitive drum 50C by the third developing roller 61C and prior to termination of development on the photosensitive drum 50K by the fourth developing roller 61K.

Figure 18D:
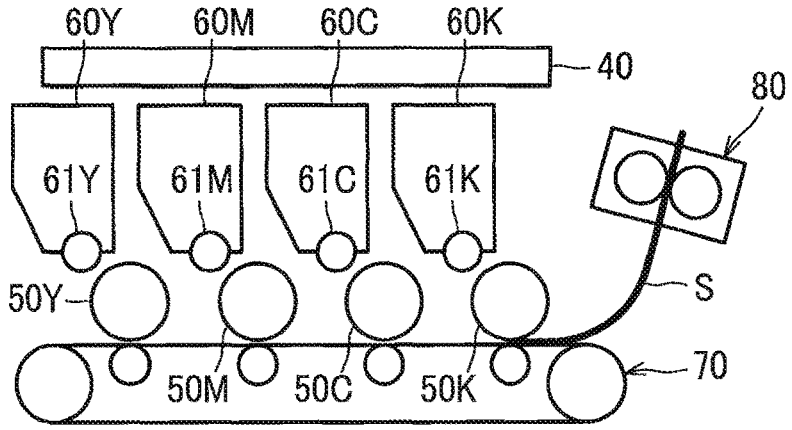
FIG. 18D is a view for description of the contacting/separating operation of the developing rollers for performing the color printing in the image forming apparatus according to the embodiment, and particularly illustrating a state subsequent to the state of FIG. 18C.

Then, as illustrated in FIG. 18D, the controller 2 controls the fourth developing cartridge 60K to be moved to move the fourth developing roller 61K to the separated position, after termination of the development on the photosensitive drum 50K by the fourth developing roller 61K.

On the other hand, in order to perform monochromatic printing in which only the fourth developing roller 61K is employed, the controller 2 controls the fourth developing roller 61K to be moved to the contacting position prior to start of exposure of the fourth photosensitive drum 50K, while maintaining the first developing roller 61Y, the second developing roller 61M, and the third developing roller 61K at the respective separated positions. Then, after termination of the development with respect to the fourth photosensitive drum 50K, the controller 2 permits the fourth developing roller 61K to be moved back to the separated position.

Further, the controller 2 controls the components in the image forming apparatus 1 so that a timing when the first developing roller 61Y and the fourth developing roller 61K contact the first photosensitive drum 50Y and the fourth photosensitive drum 50K, respectively, is coincident with a timing when the sheet S is conveyed. That is, the controller 2 controls the cams 150Y, 150M, 150C and 150K to be rotated upon receipt of a print job.

Further, the controller 2 controls the YMC clutch 140A to stop rotation of the cams 150Y, 150M and 150C at a temporary stop timing. This temporary stop timing is a timing at which: a first time period T11 has elapsed from the timing at which the separation sensor 4C stops transmitting the ON signal (the timing at which the signal turns OFF); and the first developing roller 61Y is in separation from the first photosensitive drum 50Y.

Then, the controller 2 controls the YMC clutch 140A to rotate the cams 150Y, 150M and 150C to bring the first developing roller 61Y into contact with the first photosensitive drum 50Y for image formation at a restart timing at which one of the first sheet feed sensor 28A and the second sheet feed sensor 38A functioning as the sheet sensor detects the leading edge of the sheet S fed from the corresponding one of the first tray 21 and the second tray 31.

Further, the controller 2 controls the K clutch 140K to stop rotation of the cam 150K at a temporary stop timing. This temporary stop timing is a timing at which: a first time period 121 has elapsed from the timing at which the ON signal is not transmitted from the separation sensor 4K (the timing at which the signal turns OFF); and the fourth developing roller 61K is in separation from the fourth photosensitive drum 50K.

Further, the controller 2 controls the K clutch 140K to start rotation of the cam 150K at a restart timing at which a second time period T22 has elapsed from the timing at which the front sensor 28B detects the leading edge of the sheet S, so that the fourth developing roller 61K contacts the fourth photosensitive drum 50K to perform image formation.

Further, in the image forming apparatus 1, the controller 2 is configured to switch rotation speed of the developing motor 3D to switch a rotation speed of the developing rollers 61 and a speed at which the developing rollers 61 are moved between the respective contacting positions and the separated positions. Specifically, the controller 2 is configured to perform a normal mode for rotating the developing motor 3D at a first rotation speed, and a low-speed mode for rotating the developing motor 3D at a second rotation speed smaller than the first rotation speed. Rotation speed of the developing rollers 61 and the speed at which the developing rollers 61 are moved between the contacting positions and the separated positions under the low-speed mode is lower than those under the normal mode. The normal mode is an example of a first mode, and the low-speed mode is an example of a second mode.

The controller 2 is configured to switch the rotation speed of the developing motor 3D (switch operation modes) in response to, for example, a temperature in the housing 10. In a case where the temperature in the housing 10 is lower than a predetermined temperature, grease applied to each gear of the power transmission mechanism 100 becomes stiffened, so that the gears are unlikely to be rotated. Hence, the controller 2 switches the rotation sped of the developing motor 3D from the first rotation speed to the second rotation speed lower than the first rotation speed to switch the operation mode from the normal mode to the low-speed mode.

On the other hand, in a case where the temperature in the housing 10 is higher than the predetermined temperature, the controller 2 switches the rotation speed of the developing motor 3D from the second rotation speed to the first rotation speed to switch the operation mode from the low-speed mode to the normal mode. Incidentally, the controller 2 does not change rotation speed of the process motor 3P and the fixing motor 3F, that is, the controller 2 does not change a speed at which the sheet S is conveyed.

Further, in the image forming apparatus 1, in a case where a printing process is performed onto the sheet S fed from the first tray 21, a preliminary sheet feeding operation (described later) is performed prior to start of movement of the developing rollers 61 from the separated positions to the contacting positions (prior to starting a contacting operation) after completion of preparation of sheet feeding from the first tray 21. The contacting operation is performed on or after a timing at which the first sheet feed sensor 28A detects the sheet S supplied through the preliminary sheet feeding operation. Then, after a prescribed time period T1 has elapsed from the timing at which the first sheet feed sensor 28A detects the sheet S, a main sheet feeding operation for feeding the sheet S toward the photosensitive drums 50 is performed.

Specifically, in order to perform a printing process onto the sheet S supplied from the first tray 21 under the low-speed mode, the controller 2 is configured to perform the preliminary sheet feeding operation after completion of preparation of the sheet feeding and prior to start of the contacting operation in order to absorb variation in a time period starting from the start of rotation of the pick-up roller 23 to the discharge of the sheet from the first tray 21.

Then, the controller 2 performs the contacting operation on or after the timing at which the first sheet feed sensor 28A detects the sheet S fed from the first tray 21 through the preliminary sheet feeding operation, and performs the main sheet feeding operation to feed the sheet S toward the photosensitive drums 50, more specifically, toward the transfer position where the toner image is transferred from the photosensitive drums 50 onto the sheet S after the prescribed time period T1 has elapsed from the timing at which the first sheet feed sensor 28A detects the sheet S.

Incidentally, the transfer position is a position where the toner image is transferred from the first photosensitive drum 50Y onto the sheet S when the color printing is performed, and is a position where the toner image is transferred from the fourth photosensitive drum 50K onto the sheet S when the monochromatic printing is performed.

Here, for example, preparation of sheet feeding is completed when the following three conditions are met: the first condition is that an image data contained in the print job received in the image forming apparatus 1 is converted into raster graphics so that the image to be transferred to the sheet S is prepared; the second condition is that an warm-up operation such as warming up of the fixing device 80 is completed so that the image forming apparatus 1 is ready to perform a printing operation; and the third condition is that the sheet S can be fed at a timing at which the sheet S can avoid interference with a preceding sheet S.

In the preliminary sheet feeding operation, the sheet S accommodated in the first tray 21 is fed to and is stopped at a position at which the first sheet feed sensor 28A can detect the sheet S. During the preliminary sheet feeding operation, the controller 2 first controls the pick-up roller 23 to be rotated, and then controls the pick-up roller 23 to stop rotation at a timing at which the first sheet feed sensor turns ON (outputs ON signal), i.e., at a timing when the first sheet feed sensor 28A detects the leading edge of the sheet S.

In the contacting operation, the controller 2 controls the YMC clutch 140A to turn ON in response to receiving the ON signal from the first sheet feed sensor 28A to rotate the cams 150Y, 150M and 150C to thus bring the developing rollers 61Y, 61M and 61C into contact with the corresponding photosensitive drums 50Y, 50M and 50C. Then, after a third time period T13 has elapsed from the timing at which the YMC clutch 140A turns ON, the controller 2 controls the YMC clutch 140A to turn OFF to stop rotation of the cams 150Y, 150M and 150C.

Further, on or after the first sheet feed sensor 28A starts outputting ON signal (specifically, after the main sheet feeding operation has started) and after the second time period T22 has elapsed from the timing at which the front sensor 28B starts outputting ON signal indicative of detection of the leading edge of the sheet S, the controller 2 controls the K clutch 140K to turn ON to rotate the cam 150K to bring the developing roller 61K into contact with the corresponding photosensitive drums 50K. Then, after a third time period T23 has elapsed from the timing at which the K clutch 140K turns ON, the controller 2 controls the K clutch 140K to turn OFF to stop rotation of the cam 150K.

During the main sheet feeding operation, the controller 2 controls the first sheet feed mechanism 22 including the pick-up roller 23 to feed the sheet S toward the transfer position after the prescribed time period T1 has elapsed from the timing at which the first sheet feed sensor 28A outputs ON signal. Then, the controller 2 controls the first sheet feed mechanism 22 to stop in response to output of OFF signal from the back sensor 28C indicative of the detection of the trailing edge of the final sheet S.

Further, in the image forming apparatus 1, in the case where a printing operation is performed onto the sheet S fed from the first tray 21 (specifically, in order to perform a printing operation onto the sheet S fed from the first tray 21 while the low-speed mode is being performed), the contacting operation is performed and the main sheet feeding operation is performed but the preliminary sheet feeding operation is omitted when, after completion of preparation of the sheet feeding, the first sheet feed sensor 28A already detects the sheet S and is rendered ON prior to start of the preliminary sheet feeding operation.

Further, in a case where the printing operation is performed onto a sheet S from the first tray 21 under the normal mode, and in a case where the printing operation is performed onto the sheet S fed from the second tray 31, the controller 2 does not perform the preliminary sheet feeding operation, since variation in the time period from start of rotation of the pick-up roller 23 or 33 to the discharge of the sheet S from the tray 21 or 31 does not affect the printing operation.

In the latter case, after completion of preparation of the sheet feeding, the controller 2 performs the main sheet feeding operation, i.e., the controller 2 controls the sheet feed mechanisms 22 or 32 to feed a sheet S from the tray 21 or 31 toward the transfer position (toward the photosensitive drum 50), and performs the contacting operation on or after the timing at which the corresponding sheet feed sensor 28A or 38A detects the sheet S conveyed through the main sheet feeding operation.

Specifically, in a case where the printing operation is performed onto a sheet S fed from the first tray 21 under the normal mode, and in a case where the printing operation is performed onto a sheet S fed from the second tray 31, after completion of preparation of sheet feeding, the controller 2 controls the sheet feed mechanism 22 or 32 including the pick-up roller 23 or 33 to feed the sheet S toward the transfer position.

Then, the controller 2 controls the YMC clutch 140A to turn ON to rotate the cams 150Y, 150M and 150C to successively bring the developing rollers 61Y, 61M and 61C into contact with the corresponding photosensitive drums 50Y, 50M and 50C at a timing at which ON signal is outputted from the corresponding sheet feed sensor 28A or 38A. Further, the controller 2 controls the K clutch 140K to turn ON to rotate the cam 150K to bring the fourth developing roller 61K into contact with the corresponding fourth photosensitive drum 50K after the second time period T22 has elapsed from the timing at which ON signal is outputted from the front sensor 28B.

Incidentally, the controller 2 sets a prescribed flag F to "1" in the case where the printing operation is to be performed onto the sheet S fed from the first tray 21 under the low-speed mode in the image forming apparatus 1. On the other hand, the controller 2 sets the prescribed flag F to an initial value, i.e., "0" in the case where the printing operation is to be performed onto the sheet S fed from the first tray 21 under the normal mode, or in the case where the printing operation is to be performed onto the sheet S fed from the second tray 31. The controller 2 is configured to perform the preliminary sheet feeding operation when the prescribed frag F is set to "1", and not to perform the preliminary sheet feeding operation when the prescribed frag F is set to "0".

Note that, as described above, even in a case where the prescribed flag F is set to "1" (i.e., the printing operation is to be performed onto the sheet S fed from the first tray 21 while the low-speed mode is performed), the preliminary sheet feeding operation is not performed when the first sheet feed sensor 28A already outputs ON signal before starting the preliminary sheet feeding operation.

The preliminary sheet feeding operation performed when performing a printing operation onto the sheet S fed from the first tray 21 during execution of the low-speed mode is an example of (a) controlling, and the main sheet feeding operation after this preliminary sheet feeding operation is an example of (c) controlling. The main sheet feeding operation performed when performing a printing operation onto the sheet S fed from the second tray 31 is an example of (e) controlling. The main sheet feeding operation performed when performing a printing operation onto the sheet S supplied from the first tray 21 during execution of the normal mode is an example of (g) controlling.

<Process Performed by Controller 2>

Figure 19:
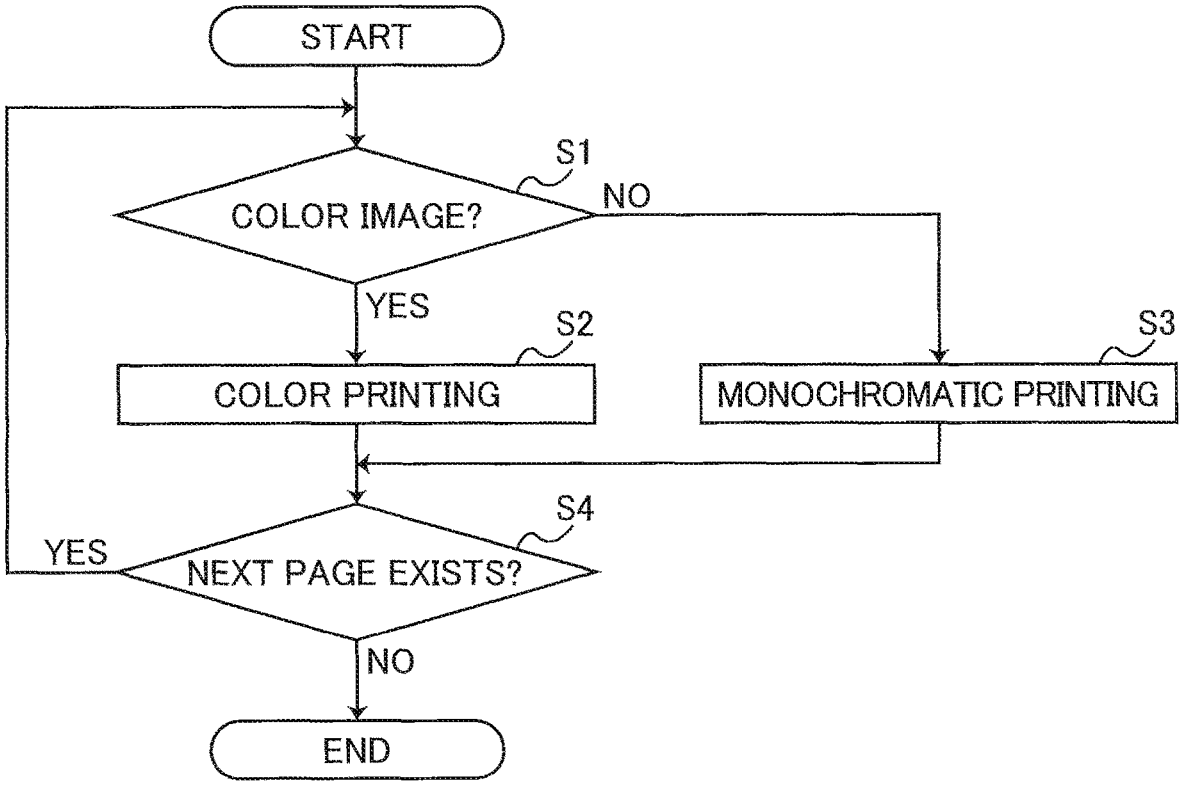
FIG. 19 is a flowchart illustrating an example of process executed by a controller in the image forming apparatus according to the embodiment upon receipt of a print job in the image forming apparatus.

Next, a process to be executed by the controller 2 will be described with reference to FIG. 19.

In response to receipt of a print job, the controller 2 determines whether an image to be printed on a first page is a color image (S). When the controller 2 determines that the color image is to be formed (S1: Yes), the controller 2 executes a color printing process (S2). On the other hand, when the controller 2 determines that a monochromatic image is to be printed, i.e., the color image is not to be printed (S1: No), the controller 2 executes a monochromatic printing process (S3).

Upon completion of image formation on the first page in the step S2 or S3, the controller 2 determines whether the print job contains data of a subsequent page (S4). When the data of the next page exists in the print job (S4: Yes), the controller 2 returns to the process in S1. When the print job does not contain data of the next page (S4: No), the controller 2 ends the process.

Next, the color printing process (S2) will be described with reference to flowcharts illustrated in FIGS. 20A through 22 and a timing chart illustrated in FIG. 23. Incidentally, in each first line of the timing chart illustrated in FIG. 23 and timing charts illustrated in FIGS. 24 through 26 (described later), operation timing of the first through fourth developing rollers 61Y, 61M, 61C and 61K is indicated by different lines such as a bold line, a normal line, and a broken line those being partly overlapped with each other.

When the color printing process in S2 is performed, all developing rollers 61 are at their separated positions prior to image forming operation. The controller 2 controls the YMC clutch 140A to turn ON (S101 in FIG. 20A, t0) and controls the K clutch 140K to turn ON (S201 in FIG. 20B, t0) in order to successively move the developing rollers 61 to their contacting positions. As a result, the cams 150Y, 150M, 150C and 150K start rotating, and immediately thereafter, the separation sensors 4C and 4K are turned OFF (t31).

Then, the controller 2 determines whether the first time period T11 has elapsed from the timing at which the separation sensor 4C for the color of cyan is turned OFF (S102). In a case where the first time period T11 is determined to have elapsed (S102: Yes), the controller 2 controls the YMC clutch 140A to turn OFF (S103, t32) to stop rotation of the cams 150Y, 150M and 150C at the temporary stop timing.

The first time period T11 is set so that the temporary stop timing is at a timing at which the contact portion 172 of the cam follower 170 for the color of yellow is positioned on a region of the second holding surface F2, the region being closest to the second guide surface F4. Hence, immediately after the restart of rotation of the cams 150Y, 150M, 150C and the cam follower 170 for the color of yellow is moved to the second guide surface F4 so that the first developing roller 61Y starts to be moved to the contacting position.

Figure 21:
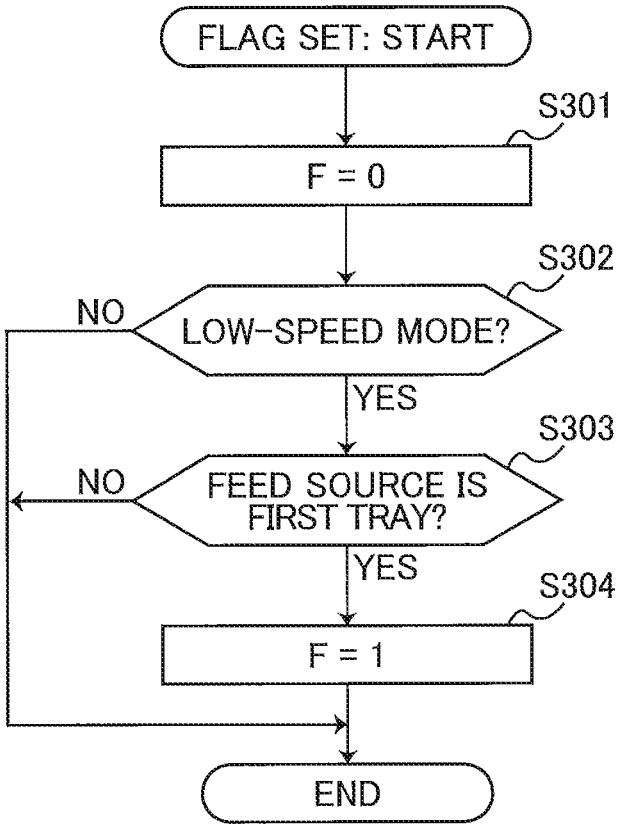
FIG. 21 is a flowchart illustrating an example of a flag setting process executed by the controller in the image forming apparatus according to the embodiment.

In the meantime, the controller 2 performs a flag setting process illustrated in FIG. 21. Specifically, first the controller 2 sets the prescribed flag F to the initial value, i.e., "0" (S301). Then, the controller 2 determines whether the low-speed mode is to be performed (S302). In a case where the low-speed mode is to be performed (S302: Yes), the controller 2 determines whether the sheet feeding source is the first tray 21, i.e., the sheet S is to be fed from the first tray 21 (S303). In a case the controller 2 determines that the sheet S is to be fed from the first tray 21 (S303: Yes), the controller 2 sets the prescribed flag F to "1" (S304) to terminate the flag setting process.

On the other hand, when the normal mode is to be performed (S302: No), or when the sheet S is to be fed from the second tray 31 (S303: No), the controller 2 terminates the flag setting process without setting the prescribed flag F to "1", i.e., maintaining the prescribed flag F at "0". In summary, the prescribed flag F is rendered "1" when the low-speed mode is to be performed and the sheet supply source is the first tray 21, and the prescribed flag F is rendered "0" when the normal mode is to be performed or when the sheet supply source is the second tray 31.

In the following description, a printing operation performed onto the sheet S fed from the first tray 21 will be described.

Figure 22:
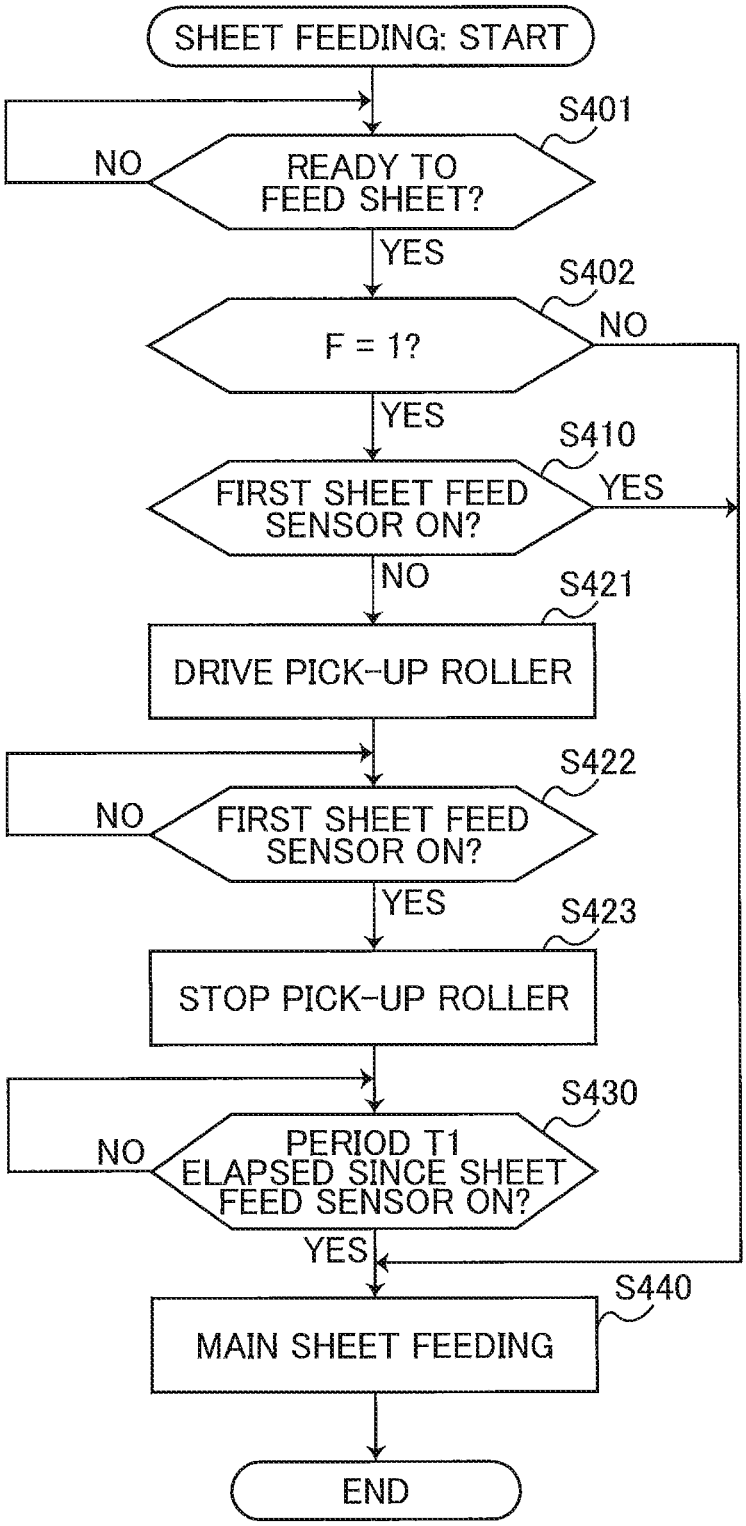
FIG. 22 is a flowchart illustrating an example of a sheet feeding process executed by the controller in the image forming apparatus according to the embodiment.

Next, the controller 2 performs a sheet feeding process illustrated in FIG. 22. At the beginning of the sheet feeding process, the controller 2 determines whether preparation of sheet feeding is completed (S401). In a case where preparation of sheet feeding is completed (S401: Yes), then the controller 2 determines whether the prescribed flag F is set to "1" (402).

When the prescribed flag F is set to "1" (S402: Yes), the controller 2 determines whether the first sheet feed sensor 28A is rendered ON (S410). When the first sheet feed sensor 28A is rendered OFF (S410: No), the controller 2 performs the preliminary sheet feeding operation (S421 to S423). Specifically, the controller 2 controls the pick-up roller 23 to be rotated (S421, 33). Then, the controller 2 controls the pick-up roller 23 to stop rotation (S423, t34) to terminate the preliminary sheet feeding operation in response to ON signal outputted from the first sheet feed sensor 28A (S422: Yes).

Figure 20A:
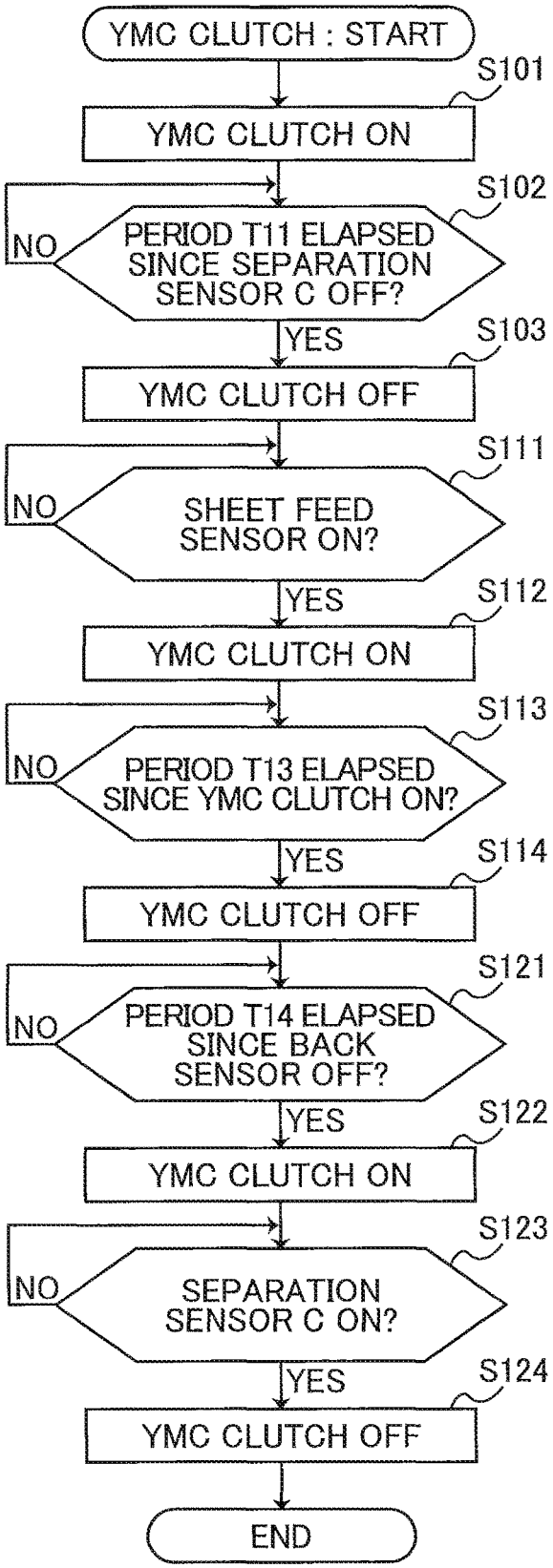
FIG. 20A is a flowchart illustrating an example of process for controlling a YMC clutch executed by the controller in the image forming apparatus according to the embodiment.

When ON signal is outputted from the first sheet feed sensor 28A (S111 in FIG. 20A: Yes), the controller 2 controls the YMC clutch 140A to turn ON (S112, t34) to restart rotation of the cams 150Y, 150M and 150C at the restart timing in order to start movement of the developing rollers 61Y, 61M and 61C from their separated positions toward the contacting positions.

Then, the controller 2 determines whether the prescribed time period T1 has elapsed from the timing at which the first sheet feed sensor 28A starts outputting ON signal (S430 in FIG. 22). When determining that the prescribed time period T1 has elapsed (S430: Yes), the controller 2 performs the main sheet feeding operation (S440) to again rotate the pick-up roller 23 (t35) in order to feed the sheet S whose leading edge reaches the first sheet feed sensor 28A toward the transfer position.

Figure 20B:
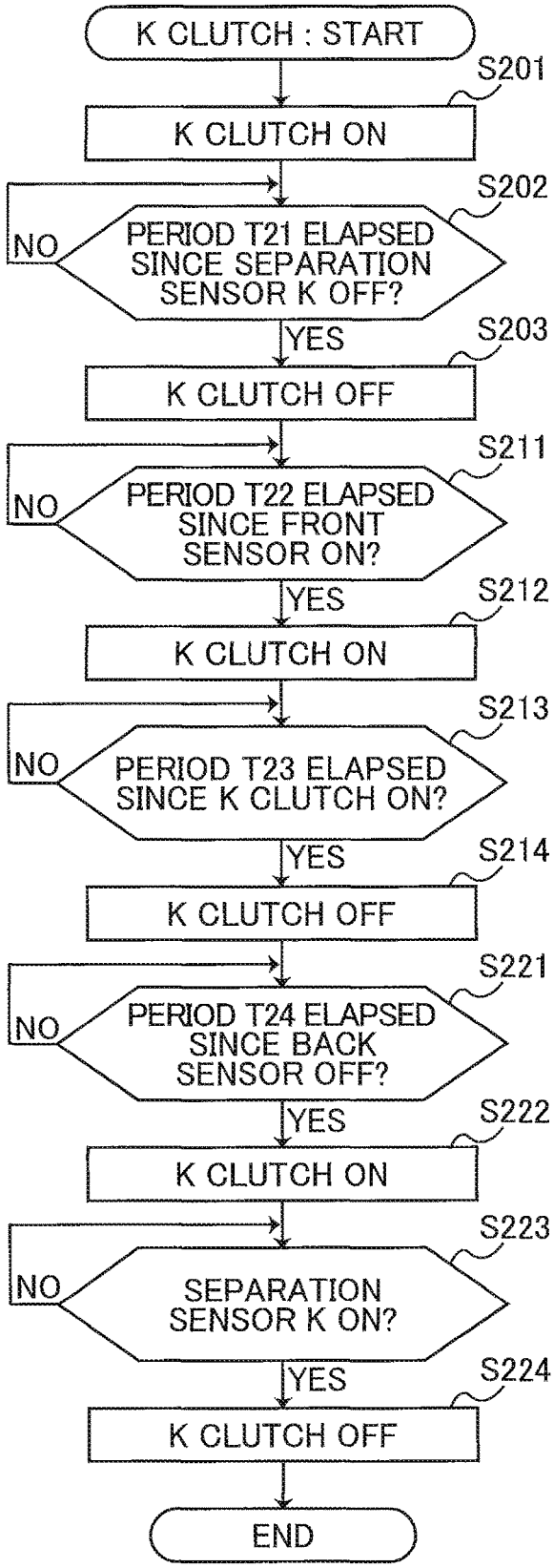
FIG. 20B is a flowchart illustrating an example of process for controlling a K clutch executed by the controller in the image forming apparatus according to the embodiment.

Further, during a period from performing the main sheet feeding operation to arrival of the sheet S at the fourth photosensitive drum 50K, the controller 2 determines whether the first time period T21 has elapsed from the timing at which the separation sensor 4K for the color of black starts outputting OFF signal (S202 in FIG. 20B). In a case where the controller 2 determines that the first time period 121 has elapsed (S202: Yes), the controller 2 controls the K clutch 140K to be turned OFF (S203, t36) to stop rotation of the cam 150K at the temporary stop timing.

The first time period T21 is set so that the temporary stop timing is at a timing at which the contact portion 172 of the cam follower 170 for the color of black is positioned on a region of the second holding surface F2, the region being closest to the second guide surface F4. Hence, immediately after the restart of rotation of the cam 150K, the cam follower 170 for the color of black is promptly moved to the second guide surface F4 so that the fourth developing roller 61K starts moving to the contacting position. Note that the first time period T21 is different from the first time period T11.

Then, the controller 2 determines (S211) whether the second time period T22 has elapsed from the timing (t37) at which the front sensor 28B is turned ON (at which the leading edge of the sheet S moves past the front sensor 28B). In a case where the second time period T22 has elapsed (S211: Yes), the controller 2 controls the K clutch 140K to be turned ON (S212, t38) to start again rotation of the cam 150K at a restart timing, so that the fourth developing roller 61K starts moving from the separated position toward the contacting position.

The second time period T22 is set so that the toner development on the fourth photosensitive drum 50K by the fourth developing roller 61K can be completed prior to a timing at which the toner image formed on the photosensitive drum 50K is transferred to the conveyed sheet S. Hence, the fourth developing roller 61K is positioned to the contacting position at a timing immediately before the start of exposure of the third photosensitive drum 50C.

Then, the controller 2 determines (S113 in FIG. 20A) whether the third time period T13 has elapsed from the timing at which the YMC clutch 140A turns ON at the restart timing (t34). In a case where the controller 2 determines that the third time period T13 has elapsed (S113: Yes), the controller 2 controls the YMC clutch 140A to be turned OFF (S114, t39) to stop rotation of the cams 150Y, 150M and 150C. The third time period T13 is set to a time period within which all of the first through third developing rollers 61Y, 61M and 61C are moved to the respective contacting positions.

Further, the controller 2 determines (S213 in FIG. 20B) whether the third time period T23 has elapsed from the timing at which the K clutch is turned ON at the restart timing (t38). In a case where the third time period T23 has elapsed (S213: Yes), the controller 2 controls the K clutch 140K to be turned OFF (214, t40) to stop rotation of the cam 150K. The third time period T23 is set to a time period within which the fourth developing roller 61K is moved to the contacting position.

Then, the controller 2 determines (S121 in FIG. 20A) whether the fourth time period T14 has elapsed from a timing at which the back sensor 28C turns OFF (t41), the timing being a timing at which the trailing edge of the sheet S moves past the back sensor 28C. In case where the fourth time period T14 has elapsed (S121: Yes), the controller 2 controls the YMC clutch 140A to be turned ON (S122, t42) to rotate the cams 150Y, 150M and 150C to thus successively start separating operation of the first developing roller 61Y, the second developing roller 61M, and the third developing roller 61C from the corresponding photosensitive drums 50.

The fourth time period T14 is set to a timing within which the first developing roller 61Y can start to move toward the separated position after the completion of development on the first photosensitive drum 50Y by the first developing roller 61Y and immediately after the completion of image transfer from the first photosensitive drum 50Y to the sheet S.

Then, the controller 2 determines (S221 in FIG. 20B) whether a fourth time period T24 has elapsed from the timing at which the back sensor 28C is turned OFF (t41). In a case where the fourth time period T24 has elapsed (S221: Yes), the controller 2 controls the K clutch 140K to be turned ON (S222, t43) to rotate the cam 150K. The fourth time period T24 is set to a timing within which the fourth developing roller 61K can be moved to the separated position after completion of development on the fourth photosensitive drum 50K by the fourth developing roller 61K and immediately after the completion of image transfer from the fourth photosensitive drum 50K to the sheet S.

Then, the controller 2 determines (S123 in FIG. 20A) whether the separation sensor 4C for the color of cyan outputs ON signal (separation signal). In a case where the controller 2 determines that the ON signal is outputted from the separation sensor 4C (S123: Yes), the controller 2 controls the YMC clutch 140A to be turned OFF (S124, t44) to stop rotation of the cams 150Y, 150M and 150C.

Then, the controller 2 determines (S223 in FIG. 20B) whether the separation sensor 4K for the color of black outputs ON signal (separation signal). In a case the ON signal is outputted from the separation sensor 4K (S223: Yes), the controller 2 controls the K clutch 140K to be turned OFF (S224, t45) to stop rotation of the cam 150K.

In the meantime, in FIG. 22, in a case where the prescribed flag F is set to "0" (S402: No) or in a case where the first sheet feed sensor 28A is already rendered ON before performing the preliminary sheet feeding operation (S410: Yes), the controller 2 performs the main sheet feeding operation (S440) without performing the preliminary sheet feeding operation (S421 to S423). The controller 2 controls the YMC clutch 140A to be turned ON (S112 in FIG. 20A, t34) to again rotate the cams 150Y, 150M and 150C upon receipt of ON signal from the first sheet feed sensor 28A (S11: Yes). Thereafter, the above-described process will be performed.

In a case where the monochromatic printing is to be performed (S3 in FIG. 19), the above-described process can be applied except that the YMC clutch 140A is not operated to maintain the developing rollers 61Y, 61M and 61C in their separated positions (that is, the process illustrated in FIG. 20A is not performed). Incidentally, the first time period T21 when the monochromatic printing is performed is different from the first time period T21 when the color printing is performed. Similarly, the second time period T22 when the monochromatic printing is performed is different from the second time period T22 when the color printing is performed.

<Functions and Effects in the Embodiment>

The image forming apparatus 1 of the present embodiment constructed as above exhibits advantageous functions and effects as described below.

Figure 25:
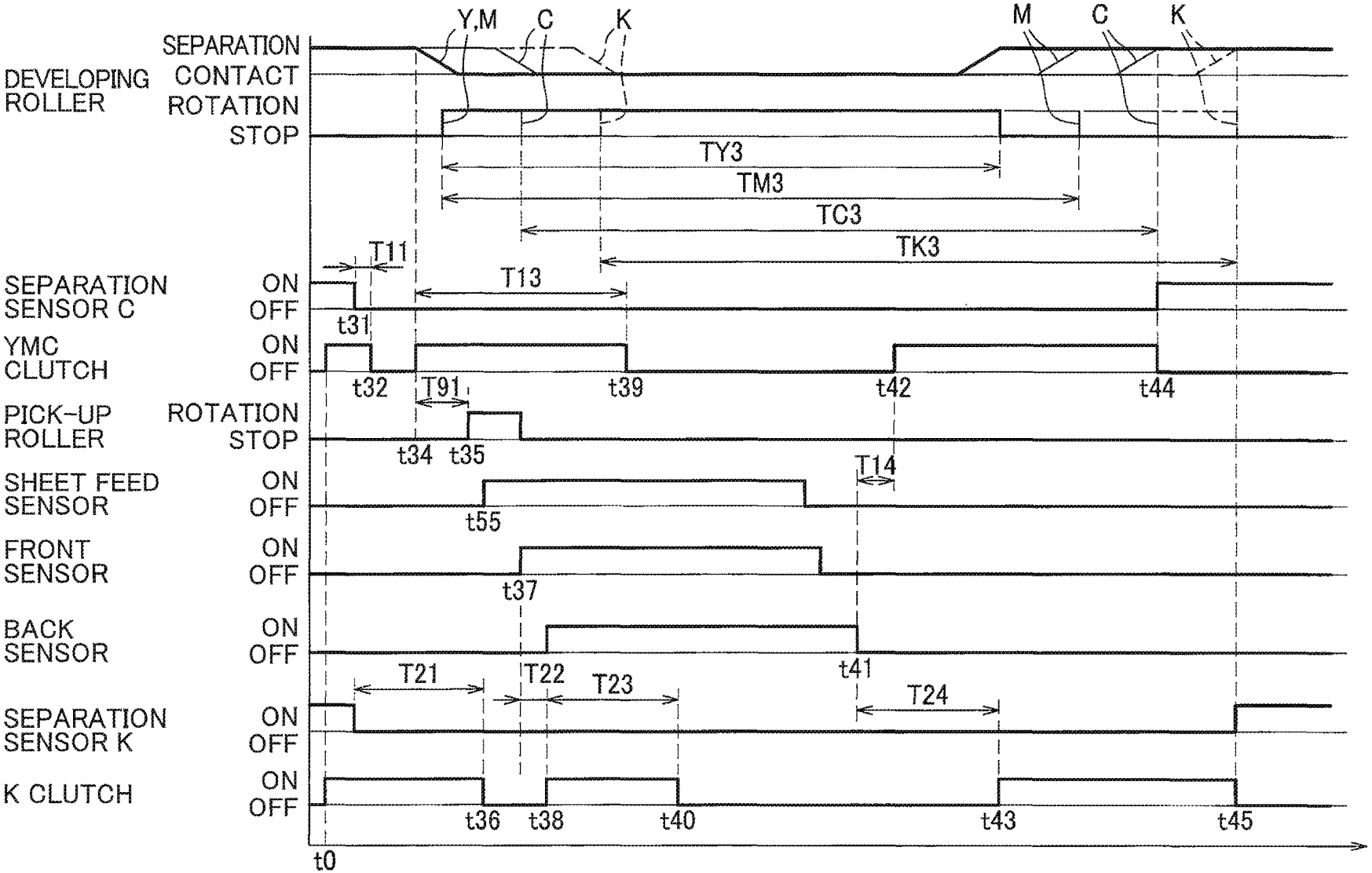
FIG. 25 is a timing chart for description of control to a pick-up roller, a YMC clutch and a K clutch in response to output from each sensor for performing printing in an image forming apparatus according to a comparative example.
Figure 26:
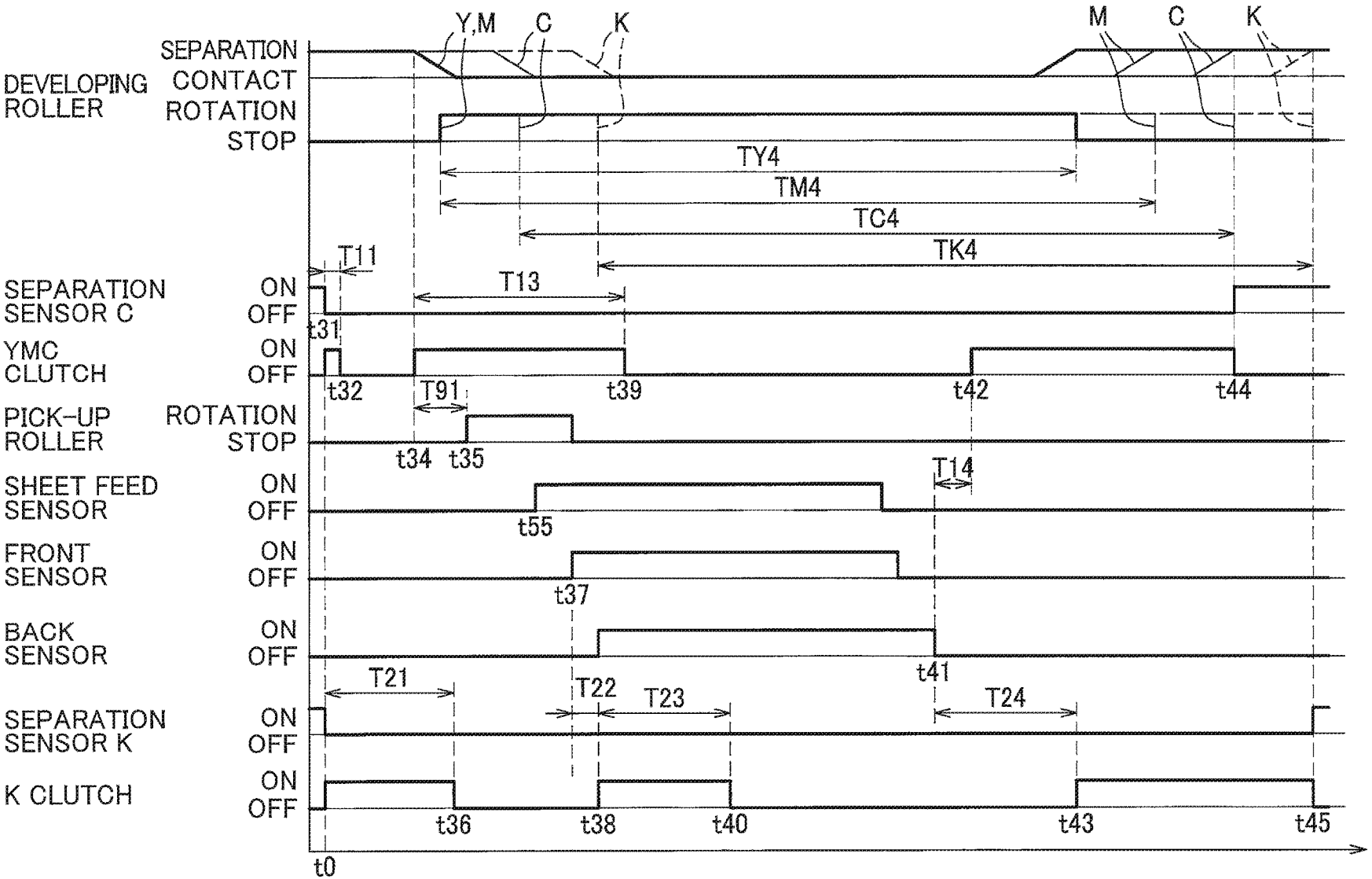
FIG. 26 is a timing chart for description of control to the pick-up roller, the YMC clutch and the K clutch in response to output from each sensor for performing printing in the image forming apparatus according to the comparative example, and particularly illustrating a case where a time period up to a timing at which the sheet fed from the sheet tray arrives at the transfer position is prolonged.

A comparative example is illustrated in FIGS. 25 and 26. According to the comparative example, the preliminary sheet feeding operation described above is not performed, but the pick-up roller 23 starts rotating (t35) after a prescribed time period T91 has elapsed from the start timing of the contacting operation in response to turning ON the YMC clutch 140A (t34) at the restart timing to feed a sheet S fed from the first tray 21 toward the transfer position.

Here, variation in sheet conveying time period (a time period from a timing at which the sheet S accommodated in the tray 21 or 31 is picked up by the corresponding pick-up roller 23 or 33 to a timing at which the sheet S arrives at the transfer position) may occur due to variation in position of the sheet S within the trays 21 or 31 or slippage occurred at a portion between the pick-up roller 23 or 33 and the sheet S.

In the configuration according to the comparative example, if the sheet conveying time period is prolonged as illustrated in FIG. 26, a time period from a timing at which the pick-up roller 23 starts rotation (t35) to a timing at which the first sheet feed sensor 28A turns ON in response to the detection of the leading edge of the sheet S (55) becomes greater than the corresponding time period illustrated in FIG. 25 where the sheet conveying time period is not prolonged.

Accordingly, in the case illustrated in FIG. 26, a subsequent timing at which the back sensor 28C is rendered OFF (t41) is delayed, so that the timings (t42, t43) at which the developing rollers 61 start moving from their respective contacting positions to the separated positions are also delayed. As a result, time periods TY4, TM4, TC4 and TK4 during which the developing rollers 61Y, 61M, 61C and 61K are in contact with the corresponding photosensitive drums 50Y, 50M, 50C and 50K in FIG. 26 are greater than time periods TY3, TM3, TC3 and TK3 in FIG. 25, respectively. That is, the following inequalities are satisfied: TY3<TY4; TM3<TM4; TC3<TC4; and TK3<TK4. Consequently, in case of FIG. 26, the developing rollers 61 and the corresponding photosensitive drums 50 must wait for arrival of the sheet S at the transfer position for a prolonged time period while maintaining contact therebetween.

Figure 23:
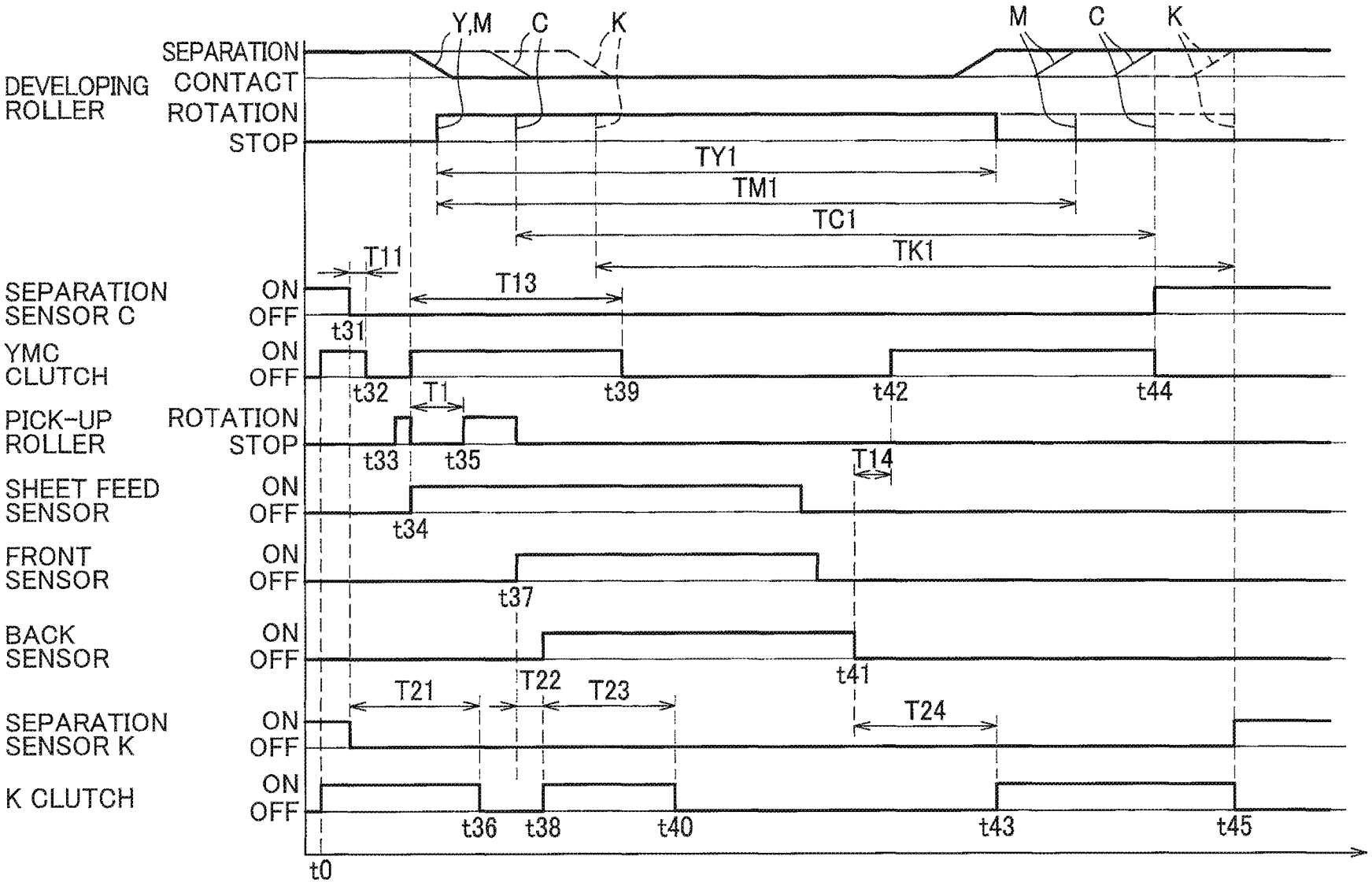
FIG. 23 is a timing chart for description of control of the pick-up roller, the YMC clutch and the K clutch in response to output from each sensor for performing printing in the image forming apparatus according to the embodiment.
Figure 24:
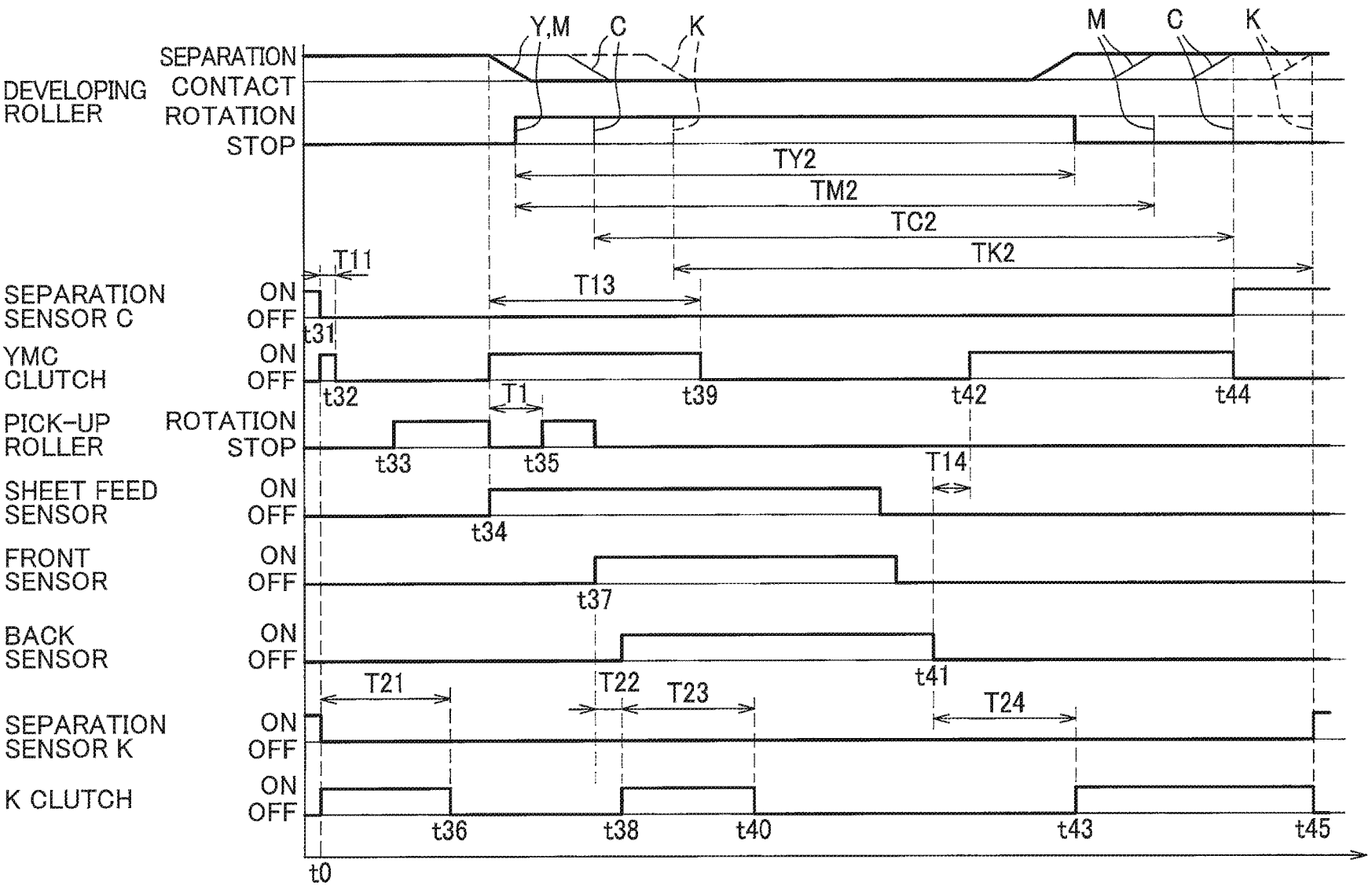
FIG. 24 is a timing chart for description of control to the pick-up roller, the YMC clutch and the K clutch in response to output from each sensor for performing printing in the image forming apparatus according to the embodiment, and particularly illustrating a case where a time period up to a timing at which the sheet fed from the sheet tray arrives at the transfer position is prolonged.

To the contrary, in the image forming apparatus 1 according to the embodiment, as illustrated in FIGS. 23 and 24, the preliminary sheet feeding operation is performed before starting the contacting operation so that the sheet S is preliminarily fed to the position at which the first sheet feed sensor 28A can detect the sheet S.

With this operation, variation in the conveying time period (particularly, the variation of a time period until the sheet S is discharged out of the tray 21 or 31) only affect the time period from the timing at which the pick-up roller 23 starts the rotation (t33) to the timing at which the first sheet feed sensor 28A turns on during the preliminary sheet feeding operation (t34), but does not affect the operation on or after the timing at which the pick-up roller 23 starts the rotation (t35) in the main sheet feeding operation.

Further, in the image forming apparatus 1 according to the present embodiment, the contacting operation is started upon turning ON the YMC clutch 140A at the restart timing at which the first sheet feed sensor 28A is rendered ON (t34) in the preliminary sheet feeding operation, and the pick-up roller 23 again starts the rotation (t35) after the prescribed time period T1 has elapsed from the timing at which the first sheet feed sensor 28A is rendered ON (t34) to feed the sheet S toward the transfer position. Therefore, the timing at which the back sensor 28C is rendered OFF (t41) is approximately constant irrespective of variation in the sheet conveying time period (the variation of a time period until the sheet S is discharged out of the tray 21 or 31).

Accordingly, time periods TY2, TM2, TC2 and TK2 during which the developing rollers 61Y, 61M, 61C and 61K are in contact with the corresponding photosensitive drums 50Y, 50M, 50C and 50K illustrated in FIG. 24 are almost equal to time periods TY1, TM1, TC1 and TK1 illustrated in FIG. 23, respectively, in spite of the fact that the sheet conveying time period in case of FIG. 24 is longer than that in case of FIG. 23. That is, the following equalities are satisfied: TY1=TY2; TM1=TM2; TC1=TC2; and TK1=TK2.

In this way, according to the present embodiment, even when the sheet conveying time period varies, the state where the developing rollers 61 and the corresponding photosensitive drums 50 wait for the arrival of the sheet S at the transfer position while maintaining the contact therebetween is not likely to occur. This is because the sheet S is fed to the photosensitive drum 50 while the developing rollers 61 are moved from the separated positions to the contacting positions after the sheet S is moved in advance to the position at which the sheet S is detected by the first sheet feed sensor 28A.

Further, since the time period during which the developing rollers 61 are in contact with the corresponding photosensitive drums 50 can be restrained from prolonging due to variation in the sheet conveying time period according to the present embodiment, wasteful contact between the developing rollers 61 and the corresponding photosensitive drum 50 due to the variation in the sheet conveying time period can be restrained, thereby prolonging the service life of the developing rollers 61.

Further, in the image forming apparatus 1 according to the embodiment, the driving force of the developing motor 3D is transmitted to the developing rollers 61 when the developing rollers 61 are at their respective contacting positions, whereas the driving force of the developing motor 3D is not transmitted to the developing rollers 61 when the developing rollers 61 are at their separated positions. Accordingly, the above configuration in which the wasteful contact between the developing rollers 61 and the photosensitive drums 50 are restrained can cause wasteful rotations of the developing rollers 61 to be reduced, thereby suppressing degradation of toner.

Further, in the image forming apparatus according to the present embodiment, the preliminary sheet feeding operation is not performed in the state where the sheet S fed from the first tray 21 is already fed to the position where the sheet S can be detected by the first sheet feed sensor 28A prior to start of the preliminary sheet feeding operation. In this case, the contacting operation and the main sheet feeding operation can be promptly performed while omitting the preliminary sheet feeding operation, thereby shortening a time period required for performing the entire of the printing operation.

Further, in the case where the printing operation is to be performed onto the sheet S fed from the first tray 21 during the execution of the normal mode, or in the case where the printing operation is to be performed onto the sheet S fed from the second tray 31, the main sheet feeding operation is performed to feed the sheet S from the tray 21 or 31 to the photosensitive drum 50 while omitting the preliminary sheet feeding operation provided that the movement of the developing rollers 61 from the separated positions to the contacting positions is ready in time for transferring an image to the sheet S even if the contacting operation is started on or after detection of the sheet S by the sheet feed sensor 28A or 38A after discharge of the sheet S from the tray 21 or 31. With the above operation, by omitting the preliminary sheet feeding operation, the time period required for performing the entire of the printing operation can be shortened.

Further, both the process motor 3P and the fixing motor 3F are provided separately from the developing motor 3D in the present embodiment. Therefore, the printing operation can be performed without changing rotation speeds of the process motor 3P and the fixing motor 3F, i.e., without changing the speed at which the sheets S are conveyed. Hence, the time period necessary for performing the entire of the printing operation can be reduced in comparison with a configuration where a single motor is only a drive source for movement of the developing rollers 61 and for conveyance of the sheet S so that the sheet conveying speed is dependent on a moving speed of the developing rollers 61.

<Modifications>

While the description has been made in detail with reference to the specific embodiment, it would be apparent to those skilled in the art that various changes and modifications may be made thereto.

For example, in the above-described embodiment, the contacting operation is performed upon the detection by the first sheet feed sensor 28A of the sheet S supplied through the preliminary sheet feeding operation. However, the contacting operation may be performed after a second prescribed time period has elapsed from the timing at which the first sheet feed sensor 28A detects the sheet S supplied through the preliminary sheet feeding operation.

That is, the contacting operation may be performed after the second prescribed time period has elapsed from the timing at which the first sheet feed sensor 28A detects the sheet S, and the main sheet feeding operation may be performed after the prescribed time period (the first time period T1) has elapsed from the timing at which the first sheet feed sensor 28A detects the sheet S.

Further, while the first sheet feed sensor 28A serves as an example of the first sheet sensor in the above-described embodiment, the front sensor 28B or the back sensor 28C is available as the first sheet sensor. Similarly, the second sheet feed sensor 38A serves as an example of the second sheet sensor in the above-described embodiment. However, the front sensor 28B or the back sensor 28C may be employed as the second sheet sensor.

Further, in the above-described embodiment, the preliminary sheet feeding operation is performed when the printing operation is to be performed onto the sheet S fed from the first tray 21 during execution of the low-speed mode, and the preliminary sheet feeding operation is not performed in the cases other than above. However, other operation may be performed in the image forming apparatus.

Specifically, the preliminary sheet feeding operation may be performed in a case where the printing operation is to be performed onto the sheet S fed from the first tray 21 (irrespective of the operation mode performed in the image forming apparatus) and in a case where the printing operation is to be performed onto the sheet S fed from the second tray 31 during the execution of the low-speed mode, and the preliminary sheet feeding operation may not be performed in a case where the printing operation is to be performed onto the sheet S fed from the second tray 31 during the execution of the normal mode.

Further, in the above-described embodiment, the image forming apparatus 1 includes two sheet trays, i.e., the first tray 21 and the second tray 31. However, the image forming apparatus 1 may further include a third tray such that a length of a conveying path from the third tray to the photosensitive drum 50 is greater than the length of the conveying length from the second tray 31 to the photosensitive drum 50.

According to this modification, the image forming apparatus may further include a third sheet feed sensor configured to detect passage of the sheet S and positioned between the third tray and the photosensitive drum 50. In a case where the printing operation is to be performed onto a sheet S fed from the third tray, the preliminary sheet feeding operation may not be performed regardless of the normal mode or the low-speed mode but the main sheet feeding operation may be performed for feeding the sheet S from the third tray toward the photosensitive drum 50, and the contacting operation may be performed on or after the third sheet feed sensor detects the passage of the sheet.

Alternatively, during the execution of the normal mode, the preliminary sheet feeding operation may be performed in a case where the printing operation is to be performed onto a sheet S fed from the first tray 21, but the preliminary sheet feeding operation may not be performed in a case where the printing operation is to be performed onto a sheet S supplied from the second or third tray. Further, during the execution of the low-speed mode, the preliminary sheet feeding operation may be performed in a case where the printing operation is to be performed on a sheet S fed from the first or second sheet tray, and the preliminary sheet feeding operation may not be performed in a case where the printing operation is to be performed on a sheet supplied fed from the third sheet tray.

Still alternatively, irrespective of the normal mode or the low-speed mode, the preliminary sheet feeding operation may be performed in a case where the printing operation is to be performed onto a sheet S supplied from the first tray, and the preliminary sheet feeding operation may not be performed in a case where the printing operation is to be performed on a sheet S fed from the sheet tray other than the first tray. As a further modification, regardless of from which the sheet S is fed, the preliminary sheet feeding operation may be performed in case of execution of the low-speed mode, and the preliminary printing operation may not be performed in case of execution of the normal mode.

Further, the image forming apparatus may include not less than four sheet trays, or may include only the first tray.

Further, in the image forming apparatus 1 according to the above-described embodiment, the normal mode (first mode) and the low-speed mode (second mode) can be selectively performed. However, it is not necessary to provide the above configuration in which the operation mode can be switched between the normal mode and the low-speed mode. That is, only a single operation mode may be performed in the image forming apparatus 1.

In a case where the single operation mode is employed, the image forming apparatus may perform the preliminary sheet feeding operation when the printing operation is to be performed onto the sheet S fed from the first tray 21, and may not perform the preliminary sheet feeding operation when the printing operation is performed onto the sheet S fed from the second tray 31.

Further, the image forming apparatus 1 according to the above-described embodiment is a color printer using toners of four colors. However, the image forming apparatus of the present disclosure may be a color printer employing toners of three colors or five colors for forming color images. As a further modification, the image forming apparatus may be a monochromatic printer provided with a single photosensitive drum, a single developing roller, and a single cam and using a toner of single color.

Further, a multifunction peripheral or a copying machine are also available as the image forming apparatus.

What is claimed is:

1. An image forming apparatus comprising:

a photosensitive drum;

a developing roller movable between a contacting position where the developing roller is in contact with the photosensitive drum and a separated position where the developing roller is separated from the photosensitive drum, the developing roller being configured to develop a latent image formed on the photosensitive drum into a toner image when the developing roller is in the contacting position;

a separation mechanism configured to move the developing roller between the contacting position and the separated position;

a first tray configured to accommodate a sheet therein;

a first sheet feed mechanism configured to feed the sheet from the first tray toward the photosensitive drum, the toner image being transferred from the photosensitive drum to the sheet in a state where the sheet is in confrontation with the photosensitive drum;

registration rollers positioned between the first tray and the photosensitive drum;

a first sheet sensor positioned at a prescribed position between the first tray and the registration rollers, the first sheet sensor configured to detect the sheet; and a controller configured to perform:

in a case where a printing operation is to be performed onto the sheet fed from the first tray, a step (a-1) of controlling the first sheet feed mechanism to feed the sheet accommodated in the first tray from the first tray toward the photosensitive drum;

a step (a-2) of controlling, in response to the first sheet sensor detecting the sheet, the first sheet feed mechanism to stop feeding the sheet whose leading edge is at a position between the first tray and the registration rollers;

a step (b) of controlling, on or after the first sheet sensor detects the sheet, the separation mechanism to move the developing roller from the separated position to the contacting position; and a step (c) of controlling, after a prescribed time period has elapsed since the first sheet sensor detects the sheet, the first sheet feed mechanism to feed the sheet from the prescribed position toward the photosensitive drum.

2. The image forming apparatus according to claim 1, wherein, in the case where the printing operation is to be performed onto the sheet fed from the first tray and in a case where the first sheet sensor already detects the sheet before starting the step (a-1), the controller is configured to perform the step (b) and the step (c) without performing the steps (a-1) and (a-2).

3. The image forming apparatus according to claim 1, further comprising:

a second tray configured to accommodate a sheet therein, the second tray providing a conveying path in cooperation with the photosensitive drum whose length is greater than a length of a conveying path provided between the first tray and the photosensitive drum;

a second sheet feed mechanism configured to feed the sheet accommodated in the second tray toward the photosensitive drum; and a second sheet sensor positioned between the second tray and the photosensitive drum and configured to detect passage of the sheet, wherein, the controller is configured to perform:

in a case where the printing operation is to be performed onto the sheet fed from the second tray, a step (d) of controlling the second sheet feed mechanism to feed the sheet accommodated in the second tray toward the photosensitive drum; and a step (e) of controlling, on or after the second sheet sensor detects the sheet, the separation mechanism to move the developing roller to the contacting position.

4. The image forming apparatus according to claim 3, wherein the second sheet sensor is configured to detect the passage of the sheet fed from the second tray.

5. The image forming apparatus according to claim 1, further comprising:

a motor; and a power transmission mechanism configured to transmit a driving force from the motor to the developing roller when the developing roller is at the contacting position and to interrupt transmitting the driving force of the motor to the developing roller when the developing roller is at the separated position.

6. The image forming apparatus according to claim 1, further comprising:

a first motor configured to supply a driving force to the separation mechanism; and a second motor provided separately from the first motor and configured to supply a driving force to the first sheet feed mechanism, wherein the controller is configured to perform one of a first mode in which the first motor is rotated at a first rotation speed and a second mode in which the first motor is rotated at a second rotation speed lower than the first rotation speed, wherein, while the second mode is performed, the developing roller is movable between the contacting position and the separated position at a speed lower than a speed at which the developing roller is movable while the first mode is performed, wherein, in a case where the printing operation is to be performed onto the sheet fed from the first tray while the first mode is performed, the controller is configured to perform:

a step (f) of controlling the first sheet feed mechanism to feed the sheet accommodated in the first tray toward the photosensitive drum; and the step (b), and wherein, in a case where the printing operation is to be performed onto the sheet fed from the first tray while the second mode is performed, the controller is configured to perform:

the step (a-1);

the step (a-2)

the step (b); and the step (c).

7. The image forming apparatus according to claim 6, further comprising a power transmission mechanism configured to transmit the driving force of the first motor to the developing roller when the developing roller is at the contacting position and to interrupt transmitting the driving force of the first motor to the developing roller when the developing roller is at the separated position.

8. The image forming apparatus according to claim 1, wherein the first sheet sensor is configured to detect the passage of the sheet fed from the first tray.

9. The image forming apparatus according to claim 1, further comprising:

a second sheet sensor positioned between the first sheet sensor and the registration rollers, the second sheet sensor being configured to detect the sheet;

wherein, in step (a-2), the controller controls, in response to the first sensor detecting the sheet and the second sheet sensor not detecting the sheet, the first sheet feed mechanism to stop feeding the sheet whose leading edge is at a position between the first sheet tray and the second sheet sensor.

10. The image forming apparatus according to claim 1, further comprising:

a second sheet sensor positioned between the registration rollers and the photosensitive drum, the second sheet sensor being configured to detect a trailing edge of the sheet;

wherein the controller is configured to further perform: in the case where the printing operation is to be performed onto the sheet fed from the first tray, a step of controlling, after a prescribed time has elapsed since the second sheet sensor detects the trailing edge of the sheet, the separation mechanism to move the developing roller from the contacting position back to the separated position.

11. An image forming apparatus comprising:

a photosensitive drum;

a developing roller movable between a contacting position where the developing roller is in contact with the photosensitive drum and a separated position where the developing roller is separated from the photosensitive drum;

a separation mechanism configured to move the developing roller between the contacting position and the separated position;

a first tray configured to accommodate a sheet therein;

a first sheet feed mechanism configured to feed the sheet from the first tray toward the photosensitive drum;

a first sheet sensor positioned at a prescribed position between the first tray and the photosensitive drum and configured to detect passage of the sheet; and a controller configured to perform:

in a first case where a printing operation is to be performed onto the sheet fed from the first tray, a step (a) of controlling the first sheet feed mechanism to feed the sheet accommodated in the first tray to the prescribed position and to maintain the sheet at the prescribed position;

a step (b) of controlling, on or after the first sheet sensor detects the sheet, the separation mechanism to move the developing roller to the contacting position; and a step (c) of controlling, after a prescribed time period has elapsed since the first sheet sensor detects the sheet, the first sheet feed mechanism to feed the sheet from the prescribed position toward the photosensitive drum;

in a second case where the first sheet sensor already detects the sheet before starting the step (a), the controller is configured to perform the step (b) and the step (c) without performing the step (a).

12. An image forming apparatus comprising:

a photosensitive drum;

a developing roller movable between a contacting position where the developing roller is in contact with the photosensitive drum and a separated position where the developing roller is separated from the photosensitive drum;

a separation mechanism configured to move the developing roller between the contacting position and the separated position;

a first tray configured to accommodate a sheet therein;

a first sheet feed mechanism configured to feed the sheet from the first tray toward the photosensitive drum;

a first sheet sensor positioned at a prescribed position between the first tray and the photosensitive drum and configured to detect passage of the sheet;

a first motor configured to supply a driving force to the separation mechanism;

a second motor provided separately from the first motor and configured to supply a driving force to the first sheet feed mechanism; and a controller configured to perform one of a first mode in which the first motor is rotated at a first rotation speed and a second mode in which the first motor is rotated at a second rotation speed lower than the first rotation speed, wherein, while the second mode is performed, the developing roller is movable between the contacting position and the separated position at a speed lower than a speed at which the developing roller is movable while the first mode is performed:

wherein in a first case where a printing operation is to be performed onto the sheet fed from the first tray while the second mode is performed, the controller is configured to perform:

a step (a) of controlling the first sheet feed mechanism to feed the sheet accommodated in the first tray to the prescribed position and to maintain the sheet at the prescribed position;

a step (b) of controlling, on or after the first sheet sensor detects the sheet, the separation mechanism to move the developing roller to the contacting position; and a step (c) of controlling, after a prescribed time period has elapsed since the first sheet sensor detects the sheet, the first sheet feed mechanism to feed the sheet from the prescribed position toward the photosensitive drum;

wherein, in a second case where the printing operation is to be performed onto the sheet fed from the first tray while the first mode is performed, the controller is configured to perform:

a step (d) of controlling the first sheet feed mechanism to feed the sheet accommodated in the first tray toward the photosensitive drum; and the step (b).

13. An image forming apparatus comprising:

a photosensitive drum;

a developing roller movable between a contacting position where the developing roller is in contact with the photosensitive drum and a separated position where the developing roller is separated from the photosensitive drum;

a separation mechanism configured to move the developing roller between the contacting position and the separated position;

a first tray configured to accommodate a sheet therein;

a first sheet feed mechanism configured to feed the sheet from the first tray toward the photosensitive drum;

a first sheet sensor positioned between the first tray and the photosensitive drum and configured to detect the sheet;

a second sheet sensor positioned between the first sheet sensor and the photosensitive drum and configured to detect the sheet; and a controller configured to perform:

in a case where a printing operation is to be performed onto the sheet fed from the first tray, a step (a-1) of controlling the first sheet feed mechanism to feed the sheet accommodated in the first tray to a prescribed position between the first sheet sensor and the second sheet sensor;

a step (a-2) of controlling, in response to the first sensor detecting the sheet and the second sensor not detecting the sheet, the first sheet feed mechanism to stop feeding the sheet whose leading edge is at a position between the first sheet sensor and the second sheet sensor;

a step (b) of controlling the separation mechanism to move the developing roller from the separated position to the contacting position in response to the first sheet sensor detecting the sheet and the second sensor not detecting the sheet; and a step (c) of controlling, after a prescribed time period has elapsed since the first sheet sensor detects the sheet, the first sheet feed mechanism to feed the sheet from the prescribed position toward the photosensitive drum.

14. An image forming apparatus comprising:

a photosensitive drum;

a developing roller;

a separation mechanism configured to move the developing roller between a contacting position where the developing roller is in contact with the photosensitive drum and a separated position where the developing roller is separated from the photosensitive drum, the developing roller being configured to develop a latent image formed on the photosensitive drum into a toner image when the developing roller is in the contacting position;

a first tray configured to accommodate a sheet therein;

a first sheet feed mechanism configured to feed the sheet from the first tray toward an image transfer position where the toner image is transferred onto the sheet;

registration rollers positioned between the first tray and the image transfer position;

a first sheet sensor positioned at a prescribed position between the first tray and the registration rollers, the first sheet sensor configured to detect the sheet; and a controller configured to:

(a-1) when a printing operation is to be performed onto the sheet fed from the first tray, control the first sheet feed mechanism to start feeding the sheet accommodated in the first tray from the first tray toward the image transfer position;

(a-2) in response to the first sheet sensor detecting the sheet, control the first sheet feed mechanism to stop feeding the sheet whose leading edge is at a position between the first tray and the registration rollers;

(b) on or after the first sheet sensor detects the sheet, control the separation mechanism to move the developing roller from the separated position to the contacting position, thereby enabling the developing roller to develop the latent image formed on the photosensitive drum into the toner image; and (c) after a prescribed time period has elapsed since the first sheet sensor detects the sheet, control the first sheet feed mechanism to restart feeding the sheet, whose leading edge is positioned between the first tray and the registration rollers, toward the image transfer position.

15. The image forming apparatus according to claim 14, wherein the image transfer position is a position where the toner image is transferred from the photosensitive drum toward the sheet in a state where the sheet is in confrontation with the photosensitive drum.

16. An image forming apparatus comprising:

a photosensitive drum;

a developing roller;

a separation mechanism configured to move the developing roller between a contacting position where the developing roller is in contact with the photosensitive drum and a separated position where the developing roller is separated from the photosensitive drum, the developing roller being configured to develop a latent image formed on the photosensitive drum into a toner image when the developing roller is in the contacting position;

a first tray configured to accommodate a sheet therein;

a first sheet feed mechanism configured to feed the sheet from the first tray toward an image transfer position where the toner image is transferred onto the sheet;

a first sheet sensor positioned between the first tray and the image transfer position, the first sheet sensor being configured to detect the sheet;

a second sheet sensor positioned between the first sheet sensor and the image transfer position, the second sheet sensor being configured to detect the sheet; and a controller configured to:

(a-1) when a printing operation is to be performed onto the sheet fed from the first tray, control the first sheet feed mechanism to start feeding the sheet accommodated in the first tray toward the image transfer position;

(a-2) in response to the first sensor detecting the sheet and the second sensor not detecting the sheet, control the first sheet feed mechanism to stop feeding the sheet whose leading edge is at a position between the first sheet sensor and the second sheet sensor;

(b) in response to the first sheet sensor detecting the sheet and the second sensor not detecting the sheet, control the separation mechanism to move the developing roller from the separated position to the contacting position, thereby enabling the developing roller to develop the latent image formed on the photosensitive drum into the toner image; and (c) after a prescribed time period has elapsed since the first sheet sensor detects the sheet, control the first sheet feed mechanism to restart feeding the sheet, whose leading edge is at the position between the first sheet sensor and the second sheet sensor, toward the image transfer position.

17. The image forming apparatus according to claim 16, wherein the image forming position is a position where the toner image is transferred from the photosensitive drum toward the sheet in a state where the sheet is in confrontation with the photosensitive drum.

* * * * *